US006568989B1

(12) United States Patent
Molnar

(10) Patent No.: US 6,568,989 B1
(45) Date of Patent: May 27, 2003

(54) SEMICONDUCTOR WAFER FINISHING CONTROL

(75) Inventor: Charles J Molnar, Wilmington, DE (US)

(73) Assignee: Beaver Creek Concepts Inc, Wilmington, DE (US)

( * ) Notice: Subject to any disclaimer, the term of this patent is extended or adjusted under 35 U.S.C. 154(b) by 0 days.

(21) Appl. No.: 09/538,409

(22) Filed: Mar. 29, 2000

Related U.S. Application Data

(60) Provisional application No. 60/127,393, filed on Apr. 1, 1999, provisional application No. 60/128,278, filed on Apr. 8, 1999, and provisional application No. 60/128,281, filed on Apr. 8, 1999.

(51) Int. Cl.[7] ..... B24B 1/00

(52) U.S. Cl. ..... 451/5; 451/8; 451/41

(58) Field of Search ..... 451/5, 8, 9, 10, 451/11, 36, 4, 41; 216/38, 88–89, 91; 252/79.1; 438/690, 691, 692, 693

(56) References Cited

U.S. PATENT DOCUMENTS

| | | | | |
|---|---|---|---|---|
| 4,421,068 | A | 12/1983 | Aral | |
| 5,069,002 | A | 12/1991 | Sandhu | 51/165 R |
| 5,107,445 | A | 4/1992 | Jensen | 36/525 |
| 5,137,544 | A | 8/1992 | Medillin | 51/308 |
| 5,154,512 | A | 10/1992 | Schietinger | 374/9 |
| 5,166,080 | A | 11/1992 | Schietinger | 437/7 |

(List continued on next page.)

FOREIGN PATENT DOCUMENTS

| | | |
|---|---|---|
| WO | WO 98/08919 | 3/1998 |
| WO | WO 99/64527 | 12/1999 |
| WO | WO 00/00561 | 1/2000 |
| WO | WO 00/00576 | 1/2000 |

OTHER PUBLICATIONS 6204181 withdrawn from issue, Molnar, filed Nov. 5, 2001, published mar. 20, 2001, Ser. No. 09/435180.

"Understanding and Using Cost of Ownership", Wright Williams & Kelly, Dublin, CA, rev 0595–1.

"Intermetal Dielectric Cost–of–Ownership", Case, C.B. and Case, C. J., *Semiconductor International,* Jun. 1995, pp 83–88.

"Using COO to select Nitride PECVD clean cycle", Anderson, Bob, et al., Semiconductor International, Oct. 1993, pp 86–88.

"The application of cost of ownership simulation to wafer sort and final test", Jimez, D. W. et al., SEMI's Manufacturing test Conference, Jul., 1993.

"Reducing Tungsten Deposition equipment cost of ownership through in situ contamination prevention and reduction", Burghard, R. W., et al., *Microcontamination,* Oct. 1992, pp 23–25.

"Reducing ion–implant equipment cost of ownship through in situ contamination prevention and control", Burghard, R. W., et al., *Microcontamination,* Sep. 1992, pp 27–30.

"Reducing ion–implant equipment cost of ownship through in situ contamination prevention and control", Burghard, R. W., et al., *Microcontamination,* Jun. 1992, pp 33–36.

(List continued on next page.)

*Primary Examiner*—Timothy V. Eley

(57) ABSTRACT

A method of in situ control for finishing semiconductor wafers to improve cost of ownership is discussed. A method to use business calculations combined with physical measurements to improve control. The use of boundary lubricating layer control in the operative finishing interface and business calculations to improve the cost of finishing semiconductor wafers is discussed. The method aids control of differential lubricating boundary layers and improved differential finishing of semiconductor wafers. Planarization and localized finishing can be improved using differential lubricating boundary layer methods of finishing.

64 Claims, 16 Drawing Sheets

U.S. PATENT DOCUMENTS

| | | | | |
|---|---|---|---|---|
| 5,196,353 | A | 3/1993 | Sandhu | 437/7 |
| 5,308,438 | A | 5/1994 | Cote | 156/636 |
| 5,314,843 | A | 5/1994 | Yu | 437/225 |
| 5,340,370 | A | 8/1994 | Cadien | 51/38 |
| 5,352,277 | A | 10/1994 | Sasaki | 106/6 |
| 5,413,941 | A | 5/1995 | Koos | 437/8 |
| 5,595,526 | A | 1/1997 | Yau | 451/8 |
| 5,597,442 | A | 1/1997 | Chen | 156/626.1 |
| 5,609,511 | A | 3/1997 | Moriyama | 451/5 |
| 5,609,517 | A | 3/1997 | Lofaro | 451/529 |
| 5,614,444 | A | 3/1997 | Farkas | 437/225 |
| 5,639,388 | A | 6/1997 | Kimura | 216/84 |
| 5,643,060 | A | 7/1997 | Sandhu | 451/285 |
| 5,647,952 | A | 7/1997 | Chen | 156/636.1 |
| 5,667,629 | A | 9/1997 | Pan | 438/13 |
| 5,685,766 | A | 11/1997 | Mattingly | 451/36 |
| 5,691,895 | A | 11/1997 | Kurtzberg et al. | |
| 5,695,384 | A | 12/1997 | Beratan | 451/28 |
| 5,695,660 | A | 12/1997 | Litvak | 216/85 |
| 5,722,879 | A | 3/1998 | Cronin | 451/281 |
| 5,728,308 | A | 3/1998 | Muroyama | 216/88 |
| 5,733,176 | A | 3/1998 | Robinson | 451/41 |
| 5,733,819 | A | 3/1998 | Kodama | 438/692 |
| 5,735,036 | A | 4/1998 | Barr | 29/603.12 |
| 5,738,562 | A | 4/1998 | Doan | 451/5 |
| 5,740,033 | A | 4/1998 | Wassick et al. | |
| 5,743,784 | A | 4/1998 | Birang | 451/21 |
| 5,749,769 | A | 5/1998 | Church | 451/5 |
| 5,759,917 | A | 6/1998 | Grover et al. | 438/690 |
| 5,762,537 | A | 6/1998 | Sandhu | 451/7 |
| 5,783,489 | A | 7/1998 | Kaufman | 438/692 |
| 5,830,280 | A | 11/1998 | Sato | 134/2 |
| 5,833,519 | A | 11/1998 | Moore | 451/56 |
| 5,842,909 | A | 12/1998 | Sandhu | 451/7 |
| 5,858,813 | A | 1/1999 | Scherber | 438/693 |
| 5,860,847 | A | 1/1999 | Sakurai et al. | 451/10 |
| 5,876,266 | A | 3/1999 | Miller | 451/56 |
| 5,876,470 | A | 3/1999 | Ronay | 106/3 |
| 5,885,137 | A | 3/1999 | Ploessl | 106/3 |
| 5,885,334 | A | 3/1999 | Suzuki | 438/639 |
| 5,906,754 | A | 5/1999 | Appel | 216/88 |
| 5,910,041 | A | 6/1999 | Duescher | 451/28 |
| 5,916,855 | A | 6/1999 | Avanzino | 51/307 |
| 5,919,082 | A | 7/1999 | Walker | 451/41 |
| 5,934,978 | A | 8/1999 | Burke | 451/36 |
| 5,945,347 | A | 8/1999 | Wright | 438/692 |
| 5,954,975 | A | 9/1999 | Cadien | 216/38 |
| 5,954,997 | A | 9/1999 | Kaufman | 252/79.1 |
| 5,958,794 | A | 9/1999 | Bruxuoort | 438/692 |
| 5,968,280 | A | 10/1999 | Ronay | 134/2 |
| 5,972,793 | A | 10/1999 | Tseng | 438/692 |
| 5,985,045 | A | 11/1999 | Kobayashi | 148/240 |
| 5,993,298 | A | 11/1999 | Duescher | 451/56 |
| 6,291,349 | B1 | 3/2000 | Molnar | 438/690 |
| 6,121,143 | A | 9/2000 | Messner et al. | 438/692 |
| 6,197,604 | B1 | 3/2001 | Miller et al. | 438/14 |
| 6,263,255 | B1 | 7/2001 | Tan et al. | |
| 6,267,644 | B1 | 7/2001 | Molnar | 451/41 |
| 6,298,470 | B1 | 8/2001 | Breiner et al. | |
| 6,283,829 | B1 | 9/2001 | Molnar | 451/8 |
| 6,293,851 | B1 | 9/2001 | Molnar | 451/41 |

OTHER PUBLICATIONS

"Reducing ion–implant equipment cost of ownship through in situ contamination prevention and control", Burghard, R. W., et al., *Microcontamination,* May. 1992, pp 21–24.

"Cost of ownership for inspection equipment", Dance D. and Bryson, P., Sematech, Austin, Texas, date unknown.

Berman, Mike et al., "Review of in Situ and in Line Detection for CMP Applic.", Semiconductor Fabtech, 8$^{th}$ edition, pp. 267–274.

Bibby, Thomas, "Endpoint Detection for CMP", Journal of Electronic Materials, vol. 27, #10, 1998, pp. 1073–1081.

Pd99a

SEMICONDUCTOR WAFER FINISHING CONTROL

This application claims the benefit of Provisional Application serial No. 60/127,393 filed on Apr. 1, 1999 entitled "Control of semiconductor wafer finishing"; Provisional Application serial No. 60/128,278 filed on Apr. 8, 1999 entitled "Improved semiconductor wafer finishing control" and Provisional Application serial No. 60/128,281 filed on Apr. 8, 1999 entitled Semiconductor wafer finishing with partial organic boundary layer lubricant"; and Utility Patent Application with Ser. No. 09/435,181 filed on Nov. 5, 1999 with title "In situ friction detector method for finishing semiconductor wafers". All Provisional and Utility Applications which this application claims benefit to are included herein by reference in their entirety.

BACKGROUND ART

Chemical mechanical polishing (CMP) is generally known in the art. For example U.S. Pat. No. 5,177,908 issued to Tuttle in 1993 describes a finishing element for semiconductor wafers, having a face shaped to provide a constant, or nearly constant, surface contact rate to a workpiece such as a semiconductor wafer in order to effect improved planarity of the workpiece. U.S. Pat. No. 5,234, 867 issued 867 to Schultz et. al. in 1993 describes an apparatus for planarizing semiconductor wafers which in a preferred form includes a rotatable platen for polishing a surface of the semiconductor wafer where a motor for rotating the platen and a non-circular pad is mounted atop the platen to engage and polish the surface of the semiconductor wafer. Fixed abrasive finishing elements are also known for polishing semiconductor layers. An example is WO 98118159 PCT application by Minnesota Mining and Manufacturing.

Semiconductor wafer fabrication generally requires the formation of layers of material having particularly small thicknesses. A typical conductor layer, such as a metallization layer, is generally 2,000 to 6,000 angstroms thick and a typical insulating layer, for example an oxide layer, is generally 3,000 to 5,000 angstroms thick. The actual thickness is at least partially dependent on the function of the layer along with the function and design of the semiconductor wafer. A gate oxide layer can be less than 100 angstroms thick while a field oxide is in the thousands of angstroms in thickness. In higher density and higher value semiconductor wafers the layers can be below 500 angstroms in thickness. Generally during semiconductor fabrication, layers thicker than necessary are formed and then thinned down to the required tolerances with techniques needed such as Chemical Mechanical Polishing. Because of the strict tolerances, extreme care is given to attaining the required thinned down tolerances. As such, it is important to accurately control the thinning of the layer during the thinning process and also as it reaches the required tolerances. The end point for the thinning or polishing operation is the final required tolerances. One current method to remove selected amounts of material is to remove the semiconductor wafer periodically from polishing for measurements such as thickness layer measurements. Although this can be done it is time consuming and adds extra expense to the operation. Further the expensive wafers can be damaged during transfer to or from the measurement process further decreasing process yields and increasing costs. Further, merely controlling finishing in a manner that stops polishing at the endpoint, misses the important aspect of controlling the polishing process itself where defects such as microscratches and other unwanted surface defects can occur. In fact, microscratches which are deep enough to penetrate the target surface can occur before the target surface depth is reached causing lower yields and lost product. Microscratches and other unwanted surface defects formed during polishing can adversely lower the polishing yield adding unnecessary expense to the polishing step in semiconductor wafer manufacture.

Confidential applicant evaluations show that the control of the finishing step is very complex. The chemical mechanical finishing step has multiple process control parameters. The manufacturing cost for the chemical mechanical finishing step is also complex. To effectively evaluate the cost of manufacture for a chemical mechanical finishing step requires the evaluation of multiple variables, and each with varying effects on the cost of manufacture. Further, some of the variables compete against each other. For instance, a higher finishing rate can lower some aspects of the cost of manufacture such as fixed costs but can also increase other aspects, such as reducing yields. Thus there is a need to evaluate in real time the effects on the cost of manufacture. Confidential analysis shows that there are some particularly preferred parameters of the cost of manufacture to use for real time process control of chemical mechanical polishing. Tracking the semiconductor wafer as it undergoes multiple polishing steps to update and change the manufacturing cost model used for effective cost control is unknown.

As discussed above, there is a need for an in situ control for a chemical mechanical polishing method which improves the cost of manufacture for a polishing step. There is a need for chemical mechanical polishing method which controls the operative finishing interface during polishing using a cost of manufacture model. There is a need for a cost of manufacture model which tracks the semiconductor wafer during its various polishing steps and uses a cost of manufacture model appropriate to that individual polishing step. There is a need for sensors which monitor the operative finishing interface in a manner that improves the ability to control and improve the cost of manufacture for a particular polishing step.

It is an advantage of this invention to develop is in an situ control subsystem which improves the cost of manufacture for a polishing step. It is an advantage of this invention to develop a finishing method which improves control of the operative finishing interface during polishing using a cost of manufacture model. It is an advantage of this invention to develop a method to use metrics related to cost of manufacture to improve control of the semiconductor wafer cost during its various polishing steps and to use this control to improve the manufacturing cost in situ at one or more individual finishing steps. It is an advantage of this invention to develop a preferred method which uses preferred sensors which monitor the operative finishing interface in a manner that improves the ability to control and improve the cost of manufacture for multiple and particular polishing steps.

These and other advantages of the invention will become readily apparent to those of ordinary skill in the art after reading the following disclosure of the invention.

BRIEF DESCRIPTION OF DRAWING FIGURES

Figure 5:
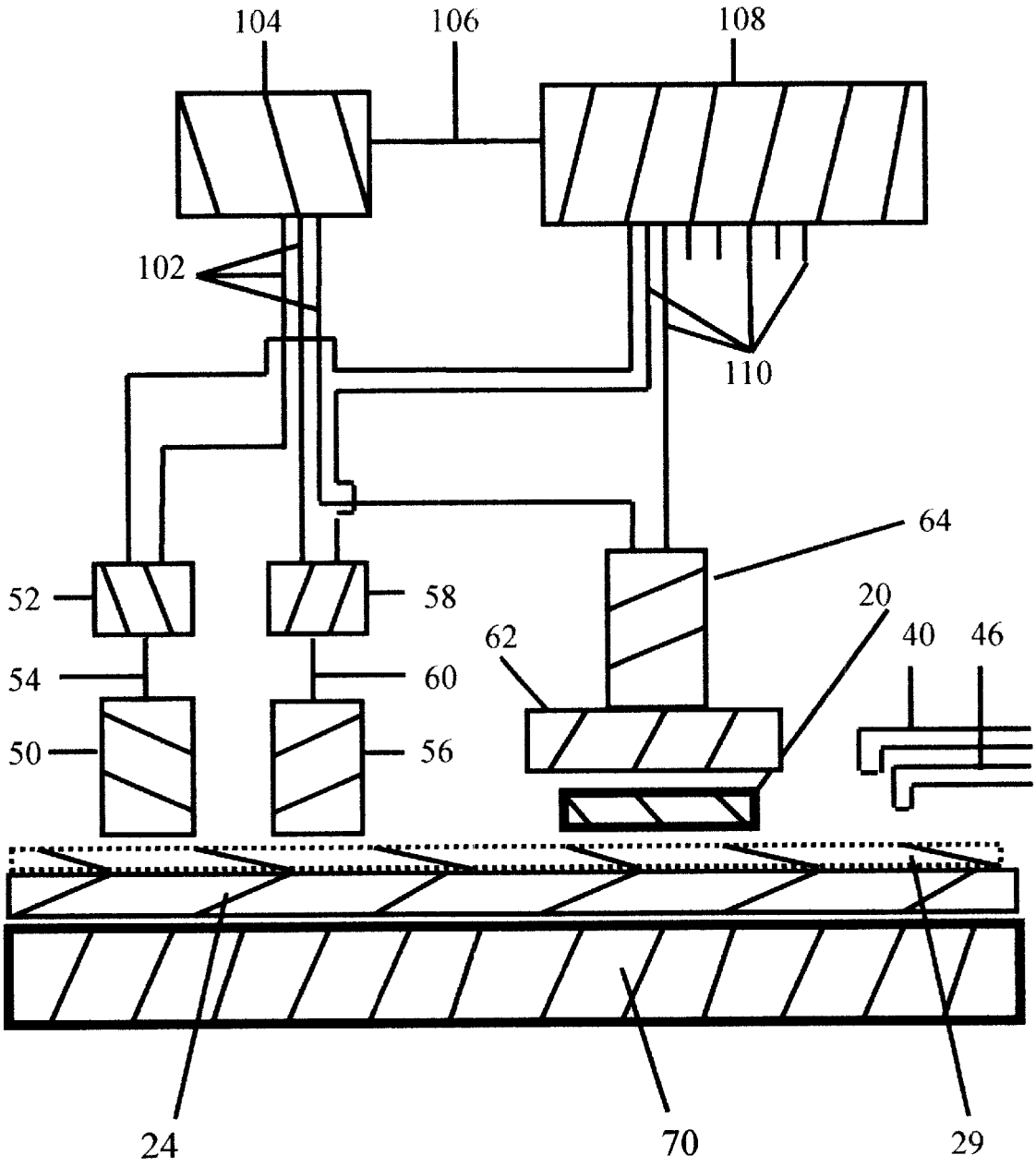
Figure 6:
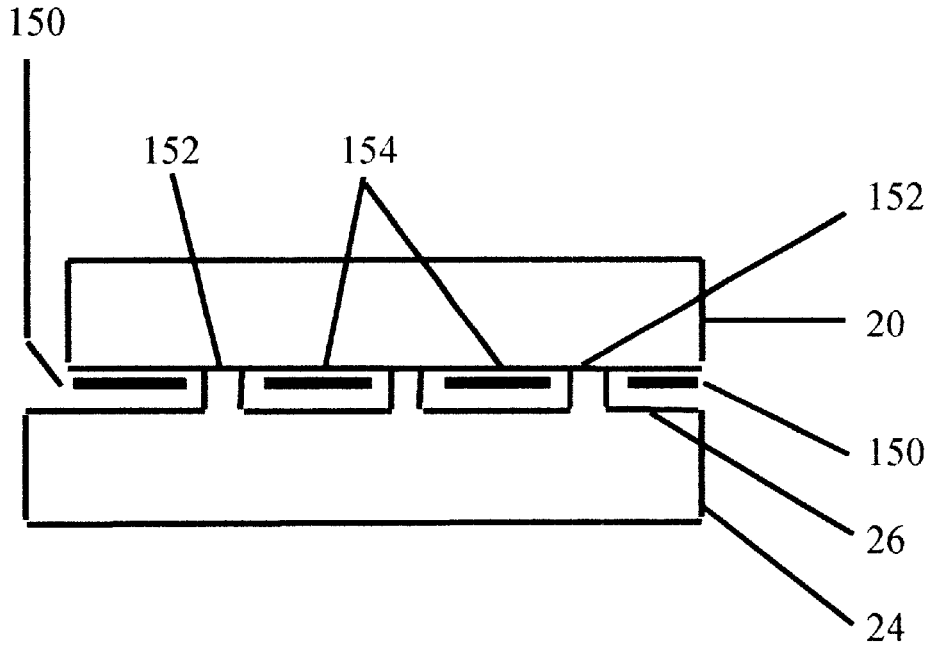
Figure 7:
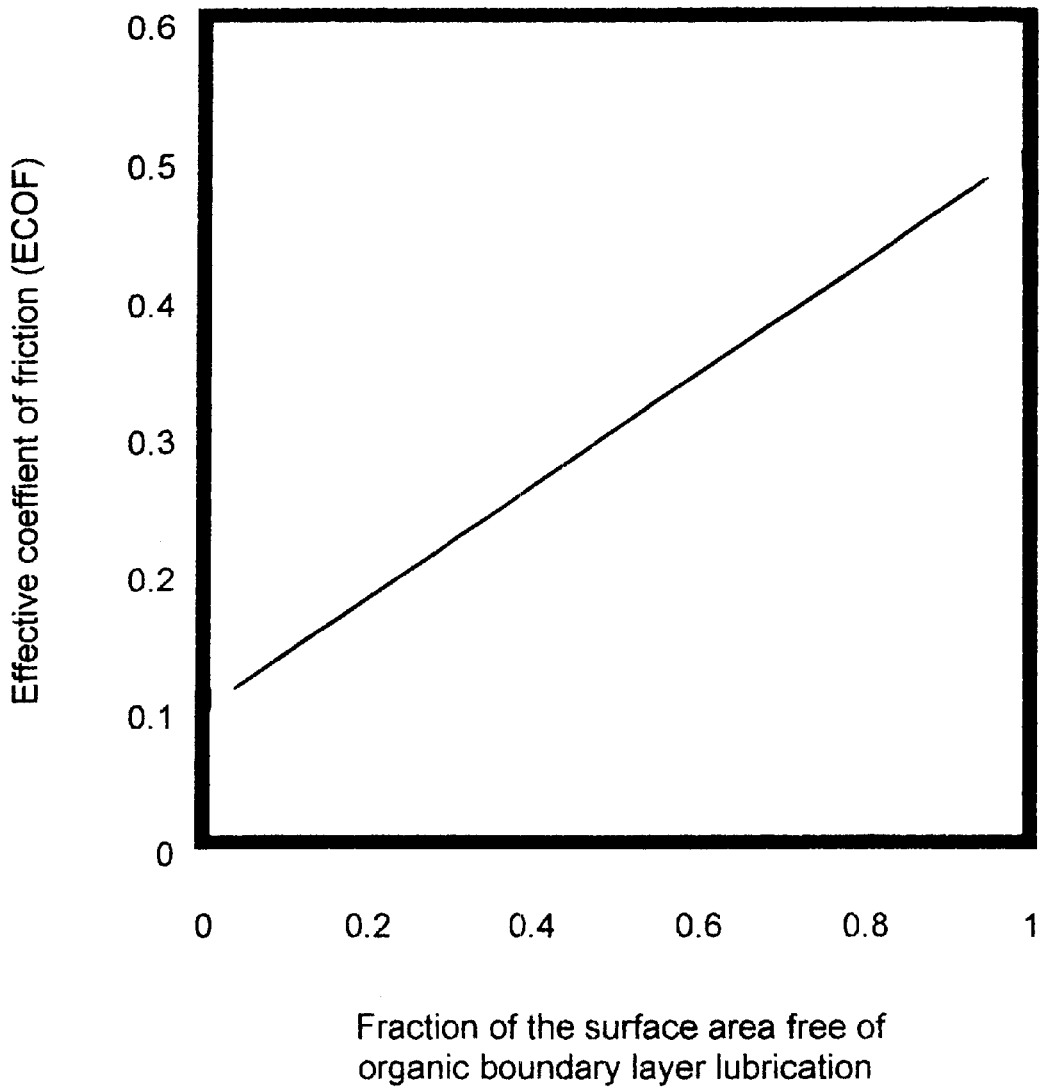
Figure 8:
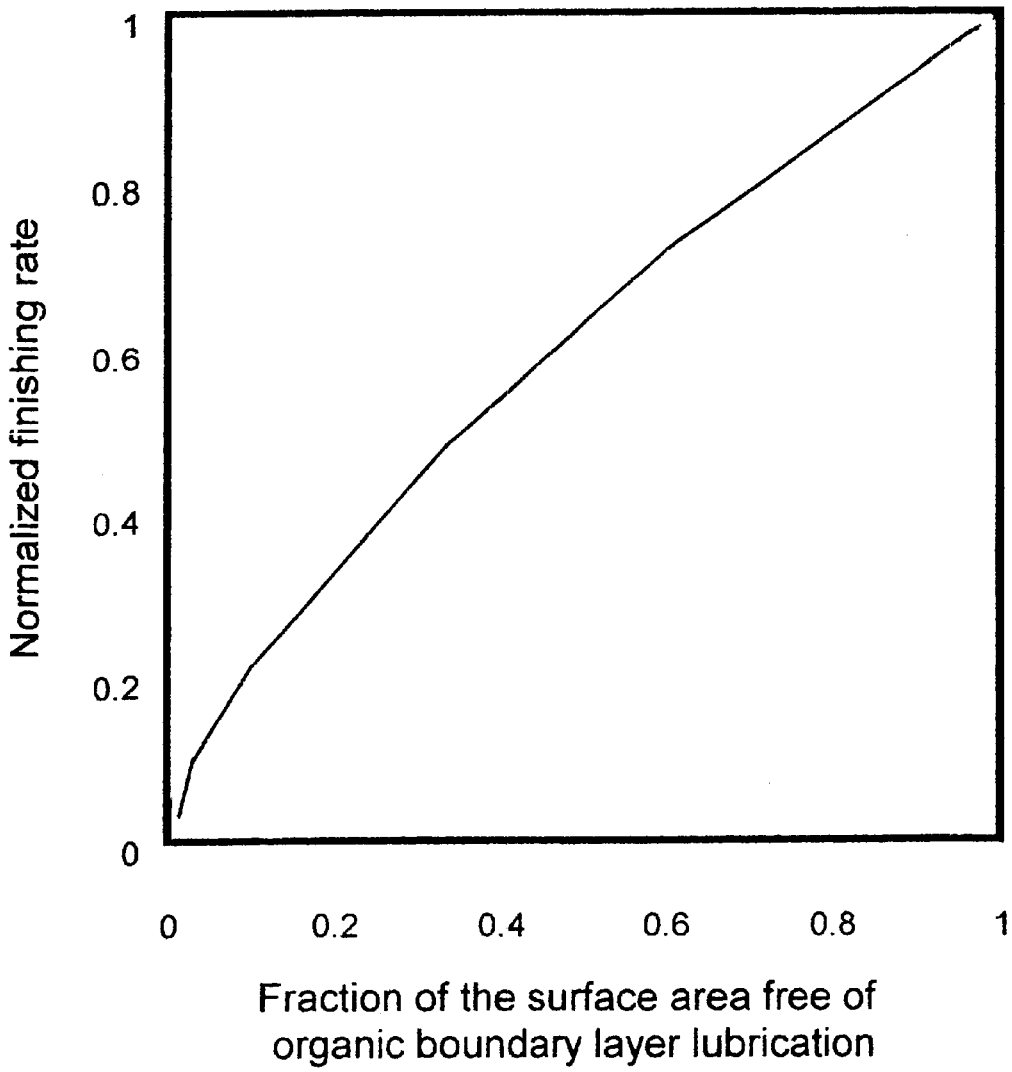
Figure 9:
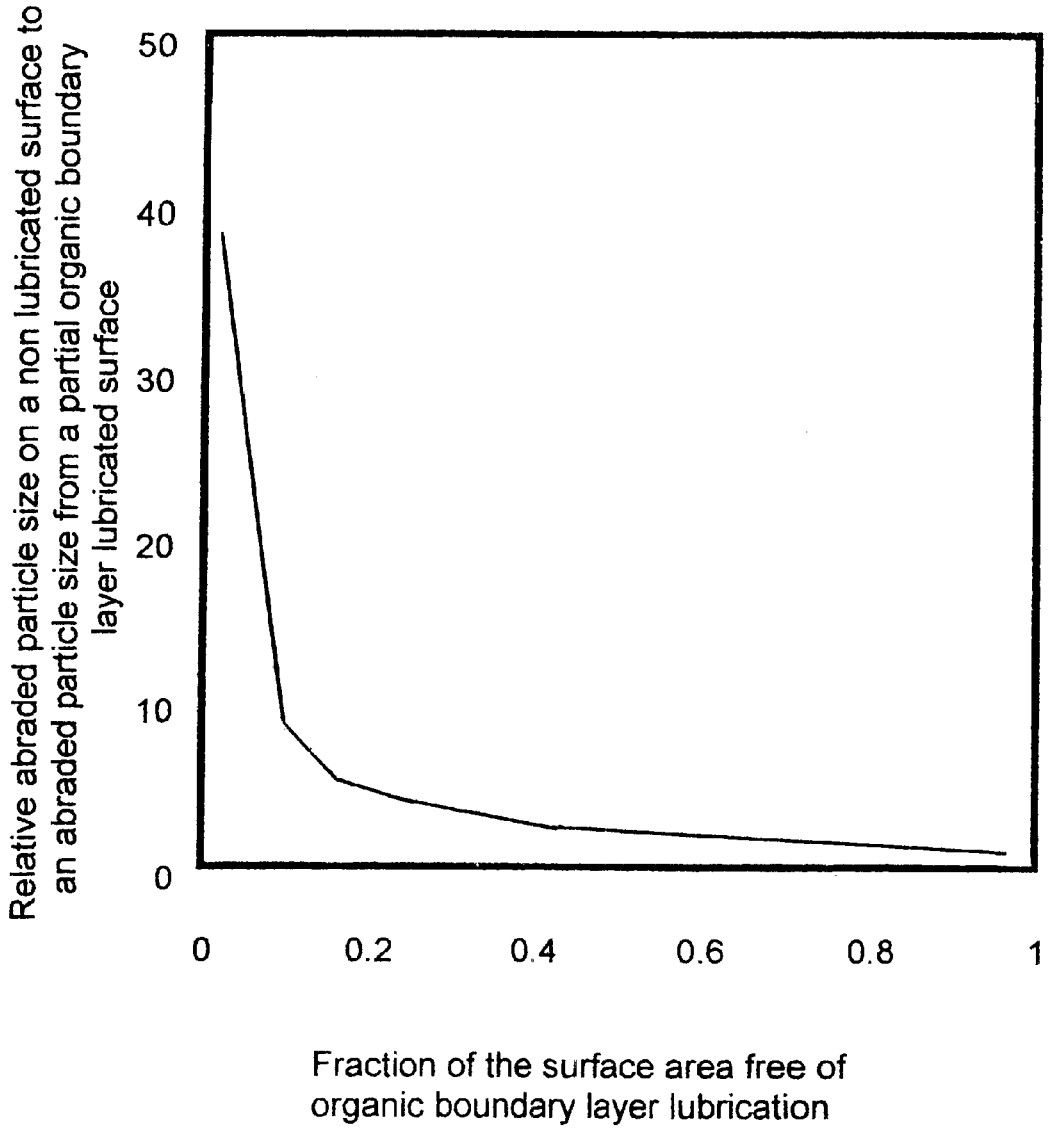
Figure 10:
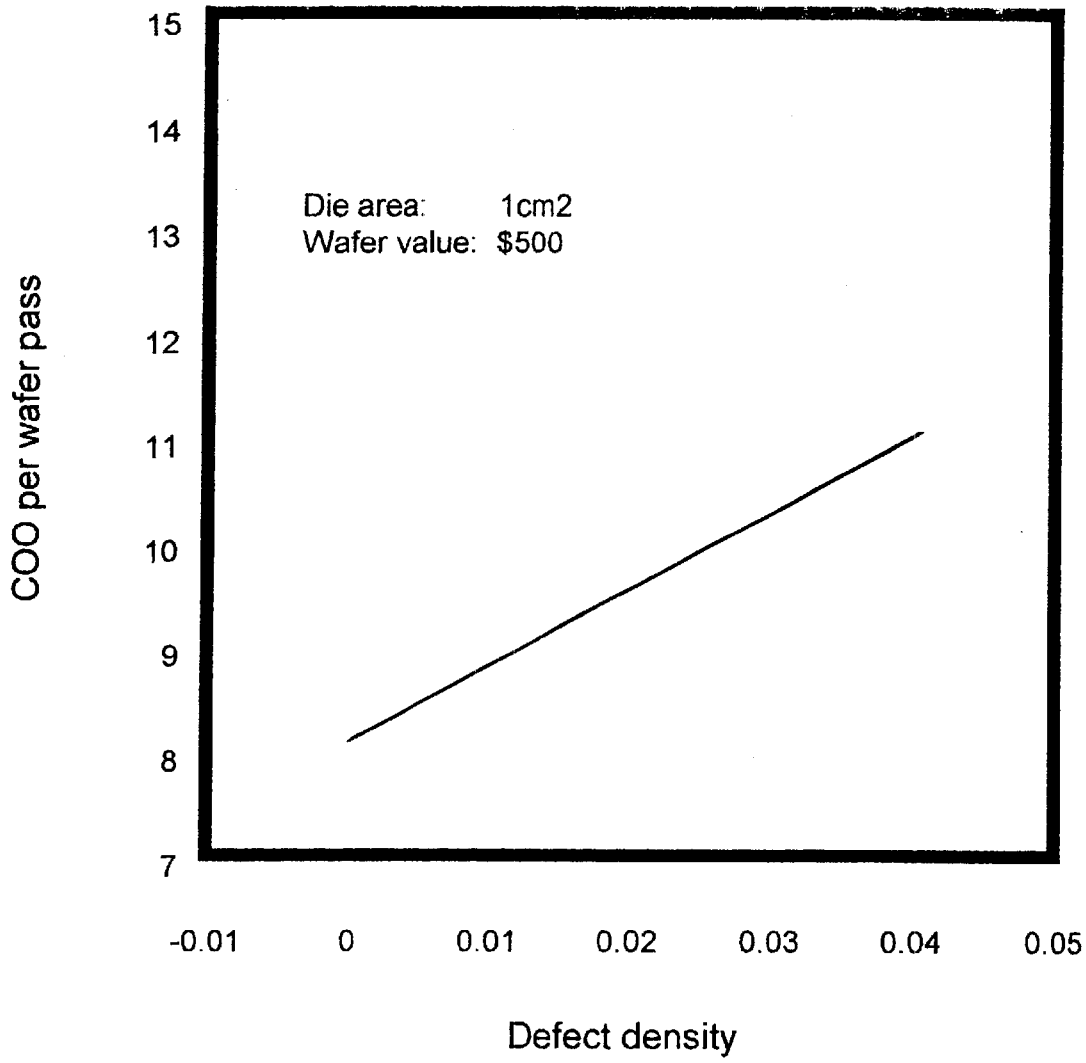
Figure 11:
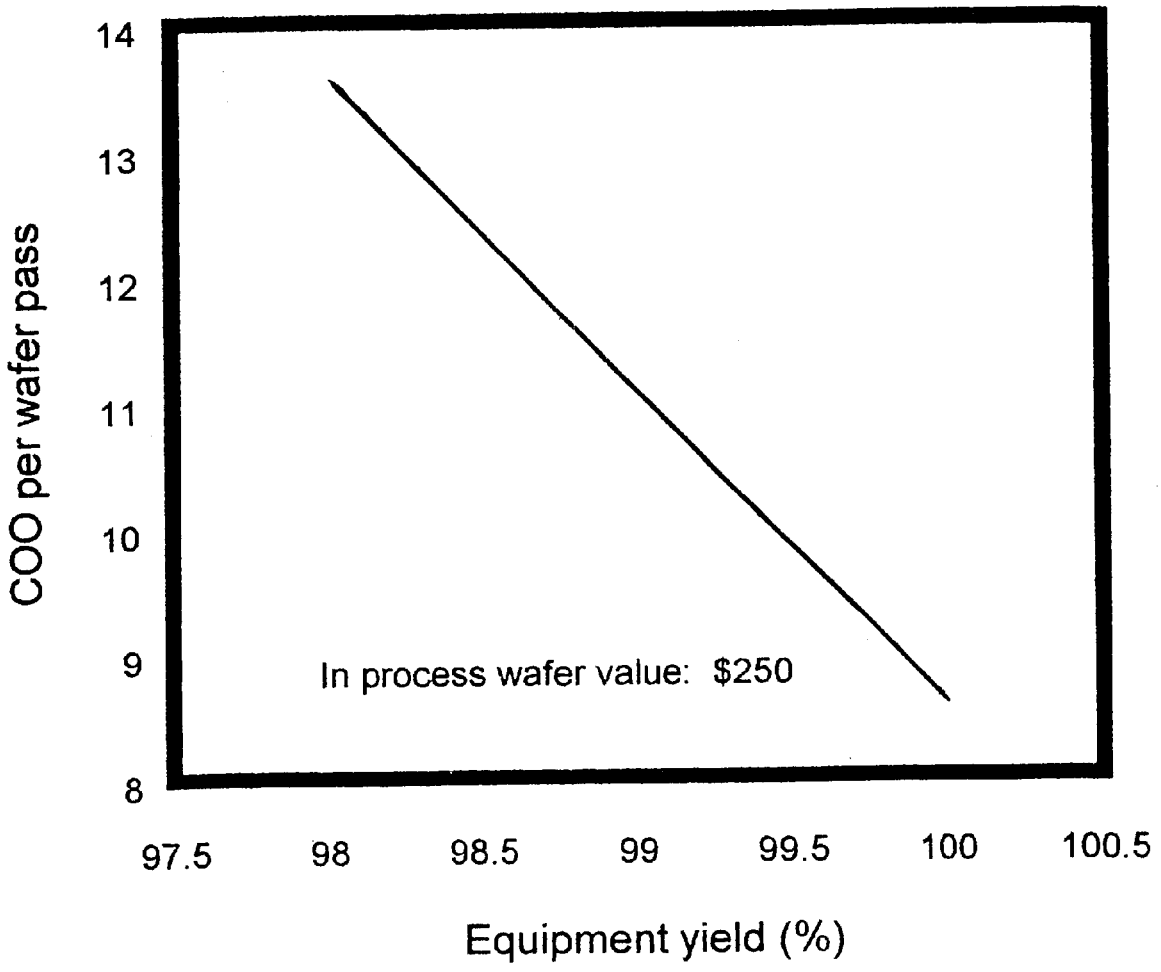
Figure 12:
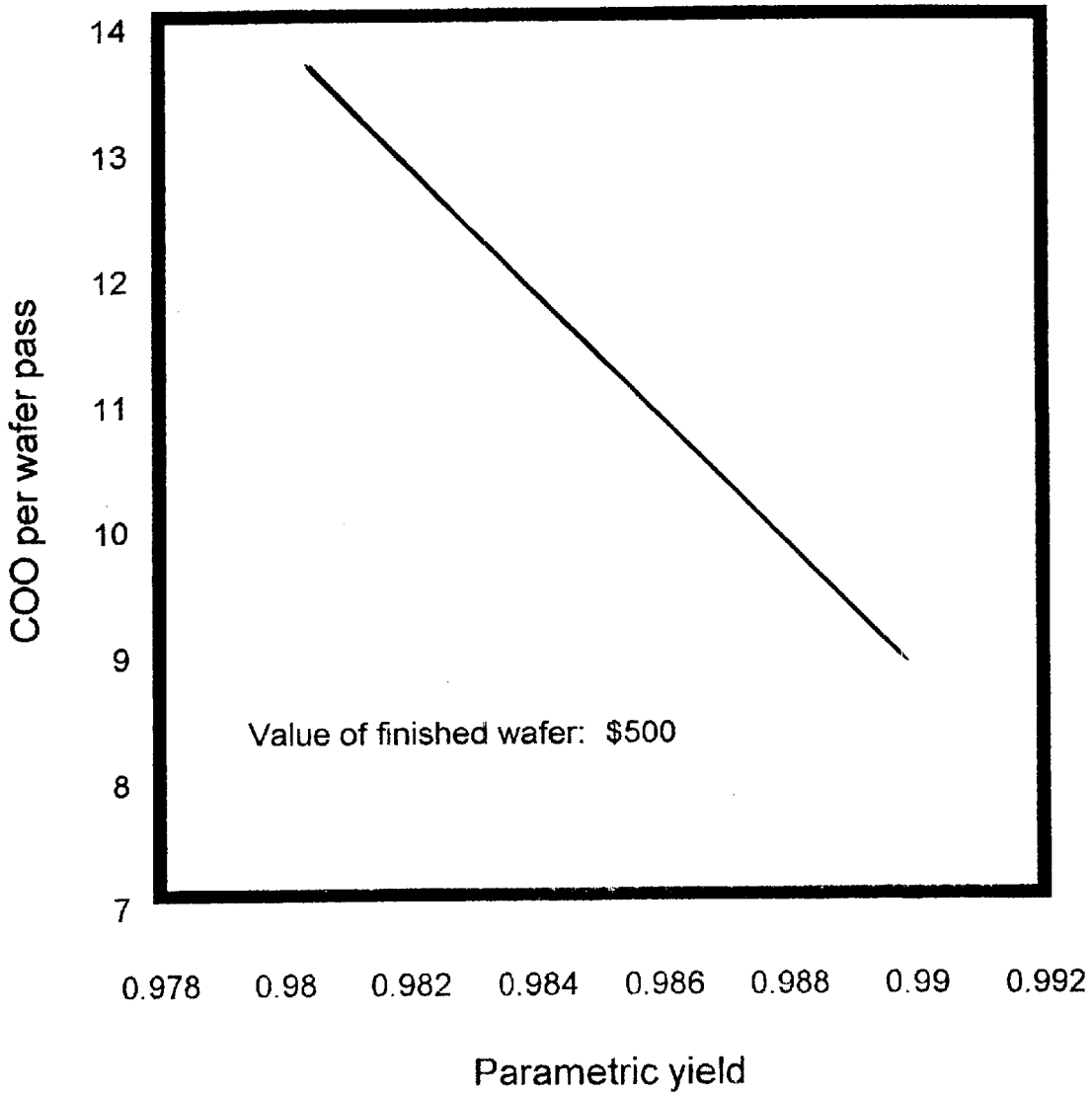
Figure 13:
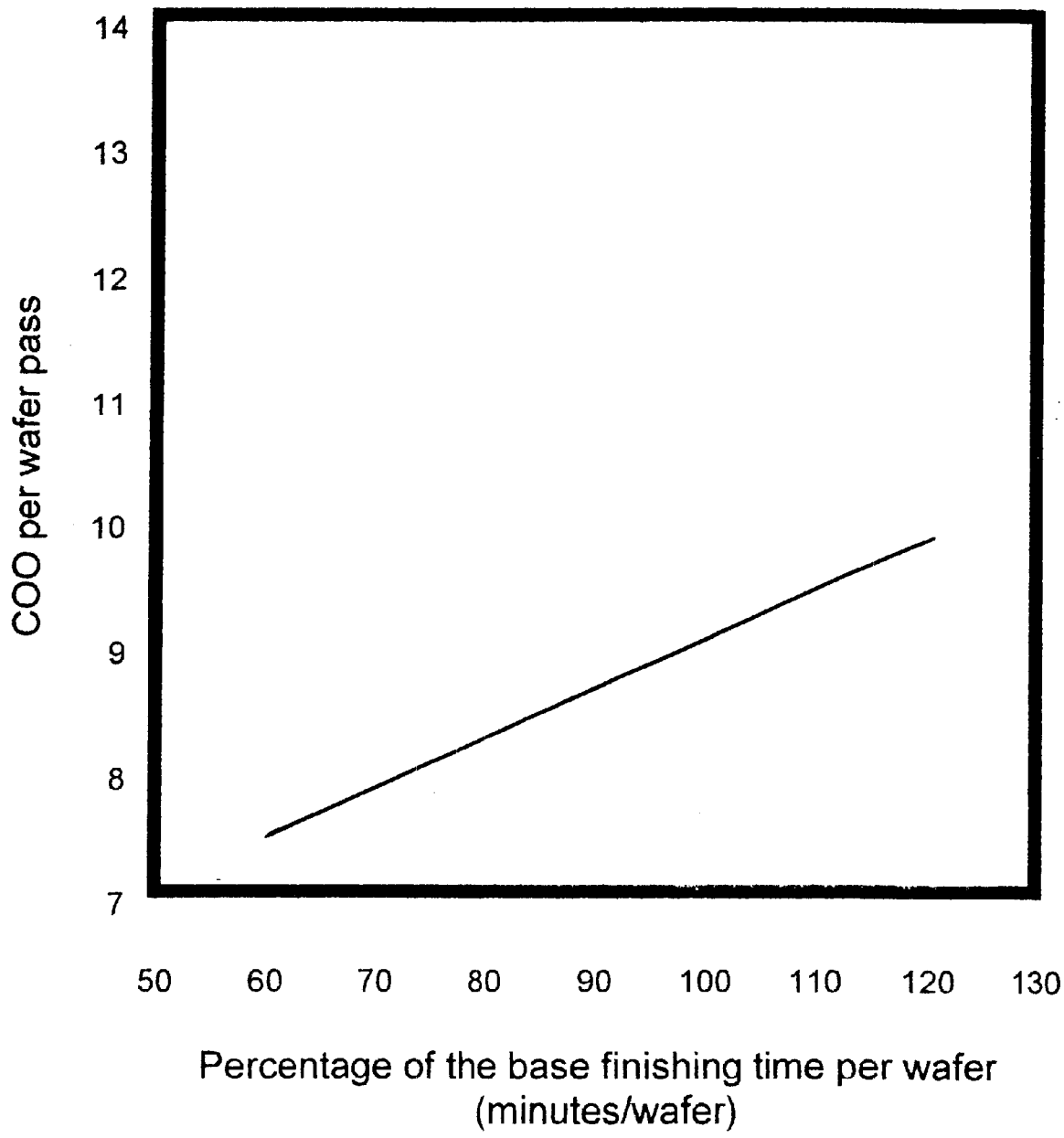
Figure 14A:
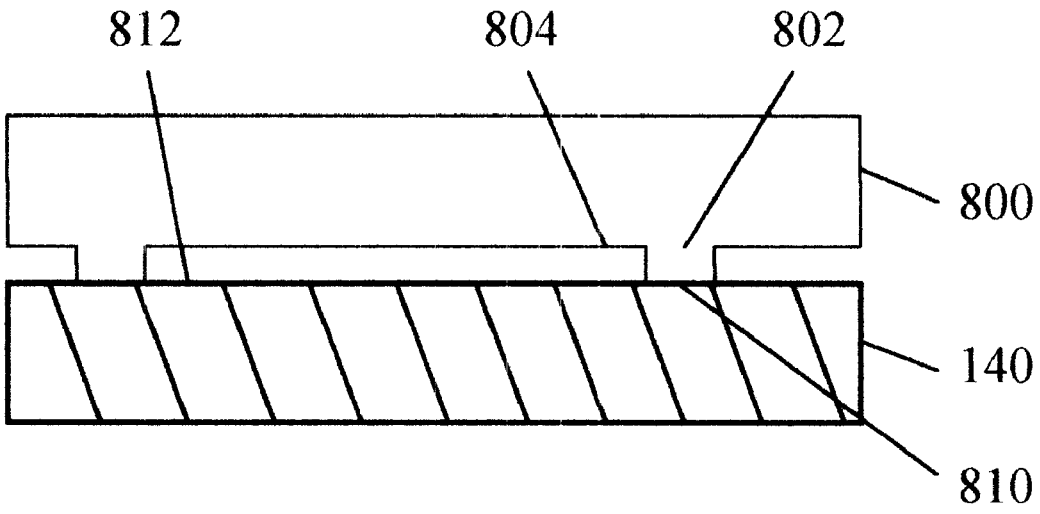
Figure 14B:
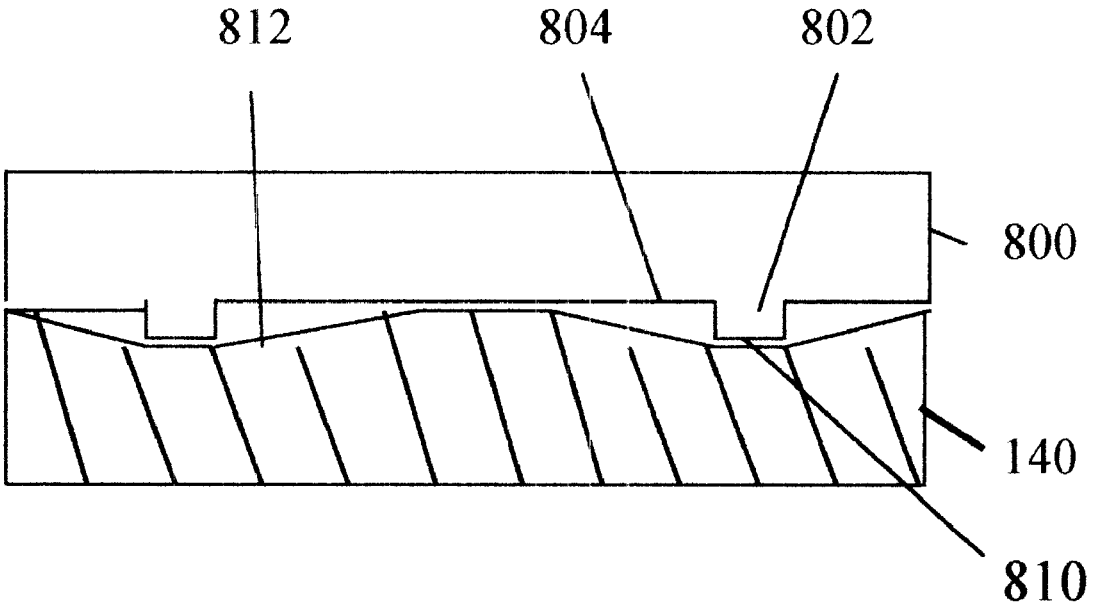

FIG. 5 is an artist's simplified view of the some major components in a finishing sensor FIG. 6 is an artist's representation of a micro-region of the operative finishing interface showing some of the regions having an effective organic boundary layer lubrication and some of the regions being free of organic boundary lubrication FIG. 7 is a graph of the effective COF vs the fraction of the surface area free of organic boundary lubricant layer FIG. 8 is a plot of the normalized finishing rate as a function of surface area free of organic boundary layer lubrication FIG. 9 is a plot of relative abraded particle size on a non lubricated surface to the abraded particle size on an organic boundary layer lubricated surface vs. fraction of the surface area free of organic boundary layer lubrication FIG. 10 is a plot of cost of ownership vs defect density FIG. 11 is a plot of cost of ownership vs equipment yield FIG. 12 is a plot of cost of ownership vs parametric yield loss FIG. 13 is a plot of finishing rate effect on cost of ownership FIG. 14 is an artist's representation of finishing some unwanted raised regions and some regions below the unwanted raised regions with differential boundary lubrication.

Figure 15:
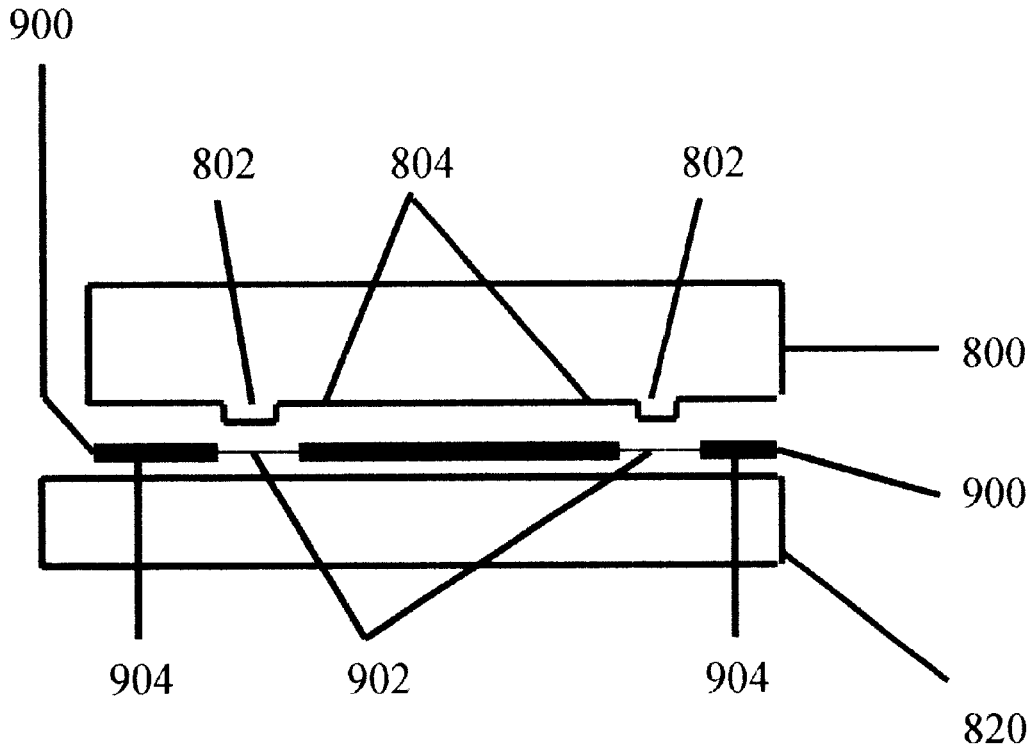
Figure 16:
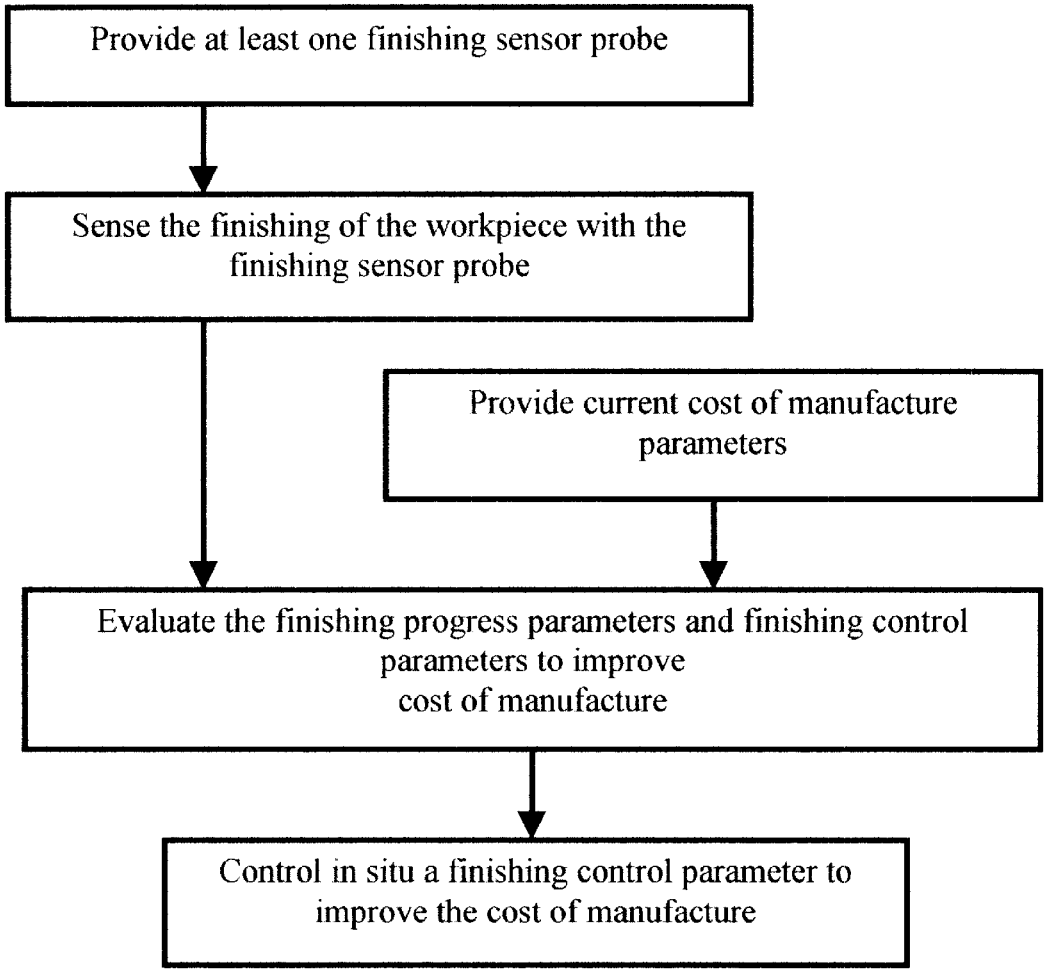

FIG. 15 is an artist's representation of an example of the effects on the boundary layer lubrication FIG. 16 includes preferred steps in one embodiment of the control semiconductor wafer finishing

REFERENCE NUMERALS IN DRAWINGS

Reference Numeral 20 workpiece
Reference Numeral 21 workpiece surface facing away from the workpiece surface being finished.
Reference Numeral 22 surface of the workpiece being finished
Reference Numeral 23 center of rotation of the workpiece
Reference Numeral 24 finishing element
Reference Numeral 26 finishing element finishing surface
Reference Numeral 28 finishing element surface facing away from workpiece surface being finished
Reference Numeral 29 finishing composition and, optionally, alternate finishing composition
Reference Numeral 30 direction of rotation of the finishing element finishing surface
Reference Numeral 32 direction of rotation of the workpiece being finished
Reference Numeral 33 pressure applied to the operative finishing interface substantially perpendicular to the finishing motion
Reference Numeral 34 operative finishing motion between the workpiece surface being finished and the finishing element finishing surface
Reference Numeral 35 applied pressure between the workpiece surface being finished and the finishing element finishing surface
Reference Numeral 36 operative finishing motion between the first friction sensor probe surface and the finishing element finishing surface
Reference Numeral 37 applied pressure between the second friction sensor probe surface and the finishing element finishing surface
Reference Numeral 38 operative friction motion between the second friction sensor probe surface and the finishing element finishing surface
Reference Numeral 39 applied pressure between the second friction sensor probe surface and the finishing element finishing surface
Reference Numeral 40 finishing composition feed line
Reference Numeral 41 reservoir of finishing composition
Reference Numeral 42 feed mechanism for finishing composition
Reference Numeral 46 alternate finishing composition feed line
Reference Numeral 47 alternate reservoir of finishing composition
Reference Numeral 48 alternate feed mechanism for finishing composition
Reference Numeral 50 first friction sensor probe
Reference Numeral 51 first friction sensor surface
Reference Numeral 52 first friction probe motor
Reference Numeral 54 operative connection between first friction sensor probe and first friction drive motor
Reference Numeral 56 second friction sensor probe
Reference Numeral 57 second friction sensor surface
Reference Numeral 58 second friction probe motor
Reference Numeral 56 operative connection between second friction sensor probe and second friction drive motor
Reference Numeral 61 unwanted raised surface region on the workpiece
Reference Numeral 62 carrier
Reference Numeral 63 operative contact element
Reference Numeral 64 motor for carrier
Reference Numeral 70 platen
Reference Numeral 72 surface of platen facing finishing element
Reference Numeral 74 surface of platen facing base support structure
Reference Numeral 76 surface of the base support structure facing the platen
Reference Numeral 77 base support structure
Reference Numeral 78 surface of the base support structure facing away from the platen
Reference Numeral 90 body of a friction sensor probe
Reference Numeral 92 insulation in a friction sensor probe
Reference Numeral 94 friction sensor element
Reference Numeral 95 friction sensor surface
Reference Numeral 96 operative friction sensor
Reference Numeral 98 thermal adjustment port for friction sensor probe
Reference Numeral 102 operative sensor connections
Reference Numeral 104 processor
Reference Numeral 106 operative connection(s) between processor and controller
Reference Numeral 108 controller
Reference Numeral 110 operative connection(s) between controller and equipment controlled
Reference Numeral 150 effective organic boundary lubricating layer
Reference Numeral 152 regions where the workpiece surface is effectively free of an organic boundary layer lubrication.
Reference Numeral 154 regions where the workpiece surface is effectively lubricated with an organic boundary lubricating layer
Reference Numeral 800 portion of a semiconductor wafer surface having two unwanted raised regions.

Reference Numeral 802 unwanted raised regions on the semiconductor surface being finished.

Reference Numeral 804 lower local regions on the semiconductor surface being finished proximate to the unwanted raised regions.

Reference Numeral 810 portion of finishing element finishing surface

Reference Numeral 812 finishing element surface local region displaced from but proximate to and lower than the unwanted raised local regions.

Reference Numeral 900 boundary layer lubrication.

Reference Numeral 902 regions of partial or no local boundary layer lubrication Reference Numeral 904 regions of boundary layer lubrication

SUMMARY OF INVENTION

A preferred embodiment of this invention is directed to a method of finishing of a semiconductor wafer surface being finished comprising the step a) of providing a finishing element finishing surface, the step b) of positioning the semiconductor wafer surface being finished proximate to the finishing surface, the step c) of providing at least one finishing sensor probe capable of monitoring the finishing of the semiconductor wafer surface being finished, the step d) of applying an operative finishing motion between the semiconductor wafer surface being finished and the finishing surface forming an operative finishing interface, the step e) of sensing the progress of the finishing of the semiconductor wafers surface with the finishing sensor probe and sending the progress of the finishing to a processor having access to current cost of manufacture parameters, the step f) of evaluating the finishing progress parameters for improved adjustment using both the current cost of manufacture parameters and finishing control parameters improve cost of manufacture, and the step g) of controlling in situ a finishing control parameter to improve the cost of manufacture of the finishing semiconductor wafer surface being finished.

A preferred embodiment of this invention is directed to a method of finishing of a semiconductor wafer surface being finished comprising the step a) of providing a finishing element finishing surface, step b) of positioning the semiconductor wafer surface being finished proximate to the finishing surface, step c) of providing at least one friction sensor probe capable of measuring at least one parameter related to friction during finishing of semiconductor wafer surface, step d) of providing an organic boundary lubricant between the finishing element finishing surface and the semiconductor wafer surface being finished, step e) of providing at least one cost of manufacture parameter, step f) of applying an operative finishing motion between the semiconductor wafer surface being finished and the finishing element, step g) of sensing at least one parameter related to friction during the finishing of the semiconductor wafers surface with the friction sensor probe and sending at least one parameter related to friction to a processor having access to the at least one cost of manufacture parameter, step h) of evaluating the finishing process parameters for improved adjustment using both the cost of manufacture parameters and finishing control parameters improve cost of manufacture, and step i) of controlling in situ a finishing control parameter to improve the cost of manufacture of the finishing semiconductor wafer surface being finished.

Another preferred embodiment of this invention is directed to a method of finishing of a semiconductor wafer surface being finished comprising the step a) of providing a finishing element finishing surface, the step b) of positioning the semiconductor wafer surface being finished proximate to the finishing surface, the step c) of providing at least one friction sensor probe capable of measuring at least one parameter related to friction during finishing of semiconductor wafer surface, the step d) of providing an organic boundary lubricant between the finishing element finishing surface and the semiconductor wafer surface being finished, the step e) of applying an operative finishing motion between the semiconductor wafer surface being finished and the finishing element in a manner that the Effective Coefficient Of Friction in the operative finishing interface is within a value determined by the equation:

$$ECOF=(COF_LF)(LFF)+(1-LFF)(COF_L)$$

wherein from 0.001 to 0.25 surface area fraction of the semiconductor wafer surface being finished is effectively free of the organic boundary layer lubrication, the step f) of sensing at least one parameter related to friction during the finishing of the semiconductor wafer surface with the friction sensor probe and sending at least one parameter related to friction to a processor having access to at least one current cost of manufacture parameter, the step g) of evaluating the finishing process parameters for improved adjustment using both the cost of manufacture parameters and finishing control parameters improve cost of manufacture, and the step h) of controlling in situ a finishing control parameter to improve the cost of manufacture of the finishing semiconductor wafer surface being finished.

Still another preferred embodiment of this invention is directed to a method of finishing of a semiconductor wafer surface being finished comprising the step a) of providing a finishing element finishing surface; a step b) of positioning the semiconductor wafer surface being finished proximate to the finishing surface; a step c) of providing at least one friction sensor capable of measuring at least one parameter related to friction during finishing of semiconductor wafer surface; a step e) of providing an organic boundary lubricant between the finishing element finishing surface and the semiconductor wafer surface being finished; a step f) of applying an operative finishing motion forming a marginal organic boundary lubricating layer between the semiconductor wafer surface being finished and the finishing element in a manner that the Effective Coefficient Of Friction in the operative finishing interface is within a value determined by the equation:

$$ECOF=(COF_LF)(LFF)+(1-LFF)(COF_L)$$

wherein from 0.001 to 0.25 surface area fraction of the semiconductor wafer surface being finished is effectively free of organic boundary layer lubrication for at least a portion of the finishing cycle time;

a step g) of sensing at least one parameter related to friction during the finishing of the semiconductor wafer surface with the friction sensor probe and sending at least one parameter related to friction to a processor; a step h) of evaluating the finishing process parameters for improved adjustment; and a step i) of controlling in situ a finishing control parameter to improve the finishing semiconductor wafer surface being finished.

Other preferred embodiments are discussed herein.

DETAILED DESCRIPTION OF PREFERRED EMBODIMENTS OF THE INVENTION

The book *Chemical Mechanical Planarization of Microelectric Materials* by Steigerwald, J. M. et al published by John Wiley & Sons, ISBN 0471138274, generally describes chemical mechanical finishing and is included herein by reference in its entirety for general background. In chemical mechanical finishing the workpiece is generally separated from the finishing element by a polishing slurry. The workpiece surface being finished is in parallel motion with finishing element finishing surface disposed towards the workpiece surface being finished. The abrasive particles such as found in a polishing slurry interposed between these surfaces finish the workpiece.

Discussion of some of the terms useful to aid in understanding this invention are now presented. Finishing is a term used herein for both planarizing and polishing. Planarizing is the process of making a surface which has raised surface perturbations or cupped lower areas into a planar surface and thus involves reducing or eliminating the raised surface perturbations and cupped lower areas. Planarizing changes the topography of the workpiece from non planar to ideally perfectly planar. Polishing is the process of smoothing or polishing the surface of an object and tends to follow the topography of the workpiece surface being polished. A finishing element is a term used herein to describe a pad or element for both polishing and planarizing. A finishing element finishing surface is a term used herein for a finishing element surface used for both polishing and planarizing. A finishing element planarizing surface is a term used herein for a finishing element surface used for planarizing. A finishing element polishing surface is a term used herein for a finishing element surface used for polishing. Workpiece surface being finished is a term used herein for a workpiece surface undergoing either or both polishing and planarizing. A workpiece surface being planarized is a workpiece surface undergoing planarizing. A workpiece surface being polished is a workpiece surface undergoing polishing. The finishing cycle time is the elapsed time in minutes that the workpiece is being finished. The planarizing cycle time is the elapsed time in minutes that the workpiece is being planarized. The polishing cycle time is the elapsed time in minutes that the workpiece is being polishing.

As used herein, an emulsion is a fluid containing a microscopically heterogeneous mixture of two (2) normally immiscible liquid phases, in which one liquid forms minute droplets suspended in the other liquid. As used herein, a surfactant is a surface active substance, i.e., alters (usually reduces) the surface tension of water. Non limiting examples of surfactants include ionic, nonionic, and cationic. As used herein, a lubricant is an agent that reduces friction between moving surfaces. A hydrocarbon oil is a non limiting example of substance not soluble in water. As used herein, soluble means capable of mixing with a liquid (dissolving) to form a homogeneous mixture (solution).

As used herein, a dispersion is a fluid containing a microscopically heterogeneous mixture of solid phase material dispersed in a liquid and in which the solid phase material is in minute particles suspended in the liquid.

As used herein, a die is one unit on a semiconductor wafer generally separated by scribe lines. After the semiconductor wafer fabrication steps are completed, the die are separated into units, generally by sawing. The separated units are generally referred to as "chips". Each semiconductor wafer generally has many die which are generally rectangular. The terminology semiconductor wafer and die are generally known to those skilled in the arts. As used herein, within die uniformity refers to the uniformity within the die. As used herein, local planarity refers to die planarity unless specifically defined otherwise. Within wafer uniformity refers to the uniformity of finishing of the wafer. As used herein, wafer planarity refers to planarity across a wafer. Multiple die planarity is the planarity across a defined number of die. As used herein, global wafer planarity refers to planarity across the entire semiconductor wafer planarity. Planarity is important for the photolithography step generally common to semiconductor wafer processing, particularly where feature sizes are less than 0.25 microns. As used herein, a device is a discrete circuit such as a transistor, resistor, or capacitor. As used herein, pattern density is ratio of the raised (up) area in square millimeters to the to area in square millimeters of region on a specific region such as a die or semiconductor wafer. As used herein, pattern density is ratio of the raised (up) area in square millimeters to the total area in square millimeters of a region on a specific region such as a die or semiconductor wafer. As used herein, line pattern density is the ratio of the line width to the pitch. As used herein, pitch is line width plus the oxide space. As an illustrative example, pitch is the copper line width plus the oxide spacing. Oxide pattern density, as used herein, is the volume fraction of the oxide within an infinitesimally thin surface of the die.

Figure 1:
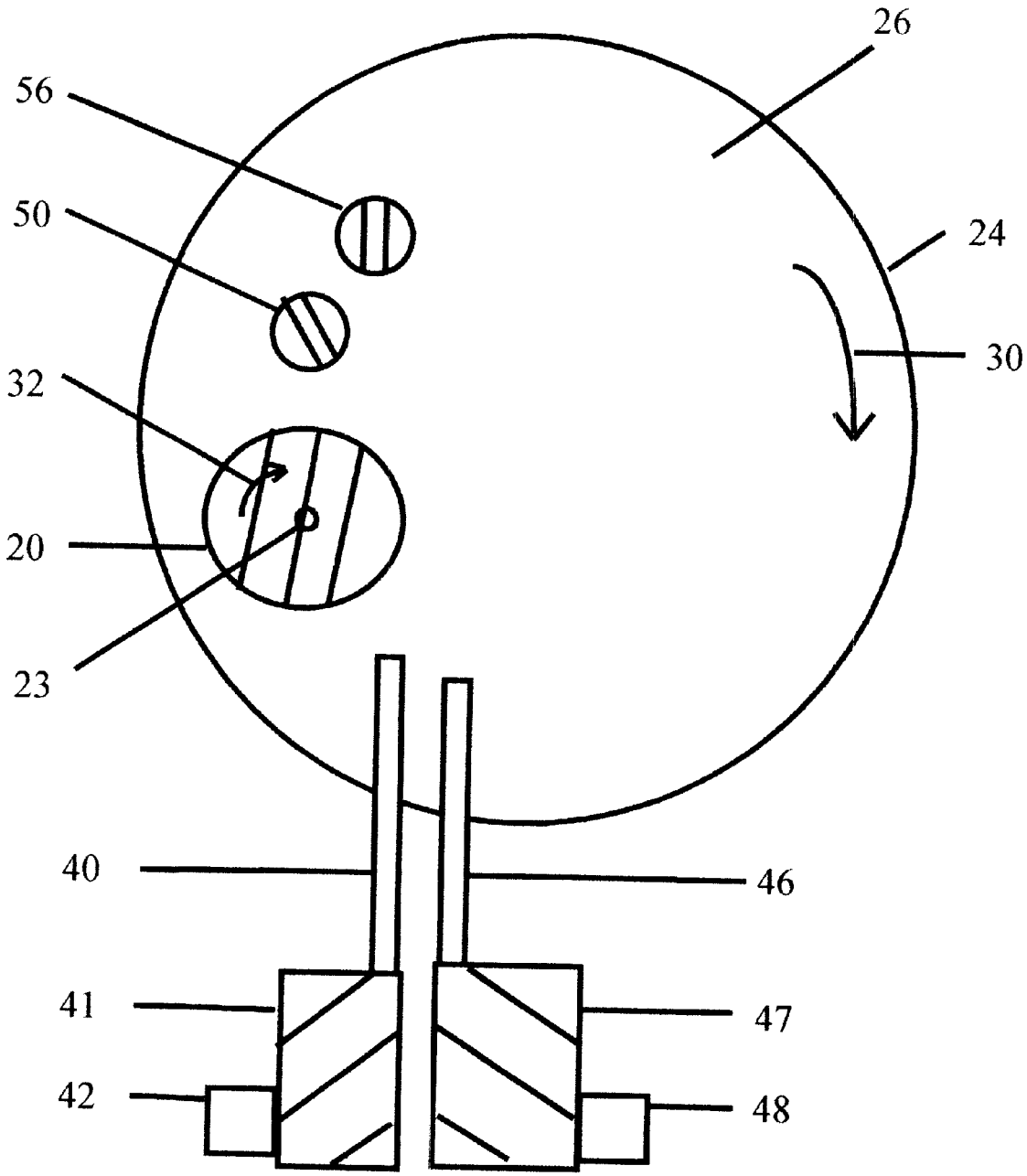
FIG. 1 is an artist's drawing of a preferred embodiment of some equipment from a top down perspective.

FIG. 1 is an artist's drawing of a particularly preferred embodiment of this invention when looking from a top down perspective including the interrelationships of some important objects when finishing according to the method of this invention. Reference Numeral 20 represents the workpiece being finished. Reference Numeral 23 is the center of the rotation of the workpiece. The workpiece surface facing the finishing element finishing surface is the workpiece surface being finished. Reference Numeral 24 represents the finishing element. Reference Numeral 26 represents the finishing element finishing surface. A finishing element finishing surface which is free of abrasive particles connected to the finishing surface is preferred for some applications. For these applications, a finishing element finishing surface which is free of inorganic abrasive particles connected to the finishing surface is more preferred and a finishing element finishing surface which is free of fixed abrasive particles is even more preferred. Abrasive particles which are connected to and/or fixed to the finishing surface increase the possibility of causing unwanted surface damage to the workpiece surface being finished. Confidential evaluations indicate that preferred lubrication of the operative finishing interface can reduce or eliminate some of these harmful effects of finishing elements finishing surfaces having a fixed abrasive. It is preferred to measure and control active lubrication at the operative finishing interface to minimize some of these harmful effects. It is preferred to have a finishing feedback subsystem with can monitor and function well with or without lubricant changes at the operative finishing interface. By having a finishing surface which is free of attached abrasive particles, potential damage from fixed abrasives is avoided. By having the real time friction sensor subsystems and finishing sensor subsystems of a preferred embodiment of this invention, changes in friction due to real time lubrication at the operative finishing interface can be sensed, controlled and adjusted to improve finishing, with a finishing element surface free of fixed abrasives and with a finishing element surface having fixed abrasives. Feeding a finishing composition without abrasives is preferred and feeding a finishing composition without abrasive particles is more preferred. Supplying a finishing composition without abrasives is preferred and supplying a finishing composition without abrasive particles is more preferred. Feeding a water borne finishing composition having a lubricant which is free of abrasive particles is also preferred and feeding a water borne finishing composition having a lubricant which is free of abrasive particles is particularly preferred. A lubricant separate from and unconnected to the abrasive particles is preferred. Reference Numeral 30 represents the direction of rotation of the finishing element finishing surface. Reference Numeral 32 represents the direction of rotation of the workpiece being finished. Reference Numeral 40 represents a finishing composition feed line for adding chemicals to the surface of the workpiece such as acids, bases, buffers, other chemical reagents, abrasive particles and the like. The finishing composition feed line can have a plurality of exit orifices. A preferred finishing composition is finishing slurry. Reference Numeral 41 represents a reservoir of a finishing composition to be fed to a finishing element finishing surface. Reference Numeral 42 represents a feed mechanism for the finishing composition such as a variable air or gas pressure or a pump mechanism. Reference Numeral 46 represents an alternate finishing composition feed line for adding a finishing chemical composition to the finishing element finishing surface to improve the quality of finishing. Reference Numeral 47 represents an alternate finishing composition reservoir of chemicals to be, optionally, fed to the finishing element finishing surface. The alternate finishing composition can also contain abrasive particles and thus can be a finishing slurry. Reference Numeral 48 represents a feed mechanism for the alternate finishing composition such as a variable pressure or a pump mechanism. A preferred embodiment of this invention is to feed liquids free of abrasives from the finishing composition feed line and the alternate finishing composition feed line in which at least one feed has a liquid having abrasive particles in a slurry. Another preferred embodiment, not shown, is to have a wiping element, preferably an elastomeric wiping element, to uniformly distribute the finishing composition(s) across the finishing element finishing surface. Multiple nozzles to feed the finishing composition and alternate finishing composition can be preferred to better distribute them across the finishing element finishing surface. Nonlimiting examples of some preferred dispensing systems and wiping elements is found in U.S. Pat. No. 5,709,593 to Guthrie et. al., U.S. Pat. No. 5,246,525 to Junichi, and U.S. Pat. No. 5,478,435 to Murphy et. al. and are included herein by reference in their entirety for general guidance and appropriate modifications by those generally skilled in the art for supplying lubricants. Alternately supplying the finishing composition through pores or holes in the finishing element finishing surface to effect a uniform distribution of the lubricant is also effective. Reference Numeral 50 represents a first friction sensor probe. Reference Numeral 56 represents an optional second friction sensor probe. A thermal sensor probe is a preferred friction sensor probe. An infrared sensor probe is a preferred thermal sensor probe. A thermocouple probe is a preferred thermal sensor probe. A thermistor probe is a preferred thermal sensor probe.

Figure 2:
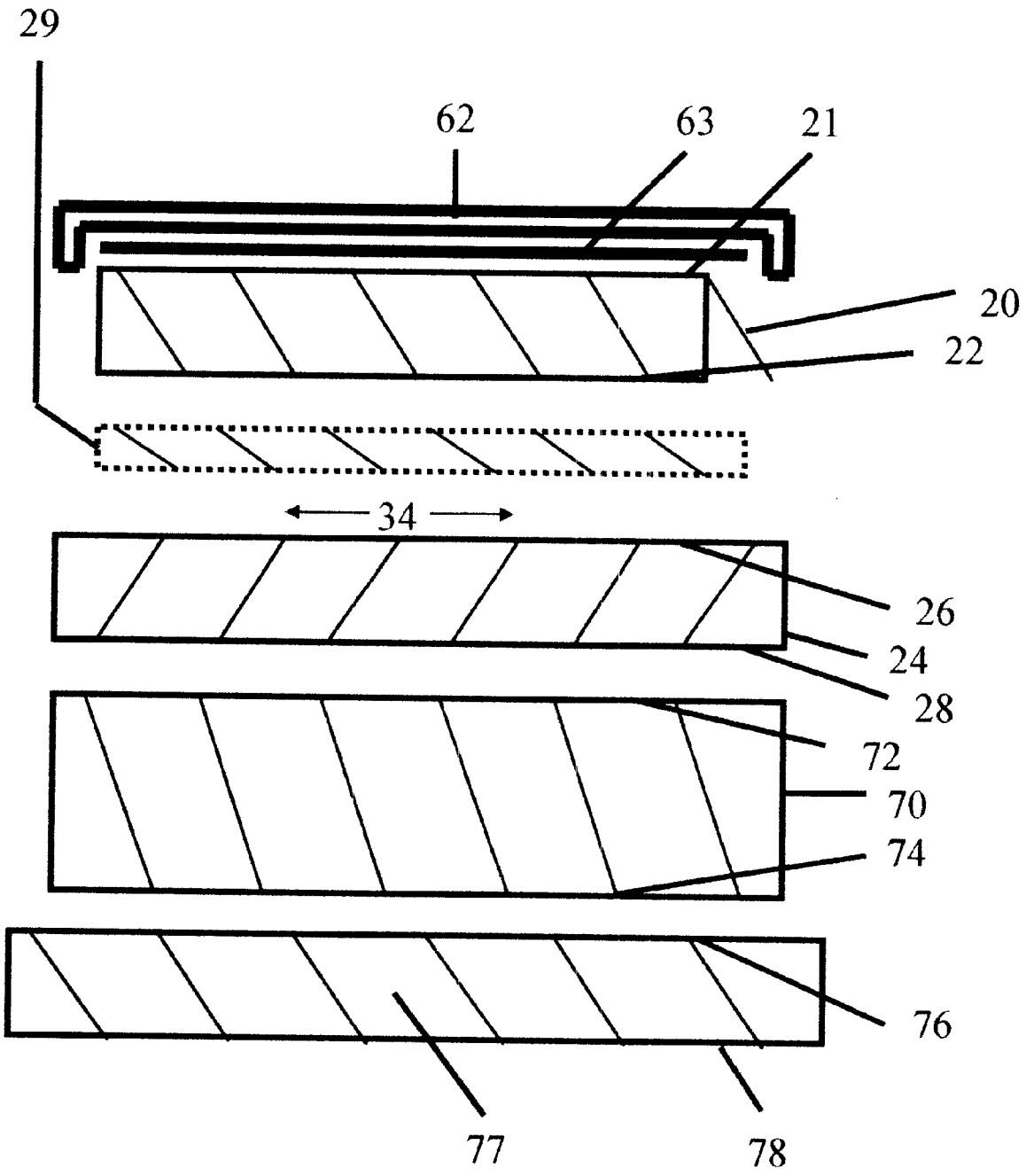
FIG. 2 is an artist's close up drawing of a particular preferred embodiment of some equipment including the interrelationships of the different objects when finishing according to this invention.

FIG. 2 is an artist's closeup drawing of a preferred embodiment of this invention showing some further interrelationships of the different objects when finishing according to the method of this invention. Reference Numeral 62 represents a carrier for the workpiece and in this particular embodiment, the carrier is a rotating carrier. The rotating carrier is operable to rotate the workpiece against the finishing element which rests against the platen and optionally has a motor. Optionally, the rotating carrier can also be designed to move the workpiece laterally, in an arch, figure eight, or orbitally to enhance uniformity of polishing. Optionally the carrier can be can have other motions. Optionally and preferably the carrier can have the ability to apply pressure locally in selective amounts as disclosed in U.S. Pat. No. 5,486,129 to Sandhu et al, and U.S. Pat. No. 5,762,536 to Pant et al. which are included by reference in their entirety for guidance and modification by those skilled in the arts. The workpiece is in operative contact with the rotating carrier and optionally, has an operative contact element (Reference Numeral 63) to hold the workpiece to the carrier during finishing. An illustrative example of an operative contact element (Reference Numeral 63) is a workpiece held in place to the rotating carrier with a bonding agent. A hot wax is an illustrative example of a preferred bonding agent. Alternately, a porometric film can be placed in the rotating carrier having a recess for holding the workpiece. A wetted porometric film (an alternate Reference Numeral 63) will hold the workpiece in place by surface tension. An adherent thin film is another preferred example of placing the workpiece in operative contact with the rotating carrier. Reference Numeral 20 represents the workpiece. Reference Numeral 21 represents the workpiece surface facing away from the workpiece surface being finished. Reference Numeral 22 represents the surface of the workpiece being finished. Reference Numeral 24 represents the finishing element. Reference Numeral 26 represents the finishing element surface facing the workpiece surface being finished and is often referred to herein as the finishing element finishing surface. Reference Numeral 28 represents the surface of the finishing element facing away from the workpiece surface being finished. Reference Numeral 29 represents the finishing composition and optionally, the alternate finishing composition supplied between the workpiece surface being finished and surface of the finishing element facing the workpiece. Reference Numeral 34 represents a preferred direction of the operative finishing motion between the surface of the workpiece being finished and the finishing element finishing surface. Reference Numeral 70 represents the platen or support for the finishing element. The platen can also have an operative finishing motion relative to the workpiece surface being finished. Reference Numeral 72 represents the surface of the platen facing the finishing element. The surface of the platen facing the finishing element is in support contact with the finishing element surface facing away from the workpiece surface being finished. The finishing element surface facing the platen can, optionally, be connected to the platen by adhesion. Frictional forces between the finishing element and the platen can also retain the finishing element against the platen. Reference Numeral 74 is the surface of the platen facing away from the finishing element. Reference Numeral 76 represents the surface of the base support structure facing the platen. Reference Numeral 77 represents the base support structure. Reference Numeral 78 represents the surface of the base support structure facing away from the platen. The rotatable carrier (Reference Number 70) can be operatively connected to the base structure to permit improved control of the pressure application at the workpiece surface being finished Reference Numeral 22).

Figure 3:
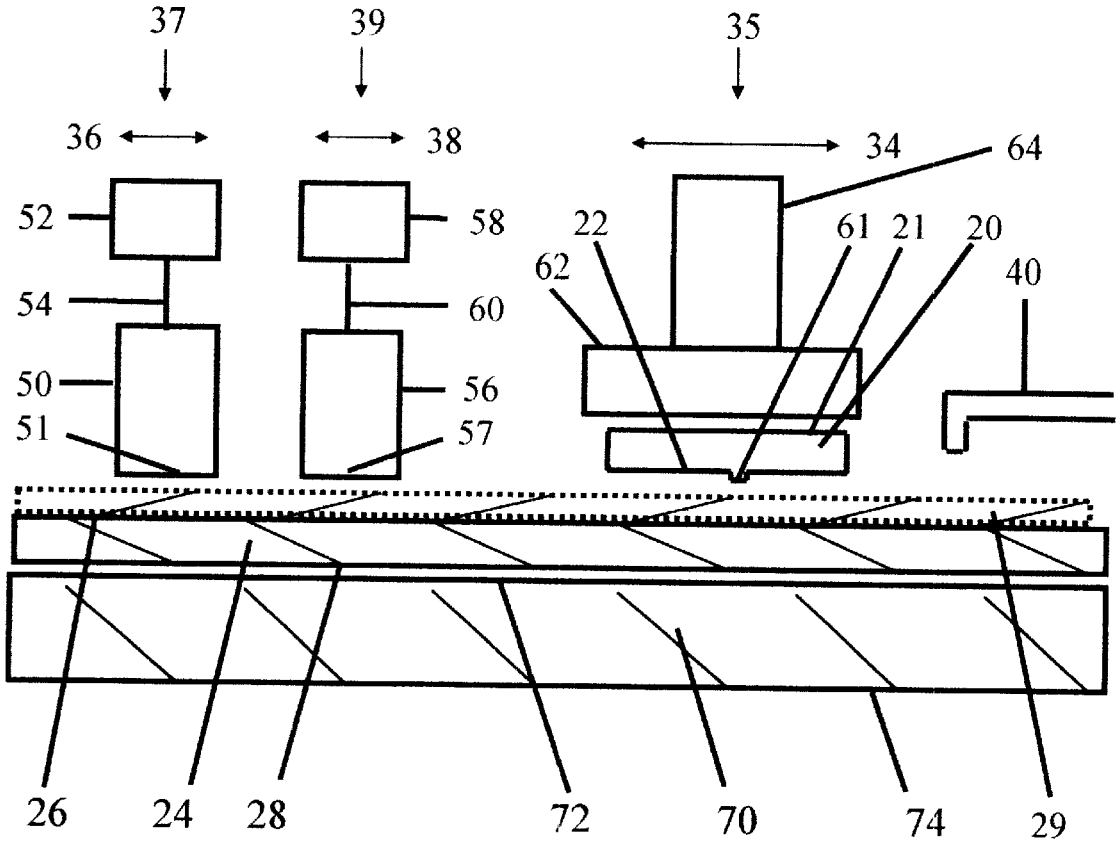
FIG. 3 is an drawing of a preferred embodiment of this invention

FIG. 3 is an artist's drawing of a preferred embodiment of this invention showing some further interrelationships of some of the objects when finishing according to the method of this invention. Reference Numeral 20 represents the workpiece being finished Reference Numeral 21 represents the workpiece surface facing away from the finishing element finishing surface. Reference Numeral 22 represents the workpiece surface being finished. Reference Numeral 61 represents an unwanted raised region on the workpiece surface being finished. Reference Numeral 62 represents a simplified view of the carrier for the workpiece. The carrier for the workpiece can have a number of preferred options, depending on the finishing required, such as a retainer ring, a fluid filled chuck, and/or a chuck capable of applying localized differential pressures across the wafer to better control wafer finishing. Reference Numeral 64 represents the optionally preferred motor for applying a finishing motion to the workpiece being finished. Reference Numeral 34 represents a preferred operative finishing motion. Reference Numeral 35 represents a preferred operative pressure applied to the workpiece surface by urging it against or towards the finishing element finishing surface. Reference Numeral 40 represents the finishing composition feed line. The alternate finishing feed line, Reference Numeral 46, is behind the Reference Numeral 40 and thus is not shown in this particular artist's drawing. Reference Numeral 24 represents the finishing element. Reference Numeral 26 represents the finishing element finishing surface. Reference Numeral 28 represents the finishing element surface facing away from the workpiece surface being finished. Reference Numeral 29 represents the finishing composition and optionally, the alternate finishing composition supplied between the workpiece surface being finished and the surface of the finishing element facing the workpiece. Reference Numeral 50 represent a first friction sensor probe. Reference Numeral 51 represents the surface of the first friction probe in friction contact with the finishing element finishing surface and is often referred to herein as the first friction sensor surface. Reference Numeral 52 represents an optionally preferred motor to rotate the first friction sensor probe. Reference Numeral 54 represents an optional operative connection between the first friction sensor probe and motor. Reference Numeral 36 represents a preferred friction motion between the first friction sensor probe friction sensor surface and the finishing element finishing surface. Reference numeral 37 represents an operative pressure applied to the first friction probe friction sensor surface by urging it against or towards the finishing element finishing surface. Reference Numeral 56 represents a preferred optional second friction sensor probe. Reference Numeral 57 represents the surface of the second friction probe in friction contact with the finishing element finishing surface and is often referred to herein as the second friction sensor surface. Reference Numeral 58 represents an optionally preferred second motor to rotate the second friction sensor probe. Reference Numeral 60 represents an optional second operative connection between the second friction sensor probe and an optional motor. Reference Numeral 38 represents a preferred friction motion between the second friction sensor probe friction sensor surface and the finishing element finishing surface. Reference numeral 39 represents an operative pressure applied to a second friction probe friction sensor surface by urging it against or towards the finishing element finishing surface. The operative finishing motion, the operative first friction motion, and the operative second friction motion can differ from each other and are preferably controlled independently of each others motions and/or pressures.

Figure 4:
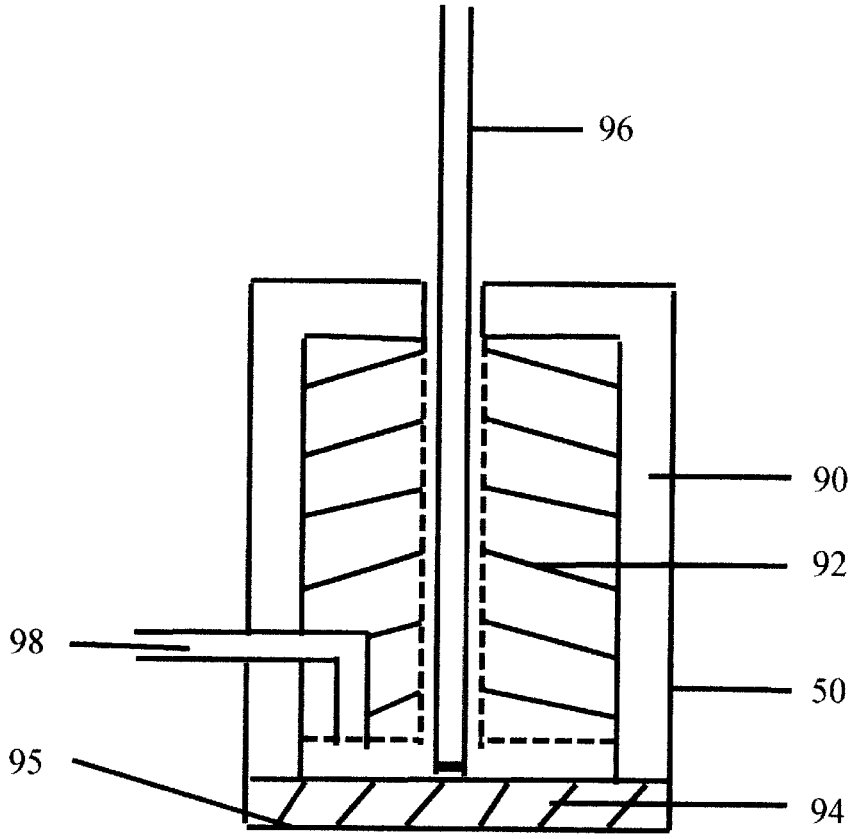
FIG. 4 is cross-sectional view of a preferred thermal sensor probe

FIG. 4 is an artist's drawing of a preferred embodiment of one type of preferred friction sensor probe useful for this invention showing some further interrelationships of the sections in the friction sensor probe. Reference Numeral 50 represents the friction sensor probe. Reference Numeral 90 represents the body of the friction sensor probe. The body of the friction sensor probe can be comprised of many different materials. A friction sensor probe body comprising metal or plastic is preferred. Reference Numeral 92 represents optional, but preferred, insulation in the friction sensor probe. Reference Numeral 94 represents a friction sensor element for the friction sensor probe. During operation, the friction sensor surface (Reference Numeral 95) is in operative friction motion with the finishing element finishing surface and the results of this friction are measured by a friction sensor probe. Shown in this embodiment is an operative friction sensor such as a thermal couple (Reference Numeral 96) which measures friction during operative friction motion by measuring changes in temperature due to increased or decreased friction. A friction sensor surface which responds to operative friction motion is preferred. A friction sensor surface which responds to operative friction motion related to the workpiece surface being finished (or material contained therein) in a manner expressible by a mathematical equation is preferred. Reference Numeral 94 represents an insulating material contained in the friction sensor probe body to improve accuracy of measurement of temperature increases and to reduce heat losses. Reference Numeral 96 represents a friction sensor which in this particular embodiment is a thermocouple. A thermocouple is a preferred example of a non-optical friction sensor. Reference Numeral 98 represents a thermal adjustment port that can be used to adjust the temperature upwards or downwards. A thermal adjustment port for feeding fluid cooling medium is preferred and feeding a gas cooling medium is especially preferred. The optional cooling port is useful to change and more particularly to decrease the temperature rapidly and economically between workpieces being finished.

Some preferred embodiments for the friction sensor element and its friction sensor surface will now be discussed further. A friction sensor element for the friction sensor probe can be an integral member of the friction sensor probe body. This is an example of a preferred permanent friction sensor element attachment to the friction sensor surface. A replaceable friction sensor element is preferred for a number of applications because it can lower the cost of finishing the workpieces. The replaceable friction sensor element is preferably attached to the friction sensor probe body. A preferred example of a replaceable friction sensor element is a temporary friction sensor element. A temporary attachment mechanism attaching the replaceable friction sensor element to the friction sensor probe body is one preferred attachment mechanism. A preferred replaceable friction sensor element can be attached to the friction sensor body with a temporary adhesive mechanism or a temporary mechanical attachment mechanism. A preferred temporary mechanical attachment mechanism is a mechanism selected from the group consisting of a friction fit mechanism, a snap fit mechanism, and a cam lock mechanism. The friction sensor element can be adhered to the friction sensor probe body, snap fit in the friction body, and/or friction fit in the friction sensor probe body. A preferred temporary adhesive mechanism includes a temporary adhesive coating, temporary adhesive surface, and a temporary adhesive tape. A permanently attached friction sensor element can also be preferred for some applications. These friction sensor probes can easily be replaced as a unit and thus reduce operator time for changes. A permanently attached friction sensor can be permanently adhered to the friction sensor body, molded into the friction sensor body, or permanently mechanically attached to the friction sensor body. An abrasion resistant friction sensor surface is often preferred because they last longer in service.

Different friction sensor surfaces are preferred for different finishing applications. A friction sensor surface that responds in a similar manner to friction as the workpiece surface or a region of the workpiece surface is often preferred. A preferred workpiece is a heterogeneous semiconductor wafer surface having conductive regions and non-conductive regions. Semiconductor wafer surfaces having a heterogeneous semiconductor wafer surface needing finishing, particularly planarized, are generally well known to those skilled in the semiconductor arts. A quartz friction sensor surface is preferred because it is low cost and is substantially abrasion resistant. A quartz friction sensor surface is often a low cost material that approximates a non conductive region proximate to the surface of the heterogeneous semiconductor wafer during finishing. A friction sensor surface comprising a silicon dioxide composition is a preferred friction sensor surface. A non conductive friction sensor surface can be preferred for some finishing applications, particularly where the workpiece has a non conductive region being finished. A friction sensor surface comprised of a metal is often preferred. A friction sensor surface comprising an aluminum composition is a preferred friction sensor surface. A friction sensor surface comprising a tungsten composition is a preferred friction sensor surface. A friction sensor surface comprising a copper composition is a preferred friction sensor surface. A friction sensor surface comprising a conductive composition is a preferred friction sensor surface, particularly where the workpiece has conductive regions being finished. A friction sensor surface comprising a synthetic polymeric composition is a preferred friction sensor surface. A friction sensor surface comprising a material having a fibrous filler is a preferred friction sensor surface. A friction sensor surface comprising a synthetic polymeric composition having a fibrous filler is a preferred friction sensor surface. A friction sensor surface comprising a surface having microasperities is a preferred friction sensor surface. A friction sensor surface comprising a surface having attached particles is a preferred friction sensor surface and a friction sensor surface comprising a surface having attached abrasion resistant particles is a more preferred friction sensor surface. Particles having a hardness of greater than the finishing element finishing surface can be preferred for some applications, particularly those applications having an abrasive free finishing composition. Silica particles are an example of preferred abrasion resistant particles and colloidal silica is a more preferred example of abrasion resistant particles. A friction sensor surface having particles having a hardness of greater than any abrasive particles in the finishing composition is particularly preferred for finishing wherein a finishing or alternate finishing composition contains finishing composition abrasive particles. A friction sensor surface having a hardness of greater than the finishing element finishing surface can be preferred for some applications, particularly those applications having an abrasive free finishing composition. Particles are preferably quite small. A friction sensor surface comprising a surface having microasperities to simulate a workpiece surface before finishing is a preferred friction sensor surface. A friction sensor surface comprising a surface having microasperities which sense changes to the finishing element finishing surface is a preferred friction sensor surface. A friction sensor surface comprising a surface having microasperities, preferably nonabrading microasperities (meaning they do not abrade the finishing element finishing surface), which sense changes to finishing element finishing surface wear can be use as a friction sensor surface. A friction sensor surface having similar characteristics such as friction or roughness to materials proximate to the surface of the workpiece is preferred. Each of these preferred friction sensor surfaces detect friction which is related to finishing of a workpiece and provides useful information for controlling the finishing of a workpiece.

A single friction sensor probe having at least one friction sensor is preferred and a single friction sensor probe having at least two friction sensors is more preferred for some applications. A single friction sensor probe having at least one friction sensor surface is preferred and a single friction sensor probe having at least two friction sensor surfaces is more preferred for some applications. A single friction sensor surface having at least one proximate friction sensor is preferred and a single friction sensor surface having at least two proximate friction sensors is more preferred for some applications. Multiple friction sensors can improve precision of the measurements (for instance in different temperature regions) and multiple friction surfaces per friction sensor probe body can sometimes reduce costs by eliminating multiple friction sensor probe bodies where only one is needed for the specific application. As an example one friction sensor surface can best measure the friction of the finishing element finishing surface while the other might best measure the friction of a region in the operative finishing interface.

FIG. 5 is an artist's drawing of the some of the objects and their interconnections in a preferred embodiment of the invention. Reference Numeral 20 represents the workpiece being finished. Reference Numeral 24 represents the finishing element. Reference Numeral 29 represents the finishing composition and, optionally, the alternate finishing composition. Reference Numeral 40 represents the feed line for the finishing composition. Reference Numeral 46 represents the feed line for the alternate finishing composition. Reference Numeral 50 represents the first friction sensor probe. Reference numeral 52 represents an optional drive mechanism such as a motor or vibrating transducer for the first friction sensor probe. Reference Numeral 54 represents the operative connection between the first friction sensor probe and the drive mechanism. Reference Numeral 56 represents the second friction sensor probe. Reference numeral 58 represents an optional drive mechanism such as a motor or vibrating transducer for the second friction sensor probe. Reference Numeral 60 represents the operative connection between the second friction sensor probe and the drive mechanism. Reference Numeral 62 represents the carrier for the workpiece. Reference Numeral 64 represents the drive motor carrier for the carrier. Reference Numeral 70 represents the platen. Reference Numeral 102 represents preferred operative sensor connections from the first friction sensor probe, second friction sensor probe, and workpiece finishing assembly to the processor (Reference Numeral 104). Preferably the sensor connections are electrical connections. A data processor is a preferred processor and an electronic data processor is a more preferred data processor and a computer is an even more preferred processor. The processor (Reference Numeral 104) is preferably connected to a controller (Reference Numeral 108) with an operative processor to controller connection(s) represented by Reference Numeral 106. The controller is preferably in operative controlling connection (Reference Numeral 110) with the first friction sensor probe, the second friction sensor probe, and the workpiece finishing sensor subsystem and can adjust finishing control parameters during finishing the workpiece. An operative electrical connection is a preferred operative connection. An operative electromagnetic wave system such as operative infrared communication connections is another preferred operative connection. The controller can also adjust the operating friction probe control parameters such as, but not limited to, pressure exerted against the finishing element finishing surface and the friction probe friction sensor surface and related relative friction motion between the finishing element finishing surface and the friction probe friction sensor surface such as relative parallel motion. Preferred finishing control parameters are discussed elsewhere herein.

The semiconductor industry is in a relentless journey to increase computing power and decrease costs. Finishing of a semiconductor wafer using in situ calculations of cost of manufacture parameters to improve control finishing parameters can help simultaneously to decrease cost and reduce unwanted defects. In situ control of the operative finishing interface is particularly useful to help reduce cost of manufacture. Supplying a controlled organic boundary lubricant to the interface to control and/or adjust the coefficient of friction at the operative finishing interface can facilitate reducing surface defects and reducing the cost of manufacture. Using current cost of manufacture parameters along with a friction sensing method to evaluate and adjust the boundary layer lubrication in a manner that adjustably controls the coefficient of friction in the operative finishing interface can be particularly effective at reducing unwanted surface defects such as microscratches and microchatter. This system is particularly preferred for finishing with fixed abrasive finishing elements. In addition generally helping to improve such parameters as equipment yield, parametric yield, and defect density, the "cuttability" or cut rate of the fixed abrasive finishing element can generally be extended which improves uptime or equipment utilization. The coefficient of friction in the operative finishing interface can change any number of times during a relatively short finishing cycle time making manual calculations ineffective. Further, the semiconductor wafer cost of manufacture parameters are relatively complex to calculate and the finishing process is relatively short thus manual calculations for equipment adjustment and control are even more difficult and ineffective. Rapid, multiple adjustments of process control parameters using process sensors operatively connected to a processor with access to cost of manufacture parameters are particularly preferred for the rapid in situ process control of this invention which helps to increase computing power in the finished semiconductor wafer and decrease manufacturing costs.

A finishing element finishing surface tends to have a higher friction than necessary with the workpiece being finished. The higher friction can lead to higher than necessary energy for finishing. The higher friction can lead to destructive surface forces on the workpiece surface being finished and on the finishing element finishing surface which can cause deleterious surface damage to the workpiece. The higher friction can lead to premature wear on the finishing element and even to the abrasive slurry particle wear. This premature wear on the finishing element and abrasive slurry particles can unnecessarily increase the cost of finishing a workpiece. Further, this higher than necessary friction can lead to higher than necessary changes in performance of the finishing element finishing surface during the finishing of a plurality of workpieces which makes process control more difficult and/or complex. Applicant currently believes that the higher than desirable number of defects in the workpiece surface being finished can at least partially be due to the fact that the abrasive particles in slurries although generally free to move about can become trapped in an elastomeric finishing element surface thus preventing rolling action and leading to a more fixed scratching type action. Further fixed abrasive finishing element surfaces can also scratch or damage of sensitive workpiece surface. Further, abrasive slurry particles which are not lubricated can tend to become dull or less effective at finishing the workpiece surface being finished which can reduce their effectiveness during finishing. Current CMP slurries are generally complex chemical slurries and applicant has found confidentially that the addition of some new chemicals, such as finishing aids, can cause instability over time, precipitation of the abrasive particulates and/or agglomeration of the abrasive particulates to form large particles which can cause unwanted scratching to the workpiece surface being finished. Further, precipitation and/or agglomeration of the abrasive slurry particulates can have an adverse impact on the economical recycling of slurry for finishing workpiece surfaces by forming the larger particulates which either are not recycled or must be reprocessed at an increased expense to decrease their size to be within specification. Each of the above situations can lead to less than desirable surface quality on the workpiece surface being finished, higher than desirable manufacturing costs, and earlier than necessary wear on the expensive finishing element finishing surface. An operative finishing interface having an organic boundary lubricant can help to reduce these forces on large workpieces. Applicant currently believes that proper choice of a finishing aid, more preferably a lubricating aid, at or proximate to the surface of the finishing element finishing surface supplied to the interface between the finishing surface and the workpiece surface being finished can help reduce or eliminate damage to the workpiece surface being finished and also generally help to reduce workpiece finishing manufacturing costs. Applicant currently believes that proper choice and supply of a finishing aid, more preferably a lubricating aid, from the finishing element to the interface of the workpiece surface being finished and the finishing element finishing surface can reduce or eliminate the negative effects of high friction such as chatter. Applicant currently believes that proper choice and supply of a finishing aid to the interface of the workpiece surface being finished and the finishing element finishing surface can extend the useful life of the finishing element finishing surface by reducing erosive and other wear forces. The lubricating aid can help to maintain the desirable "cutting ability" of the abrasive slurry particles. The lubricating aid when transferred from the finishing element finishing surface to the interface between the workpiece being finished and the finishing element finishing surface can help reduce the instability of the abrasive slurry particulates to finishing aids. Transferring the lubricating aid at the point of use from the finishing element finishing surface reduces or prevents negative interactions between the finishing composition or lubricating aid (and optional abrasive slurry particles therein). Supplying the lubricating aid from the finishing element finishing surface further reduces risks of chatter, micro localized distortions in the finishing element finishing surface, and also increases the uniformity of finishing across the surface of the workpiece surface being finished. Preferably the lubricating aid is dispersed proximate to the finishing element finishing surface and more preferably, the lubricating aid is dispersed substantially uniformly proximate to the finishing element finishing surface. Lubrication reduces the friction which reduces adverse forces particularly on a high speed belt finishing element which under high friction can cause belt chatter, localized belt stretching, and/or belt distortions, and high tendency to scratch and/or damage the workpiece surface being finished. Localized and or micro localized distortions to the surface of a finishing element and chatter can also occur with other finishing motions and/or elements and can help to reduce or eliminate these.

Supplying a finishing aid, particularly a lubricating aid, from the finishing element finishing surface to the interface of the workpiece surface being finished and the finishing element finishing surface reduces the effectiveness of current in situ friction measurement feedback systems known in CMP. Particularly troublesome is change in friction during finishing due to changes in type or amount of lubricating aid. Current known systems, quite simply, have no effective feedback loop to deal with these changes. By having at least one friction sensor probe to measure the change in friction due to changes in lubricating and/or finishing conditions while also having a friction sensor probe to monitor the progress of finishing on the finishing element finishing surface, effective feedback system for finishing of workpieces one can accomplish improved in situ control of finishing. By having at least two friction sensor probes to measure the changes in friction due to changes in lubricating and/or finishing conditions while also having a feedback subsystem to monitor the progress of finishing on the workpieces one can more effectively accomplish in situ control of finishing. The progress of finishing can be obtained by workpiece finishing sensors and/or friction sensor probes discussed herein elsewhere. Look-up tables, mathematical equations, extrapolations, and interpolations can be used to along with the workpiece finishing sensors and/or friction sensors facilitate improved progress of finishing information. For instance, cut rate control can be improved generally by accessing the operative finishing interface pressure and relative velocity and, more preferably, also effective coefficient of friction. Further, progress of finishing can be accessed with some workpiece finishing sensors by sensing changes in composition and/or changes to the thickness of the workpiece layer being finished. Thus one can more effectively control, preferably in situ, finishing during changes in lubricating aid changes (like composition, concentration, or operating condition changes) and as applied pressure or operative finishing motion changes by using the systems taught herein. Control of the coefficient of friction in the operative finishing interface is particularly useful and effective to help reduce unwanted surface defects.

The new problem recognition of this invention and unique solution including, but not limited to, the unique methods of using cost of manufacture parameters, in situ processor methods for optimization, friction sensing methods, organic boundary layer lubrication, adjustable control of the coefficient of friction at the operative finishing interface, friction sensor subsystems, and finishing sensor subsystems unknown in the industry and the new finishing method of the operation disclosed herein are considered part of this current invention.

Finishing Element

A finishing element having a synthetic polymeric body is preferred. A synthetic polymeric body comprising at least one material selected from the group consisting of an organic synthetic polymer, an inorganic polymer, and combinations thereof is preferred. A preferred example of an organic synthetic polymer is a thermoplastic polymer. Another preferred example of an organic synthetic polymer is a thermoset polymer. An organic synthetic polymeric body comprising organic synthetic polymers including materials selected from the group consisting of polyurethanes, polyolefins, polyesters, polyamides, polystyrenes, polycarbonates, polyvinyl chlorides, polyimides, epoxies, chloroprene rubbers, ethylene propylene elastomers, butyl polymers, polybutadienes, polyisoprenes, EPDM elastomers, and styrene butadiene elastomers is preferred. Polyolefin polymers are particularly preferred for their generally low cost. A preferred polyolefin polymer is polyethylene. Another preferred polyolefin polymer is a propylene polymer. Another preferred polyolefin polymer is a ethylene propylene copolymer. Copolymer organic synthetic polymers are also preferred. Polyurethanes are preferred for their inherent flexibility in formulations. A finishing element comprising a foamed organic synthetic polymer is particularly preferred because of its flexibility and ability to transport the finishing composition. A finishing element comprising a foamed polyurethane polymer is particularly preferred. Foaming agents and processes to foam organic synthetic polymers are generally known in the art. A finishing element comprising a compressible porous material is preferred and comprising an organic synthetic polymer of a compressible porous material is more preferred.

A finishing element having a body element comprising a mixture of a plurality of organic synthetic polymers can be particularly tough, wear resistant, and useful. An organic synthetic polymeric body comprising a plurality of the organic synthetic polymers and wherein the major component is selected from materials selected from the group consisting of polyurethanes, polyolefins, polyesters, polyamides, polystyrenes, polycarbonates, polyvinyl chlorides, polyimides, epoxies, chloroprene rubbers, ethylene propylene elastomers, butyl polymers, polybutadienes, polyisoprenes, EPDM elastomers, and styrene butadiene elastomers is preferred. The minor component is preferably also an organic synthetic polymer and is preferably a modifying and/or toughening agent. A preferred example of an organic synthetic polymer modifier is a material which reduces the hardness or flex modulus of the finishing element body such as a polymeric elastomer. A compatibilizing agent can also be used to improve the physical properties of the polymeric mixture. Compatibilizing agents are often also synthetic polymers and have polar and/or reactive functional groups such as carboxylic acid, maleic anhydride, and epoxy groups. Organic synthetic polymers of the above descriptions are generally available commercially. Illustrative nonlimiting examples of commercial suppliers of organic synthetic polymers include Exxon Co., Dow Chemical, Sumitomo Chemical, and BASF.

A finishing element comprising a synthetic polymer composition having a plurality of layers is also preferred. A finishing element comprising at least one layer of a soft synthetic polymer is preferred. A finishing element comprising at least one layer of a elastomeric synthetic polymer is preferred. A finishing element comprising at least one layer of a thermoset elastomeric synthetic polymer is preferred.

Further illustrative nonlimiting examples of preferred finishing elements for use in the invention are also discussed. A finishing element having at least a layer of an elastomeric material having a Shore A hardness of at least 30 A is preferred. ASTM D 676 is used to measure hardness. A porous finishing element is preferred to more effectively transfer the polishing slurry to the surface of the workpiece being finished. A finishing element comprising a synthetic resin material is preferred. A finishing element comprising a thermoset resin material is more preferred. A finishing element having layers of different compositions is preferred to improve the operative finishing motion on the workpiece surface being finished. As an example, a finishing element having two layers, one a hard layer and one a soft layer, can better transfer the energy of the operative finishing motion to the workpiece surface being finished than a similar thickness finishing element of only a very soft layer. A thermoset synthetic resin is less prone to elastic flow and thus is more stable in this application. A finishing element which is thin is preferred because it generally transfers the operative finishing motion to the workpiece surface being finished more efficiently. A finishing element having a thickness from 0.5 to 0.002 cm is preferred and a thickness from 0.3 to 0.005 cm is more preferred and a finishing element having a thickness from 0.2 to 0.01 cm is even more preferred. Current synthetic resin materials can be made quite thin now. The minimum thickness will be determined by the finishing element's integrity and longevity during polishing which will depend on such parameters as tensile and tear strength. A finishing element having sufficient strength and tear strength for chemical mechanical finishing is preferred.

An finishing element having flex modulus in particular ranges is also preferred. An finishing element having a high flex modulus is generally more efficient for planarizing. An finishing element having a low flex modulus is generally more efficient for polishing. Further a continuous belt finishing element can have a different optimum flex modulus than a finishing element disk. One also needs to consider the workpiece surface to be finished in selecting the flex modulus. A finishing element comprising a synthetic resin having flexural modulus of at most 1,000,000 psi is preferred and having flexural modulus of at most 800,000 psi is more preferred and having a flexural modulus of at most 500,000 psi is more preferred. Pounds per square is psi. Flexural modulus is preferably measured with ASTM 790 B at 73 degrees Fahrenheit. Finishing elements comprising a synthetic resin having a very low flex modulus such as elastomeric polyurethanes which can also be used are generally known to those skilled in the art. A finishing element having a flexural modulus of greater than 1,000,000 psi can be preferred for some particular planarizing applications. When finishing lubricated interfaces between the finishing element finishing surface and the workpiece being finished, generally a material with a higher flexural modulus and/or harder finishing element can be used because abrasive scratching is often reduced.

For some embodiments, polishing pad designs and equipment such as in U.S. Pat. No. 5,702,290 to Leach, a polishing pad having a high flexural modulus can be effective and preferred. A finishing element having a continuous phase of material imparting resistance to local flexing is preferred. A preferred continuous phase of material is a synthetic polymer, more preferably an organic synthetic polymer. An organic synthetic polymer having a flexural modulus of at least 20,000 psi is preferred and one having a flexural modulus of at least 50,000 psi is more preferred and one having a flexural modulus of at least 100,000 psi is even more preferred and one having a flexural modulus of at least 200,000 psi is even more particularly preferred for the continuous phase of synthetic polymer in the finishing element. An organic synthetic polymer having a flexural modulus of at most 5,000,000 psi is preferred and one having a flexural modulus of at most 3,000,000 psi is more preferred and one having a flexural modulus of at most 2,000,000 psi is even more preferred for the continuous phase of synthetic polymer in the finishing element. An organic synthetic polymer having a flexural modulus of from 5,000,000 to 50,000 psi is preferred and having a flexural modulus of from 3,000,000 to 100,000 psi is more preferred and having a flexural modulus of at from 2,000,000 to 200,000 psi is even more preferred for the continuous phase of synthetic polymer in the finishing element. For some less demanding applications (such as die with a lower pattern density), a flexural modulus of at least 20,000 psi is preferred. These ranges of flexural modulus for the synthetic polymers provide useful performance for finishing a semiconductor wafer and can improve local planarity in the semiconductor. Flexural modulus is preferably measured with ASTM 790 B at 73 degrees Fahrenheit. Pounds per square inch is psi.

A finishing element having Young's modulus in particular ranges is also preferred. A finishing element having a high Young's modulus is generally more efficient for planarizing. A finishing element having a low Young's modulus is generally more efficient for polishing. Further a continuous belt finishing element can have a different optimum Young's modulus than a finishing element disk. One also needs to consider the workpiece surface to be finished in selecting the Young's modulus. For a flexible finishing element, having a Young's modulus from 100 to 700,000 psi (pounds per square in inch) is preferred and one having a Young's modulus from 300 to 200,000 psi is more preferred and one having a Young's modulus from 300 to 150,000 psi is even more preferred. Particularly stiff finishing elements can have a preferred Young's modulus of at least 700,000 psi. For particularly flexible finishing elements, a Young's modulus of less than 100,000 psi are preferred and less than 50,000 psi is more preferred.

A reinforcing layer or member can also be included with or attached to finishing element finishing body. A finishing element having a finishing body connected to a reinforcing layer is preferred and a finishing element having a finishing body integral with a reinforcing layer is more preferred. Preferred nonlimiting examples of reinforcing layers or members are fiber constructions, woven fabrics, film layers, and long fiber reinforcement members. A continuous belt can have substantially continuous fibers therein. Aramid fibers are particularly preferred for their low stretch and excellent strength. The reinforcing layers can be attached with illustrative generally known adhesives and various generally known thermal processes such as extrusion coating or bonding.

Fixed abrasive finishing elements can be used and are preferred for some applications. A fixed abrasive finishing element comprised of a synthetic resin composition is preferred. A fixed abrasive finishing element comprising at least one layer of a soft synthetic resin is preferred. A fixed abrasive finishing element comprising at least one layer of a elastomeric synthetic resin is preferred. A fixed abrasive finishing element comprising at least one layer of a thermoset elastomeric synthetic resin is preferred.

The fixed abrasive firmly attached to the finishing element finishing surface is preferred. The abrasive can be firmly attached to the finishing element finishing surface with known adhesives and/or mixed into a surface layer of a polymeric layer, preferably an organic polymeric layer. Particular abrasive surface topographies can be preferred for specific applications. Fixed abrasive finishing elements are generally known to those skilled in the art. Some nonlimiting examples include U.S. Pat. No. 4,966,245 to Callinan, U.S. Pat. No. 5,692,950 to Rutherford, U.S. Pat. No. 5,823,855 to Robinson, WO 98/06541 to Rutherford and WO 98/181159 to Hudson and are included herein by reference in their entirety for general guidance and modification of fixed abrasive finishing elements by those skilled in the art. Illustrative nonlimiting examples of fixed abrasive polishing pads for semiconductor wafers are commercially available 3M Co. and Sony Corporation.

An abrasive finishing element having abrasive asperities on the finishing element finishing surface is preferred. An abrasive finishing element having abrasive asperities having a height from 0.5 to 0.005 micrometers is preferred and an abrasive finishing element having abrasive asperities having a height from 0.3 to 0.005 micrometers is more preferred and an abrasive finishing element having abrasive asperities having a height from 0.1 to 0.01 micrometers is even more preferred and an abrasive finishing element having abrasive asperities having a height from 0.05 to 0.005 micrometers is more particularly preferred. The asperities are preferably firmly attached to the finishing element finishing surface and asperities which are an integral part of the finishing element finishing surface are more preferred. An abrasive finishing element having small asperities can finish a workpiece surface to fine tolerances.

The organic boundary lubricant can be dispersed in the finishing element surface and transferred to the operative finishing interface during finishing. The lubricating aid can be contained in the finishing element body in different preferred forms. A lubricating aid dispersed in an organic synthetic polymer is preferred. A lubricating aid which is a liquid lubricant can be dispersed throughout the primary organic synthetic resin wherein the liquid lubricant effect of the binding of the fixed abrasive is carefully controlled. A fixed abrasive free of a coating having finishing aids is preferred and fixed abrasive particles free of a coating having finishing aid is more preferred. A lubricating aid dispersed in a minor amount of the organic synthetic polymer which is itself dispersed in the primary organic synthetic polymer in discrete, unconnected regions is more preferred. As an illustrative example, a lubricant is dispersed in a minor amount of an ethylene vinyl acetate wherein the ethylene vinyl acetate is dispersed in discrete, unconnected regions in a polyacetal resin. A lubricating aid dispersed in discrete, unconnected regions in an organic synthetic polymer is preferred. By dispersing the finishing aid and/or lubricating aids in a plurality of discrete, unconnected regions, their impact on the binding of the fixed abrasive in the body of the fixed abrasive element is reduced or eliminated.

Supplying an effective amount of an organic boundary lubricant from the finishing element finishing surface layer which reduces the coefficient of friction between the finishing element finishing surface and the workpiece surface being finished is preferred. Supplying an effective amount of an organic boundary lubricant from the finishing element finishing surface layer, more preferably a lubricating aid, which reduces the unwanted surface damage to the surface of the workpiece being finished during finishing is preferred. Supplying an effective amount of an organic boundary lubricant from the finishing element finishing surface layer, more preferably a lubricating aid, which differentially lubricates different regions of the work piece and reduces the unwanted surface damage to at least a portion of the surface of the workpiece being finished during finishing is preferred.

Stabilizing Fillers for Finishing Element

A fibrous filler is a preferred stabilizing filler for the finishing elements of this invention. A plurality of synthetic fibers are particularly preferred fibrous filler. Fibrous fillers tend to help generate a lower abrasion coefficient and/or stabilize the finishing element finishing surface from excessive wear. By reducing wear the finishing element has improved stability during finishing.

A preferred stabilizing filler is a dispersion of fibrous filler material dispersed in the finishing element body. Organic synthetic resin fibers are a preferred fibrous filler. Preferred fibrous fillers include fibers selected from the group consisting of aramid fibers, polyester fibers, and polyamide fibers. Preferably the fibers have a fiber diameter of from 1 to 15 microns and more preferably, from 1 to 8 microns. Preferably the fibers have a length of less than 1 cm and more preferably a length from 0.1 to 0.6 cm and even more preferably a length from 0.1 to 0.3 cm. Particularly preferred are short organic synthetic resin fibers that can be dispersed in the finishing element and more preferably mechanically dispersed in at least a portion of the finishing element proximate to the finishing element finishing surface and more preferably, mechanically substantially uniformly dispersed in at least a portion of the finishing element proximate to the finishing element finishing surface and even more preferably, mechanically substantially uniformly dispersed in at least a portion of the finishing element proximate to the finishing element finishing surface. The short organic synthetic fibers are added in the form of short fibers substantially free of entanglement and dispersed in the finishing element matrix. Preferably, the short organic synthetic fibers comprise fibers of at most 0.6 cm long and more preferably 0.3 cm long. An aromatic polyamide fiber is particularly preferred. Aromatic polyamide fibers are available under the trade names of "Kevlar" from DuPont in Wilmington, Del. and "Teijin Cornex" from Teijin Co. Ltd. The organic synthetic resin fibers can be dispersed in the synthetic by methods generally known to those skilled in the art. As a nonlimiting example, the cut fibers can be dispersed in a thermoplastic synthetic resin particles of under 20 mesh, dried, and then compounded in a twin screw, counter rotating extruder to form extruded pellets having a size of from 0.2–0.3 cm. Optionally, the pellets can be water cooled, as appropriate. These newly formed thermoplastic pellets having substantially uniform discrete, dispersed, and unconnected fibers can be used to extruded or injection mold a finishing element of this invention. Aramid powder can also be used to stabilize the finishing element organic synthetic polymeric resins to wear. Organic synthetic resin fibers are preferred because they tend to reduce unwanted scratching to the workpiece surface.

U.S. Pat. No. 4,877,813 to Jimmo, U.S. Pat. No. 5,079,289 to Takeshi et. al., and U.S. Pat. No. 5,523,352 to Janssen are included herein by reference in its entirety for general guidance and appropriate modification by those skilled in the art.

Workpiece

A workpiece needing finishing is preferred. A semiconductor wafer is particularly preferred. A homogeneous surface composition is a workpiece surface having one composition throughout and is preferred for some applications. A workpiece needing polishing is preferred. A workpiece needing planarizing is especially preferred. A workpiece having a microelectronic surface is preferred. A microelectronic part is a preferred workpiece. A microelectronic component is another preferred workpiece. A workpiece surface having a heterogeneous surface composition is preferred. A heterogeneous surface composition has different regions with different compositions on the surface, further the heterogeneous composition can change with the distance from the surface. Thus finishing can be used for a single workpiece whose surface composition changes as the finishing process progresses. A semiconductor wafer surface having a heterogeneous surface composition is preferred. A heterogeneous surface composition having different regions with different compositions on the surface is a preferred heterogeneous surface. A heterogeneous surface having different local topographies such as unwanted raised regions is a preferred heterogeneous surface. An example of a heterogeneous surface is a surface having regions of high conductivity and regions of lower conductivity. A heterogeneous surface uncovered during semiconductor wafer processing such as a heterogeneous interface having regions of high conductivity and lower conductivity is a preferred heterogeneous surface. A workpiece having a microelectronic surface having both conductive regions and nonconductive regions is more preferred and is an example of a preferred heterogeneous workpiece surface. Illustrative examples of conductive regions can be regions having copper or tungsten and other known conductors, especially metallic conductors. Metallic conductive regions in the workpiece surface consisting of metals selected from the group consisting of copper, aluminum, and tungsten or combinations thereof are particularly preferred. A semiconductor device is a preferred workpiece. A substrate wafer is a preferred workpiece. A semiconductor wafer having a polymeric layer requiring finishing is preferred because a lubricating aid can be particularly helpful in reducing unwanted surface damage to the softer polymeric surfaces. An example of a preferred polymer is a polyimide. Polyimide polymers are commercially available from E. I. DuPont Co. in Wilmington, Del.

This invention is particularly preferred for workpieces requiring a highly flat surface. Finishing a workpiece surface to meet the specified semiconductor industry circuit design rule is preferred and finishing a workpiece surface to meet the 0.35 micrometers feature size semiconductor design rule is more preferred and finishing a workpiece surface to meet the 0.25 micrometers feature size semiconductor design rule is even more preferred and finishing a workpiece surface to meet the 0.18 micrometers semiconductor design rule is even more particularly preferred. An electronic wafer finished to meet a required surface flatness of the wafer device rule in to be used in the manufacture of ULSIs (Ultra Large Scale Integrated Circuits) is a particularly preferred workpiece made with a method according to preferred embodiments of this invention. The design rules for semiconductors are generally known to those skilled in the art. Guidance can also be found in the "The National Technology Roadmap for Semiconductors" published by SEMATECH in Austin, Tex.

Supplying an aqueous lubricating composition to a semiconductor wafer having a diameter of at least 200 mm is preferred and supplying an aqueous lubricating composition to a semiconductor wafer having a diameter of at least 300 mm is more preferred. Supplying an aqueous lubricating composition having a lubricant to a semiconductor wafer having a diameter of at least 200 mm is even more preferred and supplying aqueous lubricating having a lubricant to a semiconductor wafer having a diameter of at least 300 mm is more preferred. Large semiconductor wafers can generally be finished more effectively with an aqueous lubricating composition, particularly one having lubricant. Friction, heat generation, manufacturing costs can be more effectively controlled with the sensors and methods disclosed herein.

Finishing Composition

Finishing compositions such as CMP slurries are generally known for finishing workpieces. A chemical mechanical polishing slurry is an example of a preferred finishing composition. Finishing compositions that have their pH adjusted carefully, and generally comprise other chemical additives are used to effect chemical reactions and/or other surface changes to the workpiece. A finishing composition having dissolved chemical additives is particularly preferred. Finishing compositions having small abrasive particles in a slurry are preferred for many applications. Illustrative preferred examples include dissolved chemical additives include dissolved acids, bases, buffers, oxidizing agents, reducing agents, stabilizers, and chemical reagents. A finishing composition having a chemical which substantially reacts with material from the workpiece surface being finished is particularly preferred. A finishing composition chemical which selectively chemically reacts with only a portion of the workpiece surface is particularly preferred. A finishing composition having a chemical which preferentially chemically reacts (or interacts) with only a portion of the workpiece surface is particularly preferred.

Some illustrative nonlimiting examples of polishing slurries which can be used and/or modified by those skilled in the art are now discussed. An example slurry comprises water, a solid abrasive material and a third component selected from the group consisting of $HNO_3$, $H_2SO_4$, and $AgNO_3$ or mixtures thereof Another polishing slurry comprises water, aluminum oxide, and hydrogen peroxide mixed into a slurry. Other chemicals such as KOH or potassium hydroxide can also be added to the above polishing slurry. Still another illustrative polishing slurry comprises $H_3PO_4$ at from about 0.1% to about 20% by volume, $H_2O_2$ at from 1% to about 30% by volume, water, and solid abrasive material. Still another polishing slurry comprises an oxidizing agent such as potassium ferricyanide, and an abrasive such as silica, and has a pH of between 2 and 4. Still another polishing slurry comprises high purity fine metal oxide particles uniformly dispersed in a stable aqueous medium. Still another polishing slurry comprises a colloidal suspension of $SiO_2$ particles having an average particle size of between 20 and 50 nanometers in alkali solution, demineralized water, and a chemical activator. U.S. Pat. No. 5,209,816 to Yu et. al. issued in 1993, U.S. Pat No. 5,354490 to Yu et. al. issued in 1994, U.S. Pat. No. 5,5408,810 to Sandhu et. al. issued in 1996, U.S. Pat. No. 5,516,346 to Cadien et. al. issued in 1996, U.S. Pat. No. 5,527,423 to Neville et. al. issued in 1996, U.S. Pat. No. 5,622,525 to Haisma et. al. issued in 1997, and U.S. Pat. No. 5,645,736 to Allman issued in 1997 comprise illustrative nonlimiting examples of slurries contained herein for further general guidance and modification by those skilled in the arts. Commercial CMP polishing slurries are also available from Rodel Manufacturing Company in Newark, Del.

Finishing Aid

Supplying an effective amount of finishing aid, more preferably a lubricating aid, which reduces the coefficient of friction between the finishing element finishing surface and the workpiece surface being finished is preferred. Supplying an effective amount of finishing aid, more preferably a lubricating aid, which reduces the unwanted surface damage to the surface of the workpiece being finished during finishing is preferred. Supplying an effective amount of finishing aid, more preferably a lubricating aid, which differentially lubricates different regions of the workpiece and reduces the unwanted surface damage to at least a portion of the surface of the workpiece being finished during finishing is preferred.

The finishing aid, more preferably a lubricating aid, can help reduce the formation of surface defects for high precision part finishing. Fluid based finishing aid, more preferably a lubricating aid, can be incorporated in the finishing element finishing surface. A method of finishing which adds an effective amount of fluid based finishing aid, more preferably a lubricating aid, to the interface between the finishing element finishing surface and workpiece surface being finished is preferred. A preferred effective amount of fluid based finishing aid, more preferably a lubricating aid, reduces the occurrence of unwanted surface defects. A preferred effective amount of fluid based finishing aid, more preferably a lubricating aid, reduces the coefficient of friction between the work piece surface being finished and the finishing element finishing surface.

A lubricating aid which is water soluble is preferred for many applications. An organic boundary layer lubricant which comprises a water soluble organic boundary layer lubricant is preferred and which consists essentially of a water soluble organic boundary layer lubricant is more preferred and which consists of a water soluble organic boundary layer lubricant is even more preferred. A lubricating aid which has a different solubility in water at different temperatures is more preferred. A degradable finishing aid, more preferably a lubricating aid, is also preferred and a biodegradable finishing aid, more preferably a lubricating aid, is even more preferred. An environmentally friendly finishing aid, more preferably a lubricating aid, is particularly preferred Certain particularly important workpieces in the semiconductor industry have regions of high conductivity and regions of low conductivity. The higher conductivity regions are often comprised of metallic materials such as tungsten, copper, aluminum, and the like. An illustrative example of a common lower conductivity region is silicon or silicon oxide. A lubricant which differentially lubricates the two regions is preferred and a lubricant which substantially lubricates two regions is more preferred. An example of a differential lubricant is if the coefficient of friction is changed by different amounts in one region versus the other region during finishing. For instance one region can have the coefficient of friction reduced by 20% and the other region reduced by 40%. This differential change in lubrication can be used to help in differential finishing of the two regions. An example of differential finishing is a differential finishing rate between the two regions. For example, a first region can have a finishing rate of"X" angstroms/minute and a second region can have a finishing rate of "Y" angstroms per minute before lubrication and after differential lubrication, the first region can have a finishing rate of 80% of "X" and the second region can have a finishing rate of 60% of "Y". An example of where this will occur is when the lubricant tends to adhere to one region because of physical or chemical surface interactions (such as a metallic conductive region) and adhere or not adhere as tightly to the an other region (such as a non metallic, non conductive region). Changing the finishing control parameters to change the differential lubrication during finishing of the workpiece is a preferred method of finishing. Changing the finishing control parameters to change the differential lubrication during finishing of the workpiece which in turn changes the regional finishing rates in the workpiece is a more preferred method of finishing. Changing the finishing control parameters with in situ process control to change the differential lubrication during finishing of the workpiece which in turn changes the region finishing rates in the workpiece is an even more preferred method of finishing. The friction sensor probes play an important role in detecting and controlling differential lubrication in the workpieces having heterogeneous surface compositions needing finishing.

A lubricant comprising a reactive lubricant is preferred. A lubricant comprising a boundary lubricant is also preferred. A reactive lubricant is a lubricant which chemically reacts with the workpiece surface being finished. A lubricant free of sodium is a preferred lubricant. As used herein a lubricant free of sodium means that the sodium content is below the threshold value of sodium which will adversely impact the performance of a semiconductor wafer or semiconductor parts made therefrom. A boundary layer lubricant is a preferred example of a lubricant which can form a lubricating film on the surface of the workpiece surface. As used herein a boundary lubricant is a thin layer on one or more surfaces which prevents or at least limits, the formation of strong adhesive forces between the workpiece being finished and the finishing element finishing surface and therefore limiting potentially damaging friction junctions between the workpiece surface being finished and the finishing element finishing surface. A boundary layer film has a comparatively low shear strength in tangential loading which reduces the tangential force of friction between the workpiece being finished and the finishing element finishing surface which can reduce surface damage to the workpiece being finished. In other words, boundary lubrication is a lubrication in which friction between two surfaces in relative motion, such as the workpiece surface being finished and the finishing element finishing surface, is determined by the properties of the surfaces, and by the properties of the lubricant other than the viscosity. A boundary film generally forms a thin film, perhaps even several molecules thick, and the boundary film formation depends on the physical and chemical interactions with the surface. A boundary lubricant which forms of thin film is preferred. A boundary lubricant forming a film having a thickness from 1 to 10 molecules thick is preferred and a boundary lubricant forming a film having a thickness from 1 to 6 molecules thick is more preferred and a boundary lubricant forming a film having a thickness from 1 to 4 molecules thick is even more preferred. A boundary lubricant forming a film having a thickness from 1 to 10 molecules thick on at least a portion of the workpiece surface being finished is particularly preferred and a boundary lubricant forming a film having a thickness from 1 to 6 molecules thick on at least a portion of the workpiece surface being finished is more particularly preferred and a boundary lubricant forming a film having a thickness from 1 to 4 molecules thick on at least a portion of the workpiece surface being finished is even more particularly preferred. A boundary lubricant forming a film having a thickness of at most 10 molecules thick on at least a portion of the workpiece surface being finished is preferred and a boundary lubricant forming a film having a thickness of at most 6 molecules thick on at least a portion of the workpiece surface being finished is more preferred and a boundary lubricant forming a film having a thickness of at most 4 molecules thick on at least a portion of the workpiece surface being finished is even more preferred and a boundary lubricant forming a film having a thickness of at most 2 molecules thick on at least a portion of the workpiece surface being finished is even more preferred. An operative motion which continues in a substantially uniform direction can improve boundary layer formation and lubrication. Friction sensor subsystems and finishing sensor subsystems having the ability to control the friction probe motions and workpiece motions are preferred and uniquely able to improve finishing in many real time lubrication changes to the operative finishing interface. Boundary layer lubricants, because of the small amount of required lubricant, can be effective lubricants for use in the operative finishing interface.

An organic boundary layer lubricant is a preferred lubricant. A boundary layer lubricant which forms a thin lubricant film on the metal conductor portion of a workpiece surface being finished is particularly preferred. A nonlimiting preferred group of example organic boundary layer lubricants include at least one lubricant selected from the group consisting of fats, fatty acids, esters, and soaps. A phosphorous containing compound can be an effective preferred boundary lubricant. A phosphate ester is an example of a preferred phosphorous containing compound which can be an effective boundary lubricant. A chlorine containing compound can be an effective preferred boundary lubricant. A sulfur containing compound can be an effective preferred boundary lubricant. A nitrogen containing compound can be an effective preferred boundary lubricant. An amine derivative of a polyglycol can be a preferred boundary lubricant. A diglycol amine is a preferred amine derivative of a polyglycol. A compound containing atoms selected from the group consisting of at least one of the following elements oxygen, fluorine, nitrogen, or chlorine can be a preferred lubricant. A compound containing atoms selected from the group consisting of at least two of the following elements oxygen, fluorine, nitrogen, or chlorine can be a more preferred lubricant. A synthetic organic polymer containing atoms selected from the group consisting of at least one of the following elements oxygen, fluorine, nitrogen, or chlorine can be a preferred an organic boundary layer lubricant. A synthetic organic polymer containing atoms selected from the group consisting of at least two of the following elements oxygen, fluorine, nitrogen, or chlorine can be a more preferred an effective organic boundary layer lubricant. A synthetic organic polymer containing atoms selected from the group consisting of at least two of the following elements oxygen, fluorine, nitrogen, or chlorine can be a preferred organic boundary layer lubricant. A sulfated vegetable oil and sulfurized fatty acid soaps are preferred examples of a sulfur containing compound can be preferred organic boundary layer lubricants. Organic boundary layer lubricant and lubricant chemistries are discussed further herein below. A lubricant which reacts physically with at least a portion of the workpiece surface being finished is a preferred lubricant. A lubricant which reacts chemically with at least a portion of the workpiece surface being finished is often a more preferred lubricant because it is often a more effective lubricant and can also aid at times directly in the finishing. A lubricant which reacts chemically with at least a portion of the workpiece surface being finished and which is non-staining is a particularly preferred lubricant because it is often a more effective lubricant, is generally easily cleaned from the workpiece, and can also aid directly in the finishing as discussed herein.

Limited zone lubrication between the workpiece being finished and the finishing element finishing surface is preferred. As used herein, limited zone lubricating is lubricating to reduce friction between two surfaces while simultaneously having wear occur. Limited zone lubricating which simultaneously reduces friction between the operative finishing interface while maintaining a cut rate on the workpiece surface being finished is preferred. Limited zone lubricating which simultaneously reduces friction between the operative finishing interface while maintaining an acceptable cut rate on the workpiece surface being finished is more preferred. Limited zone lubricating which simultaneously reduces friction between the operative finishing interface while maintaining a finishing rate on the workpiece surface being finished is preferred. Limited zone lubricating which simultaneously reduces friction between the operative finishing interface while maintaining an acceptable finishing rate on the workpiece surface being finished is more preferred. Limited zone lubricating which simultaneously reduces friction between the operative finishing interface while maintaining a planarizing rate on the workpiece surface being finished is preferred. Limited zone lubricating which simultaneously reduces friction between the operative finishing interface while maintaining an acceptable planarizing rate on the workpiece surface being finished is more preferred. Limited zone lubricating which simultaneously reduces friction between the operative finishing interface while maintaining a polishing rate on the workpiece surface being finished is preferred. Limited zone lubricating which simultaneously reduces friction between the operative finishing interface while maintaining an acceptable polishing rate on the workpiece surface being finished is preferred. Lubricant types and concentrations are preferably controlled during limited zone lubricating. Limited zone lubricating offers the advantages of controlled wear along with reduced unwanted surface damage. In addition, since limited zone lubrication often involves thin layers of lubricant, often less lubricant can be used to finish a workpiece.

Lubricants which are polymeric can be very effective lubricants. Supplying a lubricant to the interface of the workpiece surface being finished and the finishing element finishing surface wherein the lubricant is from 0.1 to 15% by weight of the total fluid between the interface is preferred and from 0.2 to 12% by weight of the total fluid between the interface is more preferred and from 0.3 to 12% by weight of the total fluid between the interface is even more preferred and from 0.3 to 9% by weight of the total fluid between the interface is even more particularly preferred. These preferred ranges are given for general guidance and help to those skilled in the art. Lubricants outside this range are currently believed to be useful but not as economical to use.

A lubricant having functional groups containing elements selected from the group consisting of chlorine, sulfur, and phosphorous is preferred and a boundary lubricant having functional groups containing elements selected from the group consisting of chlorine, sulfur, and phosphorous is more preferred. A lubricant comprising a fatty acid substance is a preferred lubricant. A preferred example of a fatty substance is a fatty acid ester or salt. Fatty acid salts of plant origin can be particularly preferred. A lubricant comprising a synthetic polymer is preferred and a lubricant comprising a boundary lubricant synthetic polymer is more preferred and a lubricant comprising a boundary lubricant synthetic polymer and wherein the synthetic polymer is water soluble is even more preferred. A polymer having a number average molecular weight from 400 to 150,000 is preferred and one having a number average molecular weight from 1,000 to 100,000 is more preferred and one having a number average molecular weight from 1,000 to 50,000 is even more preferred.

A lubricant comprising a polyalkylene glycol polymer is a preferred composition. A polymer of polyoxyalkylene glycol monoacrylate or polyoxyalkylene glycol monomethacrylate is very useful as a base of lubricant. A polyethylene glycol having a molecular weight of 400 to 1000 is preferred. Polyglycols selected from the group polymers consisting of ethylene oxide, propylene oxide, and butylene oxide and mixtures thereof are particularly preferred. A fatty acid ester can be an effective lubricant.

A finishing aid, preferably a lubricating aid, can be contained in the finishing element finishing surface and then supplied to the interface between the workpiece being finished and the finishing element finishing surface by the operative finishing motion. The interface between the workpiece being finished and the finishing element finishing surface is often referred to herein as the operative finishing interface. Alternately, the finishing aid can be delivered in the finishing composition, preferably in a fluid, and more preferably in an aqueous finishing composition. Both techniques have advantages in different finishing situations. When the finishing aid is contained in the finishing element surface the need for finishing aids in the finishing composition is reduced or eliminated. Supplying finishing aids in a fluid finishing composition generally offers improved control of lubrication at the operative finishing interface. Both the concentration and the feed rate of the finishing aid can be controlled. If the finishing aids are supplied in a first finishing composition free of abrasives and abrasives are supplied in a second finishing composition, then the finishing aids, preferably lubricating aids, can be controlled separately and independently from any supplied abrasive. If the finishing aids are supplied in a first finishing composition free of abrasives and abrasives are supplied in the finishing element finishing surface, then the finishing aids, preferably lubricating aids, can be again controlled separately and independently from any supplied abrasive. Supplying lubricating aid separately and independently of the abrasive to the operative finishing interface is preferred because this improves finishing control.

A lubricating aid which can be included in the finishing element can be preferred and an organic boundary layer lubricant which can be included in the finishing element is more preferred. A lubricating aid distributed in at least a portion of the finishing element proximate to the finishing element finishing surface is preferred and a lubricating aid distributed substantially uniformly in at least a portion of the finishing element proximate to the finishing element finishing surface is more preferred and a lubricating aid distributed uniformly in at least a portion of the finishing element proximate to the finishing element finishing surface is even more preferred. A lubricating aid selected from the group consisting of liquid and solid lubricants and mixtures thereof is a preferred finishing aid.

A combination of a liquid lubricant and ethylene vinyl acetate, particularly ethylene vinyl acetate with 15 to 50% vinyl acetate by weight, can be a preferred effective lubricating aid additive. Preferred liquid lubricants include paraffin of the type which are solid at normal room temperature and which become liquid during the production of the finishing element. Typical examples of desirable liquid lubricants include paraffin, naphthene, and aromatic type oils, e.g. mono- and polyalcohol esters of organic and inorganic acids such as monobasic fatty acids, dibasic fatty acids, phthalic acid and phosphoric acid.

The lubricating aid can be contained in finishing element body in different preferred forms. A lubricating aid dispersed in an organic synthetic polymer is preferred. A lubricating aid dispersed in a minor amount of an organic synthetic polymer which is itself dispersed in the primary organic synthetic polymeric resin in discrete, unconnected regions is more preferred. As an illustrative example, a lubricant dispersed in a minor amount of an ethylene vinyl acetate and wherein the ethylene vinyl acetate is dispersed in discrete, unconnected regions in a polyacetal resin. A lubricating aid dispersed in discrete, unconnected regions in an organic synthetic polymer is preferred.

A polyglycol is an example of a preferred finishing aid. Preferred polyglycols include glycols selected from the group consisting of polyethylene glycol, an ethylene oxide-propylene butyl ethers, a diethylene glycol butyl ethers, ethylene oxide-propylene oxide polyglycol, a propylene glycol butyl ether, and polyol esters. A mixture of polyglycols is a preferred finishing aid. Alkoxy ethers of polyalkyl glycols are preferred finishing aids. An ultra high molecular weight polyethylene, particularly in particulate form, is an example of preferred finishing aid. A fluorocarbon resin is an example of a preferred lubricating agent. Fluorocarbons selected from the group consisting of polytetrafluoroethylene (PTFE), ethylene tetrafluoride/propylene hexafluoride copolymer resin (FEP), an ethylene tetrafluoride/perfluoroalkoxyethylene copolymer resin (PFA), an ethylene tetra fluoride/ethylene copolymer resin, a trifluorochloroethylene copolymer resin (PCTFE), and a vinylidene fluoride resin are examples of preferred fluorocarbon resin finishing aids. A polyphenylene sulfide polymer is a preferred polymeric lubricating aid. Polytetrafluoroethylene is a preferred finishing aid. Polytetrafluoroethylene in particulate form is a more preferred finishing aid and polytetrafluoroethylene in particulate form which resists reaggolmeration is a even more preferred finishing aid. A silicone oil is a preferred finishing aid. A polypropylene is a preferred finishing aid, particularly when blended with polyamide and more preferably a nylon 66. A lubricating oil is a preferred finishing aid. A polyolefin polymer can be a preferred effective lubricating aid, particularly when incorporated into polyamide resins and elastomers. A high density polyethylene polymer is a preferred polyolefin resin. A polyolefin/polytetrafluoroethylene blend is also a preferred lubricating aid. Low density polyethylene can be a preferred lubricating aid. A fatty acid substance can be a preferred lubricating aid. An examples of a preferred fatty acid substance is a fatty ester derived from a fatty acid and a polyhydric alcohol. Examples fatty acids used to make the fatty ester are lauric acid, tridecylic acid, myristic acid, pentadecylic acid, palmitic acid, margaric acid, stearic acid, nonadecylic acid, arachidic acid, oleic acid, elaidic acid and other related naturally occurring fatty acids and mixtures thereof. Examples of preferred polyhydric alcohols include ethylene glycol, propylene glycol, homopolymers of ethylene glycol and propylene glycol or polymers and copolymers thereof and mixtures thereof.

Illustrative, nonlimiting examples of useful lubricants and systems for use in lubricated finishing element finishing surface systems and general useful related technology are given in the U.S. Pat. No. 3,287,288 to Reilling, U.S. Pat. No. 3,458,596 to Eaigle, U.S. Pat. No. 4,877,813 to Jimo et. al., U.S. Pat. No. 5,079,287 to Takeshi et. al., U.S. Pat. No. 5,110,685 to Cross et. al., U.S. Pat. No. 5,216,079 to Crosby et. al., U.S. Pat. No. 5,523,352 to Janssen, and U.S. Pat. No. 5,591,808 to Jamison and are included herein by reference in their entirety for guidance and modification as appropriate by those skilled in the art. Further illustrative, non limiting examples of useful lubricants and fluid delivery systems and general useful related technology are given in U.S. Pat. No. 4,332,689 to Tanizaki, U.S. Pat. No. 4,522,733 to Jonnes, U.S. Pat. No. 4,544,377 to Schwen, U.S. Pat. No. 4,636,321 to Kipp et. al., U.S. Pat. No. 4,767,554 to Malito et. al., U.S. Pat. No. 4,950,415 to Malito, U.S. Pat. No. 5,225,249 to Biresaw, U.S. Pat. No. 5,368,757 to King, 5,401,428 to Kalota, U.S. Pat. No. 5,433,873 to Camenzind, U.S. Pat. No. 5,496,479 to Videau et. al., and U.S. Pat. No. 5,614,482 to Baker et. al. are included for guidance and modification by those skilled in the art and are included by reference in their entirety herein. It is also understood that the lubricants and lubricant systems can be combined in many different ways in this invention to produce useful finishing results given the new guidance herein.

Supplying an effective organic boundary layer lubricating composition to the interface between the workpiece surface being finished and the finishing element finishing surface is preferred and supplying an organic lubrication having an effective amount organic boundary layer lubrication to the operative finishing interface to change finishing rates is more preferred. Boundary layer lubrication which is less than complete lubrication and facilitates controlling frictional wear and tribochemical reactions is preferred. Independent control of the aqueous lubricating composition control parameters aids in controlling an effective amount of marginal lubrication and in situ control of the lubricant control parameters is more preferred. Changing the pressure applied to the operative finishing interface is a preferred control parameter which can change organic boundary layer lubrication. Changing the pressure applied to the operative finishing interface can be done particularly rapidly and controllably with a subsystem control in real time during finishing. Control of at least one of aqueous lubricating composition control parameters independent from changes in abrasives is preferred to enhance control of finishing. Control of at least one of aqueous lubricating composition control parameters in situ independent from changes in abrasives is preferred to enhance control of finishing. Non limiting examples of preferred independent aqueous lubricating composition control parameters is to feed aqueous lubricating composition separate and independently from any abrasive feed and then to adjust either the feed rate of the aqueous lubricating composition or the concentration(s) in the aqueous lubricating composition.

For general guidance for lubricants, some general test methods are discussed. Generally those skilled in the art know how to measure the kinetic coefficient of friction. A preferred method is ASTM D 3028-95 and ASTM D 3028-95 B is particularly preferred. Those skilled in the art can modify ASTM D 3028-95 B to adjust to appropriate finishing velocities and to properly take into consideration appropriate fluid effects due to the lubricant and finishing composition. Preferred lubricants and finishing compositions do not corrode the workpiece or localized regions of the workpiece. Corrosion can lead to workpiece failure even before the part is in service. ASTM D 130 is a is a useful test for screening lubricants for particular workpieces and workpiece compositions. As an example a metal strip such as a copper strip is cleaned and polished so that no discoloration or blemishes detectable. The finishing composition to be tested is then added to a test tube, the copper strip is immersed in the finishing composition and the test tube is then closed with a vented stopper. The test tube is then heated under controlled conditions for a set period of time, the metal strip is removed, the finishing composition removed, and the metal strip is compared to standards processed under identical conditions to judge the corrosive nature and acceptableness of the finishing composition. ASTM D 1748 can also be used to screen for corrosion. These test methods are included herein by reference in their entirety.

Some preferred suppliers of lubricants include Dow Chemical, Huntsman Corporation, and Chevron Corporation. An organic boundary layer lubricant consisting essentially of carbon, hydrogen, and oxygen is a particularly preferred lubricant. Organic boundary layer lubricants which are water soluble are also preferred and organic boundary layer lubricants free of mineral oils and vegetable oils can be preferred for applications where long term stability is especially preferred such as in slurry recycle applications.

Marginal Lubrication

FIG. 6 is an artist's representation of a micro-region of the operative finishing interface showing some of the regions having an effective organic boundary layer lubrication and some of the regions being free of the organic boundary lubrication. Reference Numeral 20 represents the workpiece being finished. Reference Numeral 24 represents the finishing element. Reference Numeral 26 represents the finishing element finishing surface. Reference Numeral 150 represents the effective organic boundary layer lubrication during finishing. The organic boundary layer lubrication does not effectively lubricate the entire workpiece surface being finished in this invention. Reference Numeral 152 represents regions where the workpiece surface is free of the organic boundary layer lubrication. Reference Numeral 154 represents regions where the workpiece surface is effectively lubricated with organic boundary layer lubrication. It is important to understand that organic boundary layer lubricated regions can be very small and the preferred organic boundary layer lubricant can be very thin, such as a boundary layer from one to a few molecular layers of an organic boundary lubricating layer. The regions and thickness of the organic boundary layer lubrication are not drawn to scale in FIG. 6 in order to better illustrate particularly preferred aspects of the organic boundary layer lubrication when finishing workpieces according to this invention.

As used herein, the coefficient of friction is defined in the normal manner, that is the coefficient of friction (COF) is equal to the friction force (ff) divided by the load (L). As used in this specification a marginal organic boundary lubrication layer is a term used to describe a surface which effectively has at least one region which has an effective boundary lubrication layer and at least one region which is effectively free of a boundary lubrication layer. An Effective Coefficient of Friction (ECOF) is a term used herein to help define and control marginal lubrication. Equation ECOF_ A1 will now be given which defines Effective Coefficient of Friction as used herein.

$$ECOF=(COF_LF)(FFOBL)+(1-FFOBL)(COF_L)$$

where:

ECOF=Effective Coefficient of Friction

FFOBL=surface area Fraction Free of Organic Boundary Layer lubrication

COF_LF=coefficient of friction for surface lubricant free (free of organic boundary layer lubricant)

COF_L=coefficient of friction for surface with lubricant (having an organic boundary layer lubricant)

To further illustrate, an example will now be given. In the example an organic boundary lubricant layer free region has a COF_LF of 0.5 and an FFOBL (surface area Fraction Free of Organic Boundary Layer lubrication) of 0.15. In the example a organic boundary lubricant layer region has a COF_L of 0.1 and looking to the equation above, the organic boundary layer lubricant covers a surface area fraction of 0.85. Further, the ECOF is calculated to be 0.16. Thus the ECOF with changes in COF_LF, COF_L, and FFOBL. FIG. 7 is a calculated graph of the change of the Effective Coefficient of Friction versus the fraction of the operative finishing surface interface which is free of an organic boundary lubricant wherein the coefficient of friction for the organic boundary layer lubricated semiconductor wafer surface is 0.1 and the coefficient of friction for the semiconductor wafer surface free of organic boundary lubricant is 0.5. If a heterogeneous semiconductor wafer surface is being finished, the terms for each of the uniform regions on the surface can be defined and can be used by those skilled in the art. A friction sensing method along with appropriate calculations from a processor can be used to advantage to selectively control the ECOF in a designated region or type of region as will be discussed herein below. Finishing in preferred value ranges of the effective coefficient of friction is an important aspect of this invention. Using the effective coefficient of friction to manage, control, and improve finishing results by reducing unwanted surface defects and improving semiconductor wafer processing costs is an important preferred embodiment of this invention. Using the effective coefficient of friction to control in situ, real time finishing is particularly preferred.

Adjusting the Effective Coefficient of Friction is a particularly preferred calculated control parameter to optimize both quality of the semiconductor surface being finished and the finishing rate as well as the cost of ownership to finish the semiconductor wafer surface. The finishing rate can be calculated to show an expected normalized finishing rate as a function of the change in this calculated Effective Coefficient of Friction. The results of these calculations are shown in FIG. 8. It is important to note that the finishing rate is non linear. There is a surprising increase in finishing rate where the workpiece surface area fraction free of organic boundary layer lubrication is from about 0.001 to 0.25. It is further important to note ECOF can be used as shown in FIG. 7 (and the equation above) to adjustably control the work piece surface area free of the organic boundary layer lubrication in FIG. 8. Another important consideration is the quality of the semiconductor surface being finished. Large workpiece particles removed during the operative finishing motion can scratch, gouge, or otherwise damage the workpiece surface during finishing. Therefore, it is important to reduce the size the workpiece particles removed during the operative finishing motion. Further, the quality of the surface finish is generally related to the size of the workpiece particles removed during the operative finishing motion; as the size of the workpiece particles decreases the quality of the surface finish generally improves. The predicted relative abraded particle size on a non lubricated surface to the abraded particle size on an organic boundary lubricated surface as a function of the fraction of the surface area free of organic boundary layer lubrication is shown in FIG. 9. As can be seen in FIG. 9, the ratio of the non lubricated abraded workpiece particle size (average mean diameter) to the abraded workpiece particle size (average mean diameter) from a partial organic boundary lubricated surface varies with the fraction of surface area free of boundary lubrication. The average mean workpiece particle diameter size removed during finishing increases surprisingly rapidly as the fraction of the semiconductor wafer surface free of organic boundary layer lubrication increases. It is further important to note that ECOF can be used as shown in FIG. 7 (and the equation above) to adjustably control the work piece surface area free of organic boundary layer lubrication in FIG. 9. Thus the ECOF can be used to adjustably control finishing rate and the average mean workpiece particle size removed during finishing. As the average mean workpiece particle size decreases, the workpiece surface generally improves in finish and the tendency for unwanted surface scratching or gouging on the workpiece surface is reduced.

Control of the Effective Coefficient of Friction is preferred for finishing, and more preferably for fixed abrasive finishing. As used herein, partial organic boundary lubrication is where a workpiece surface has an area(s) which has an organic boundary layer lubrication and where that same surface has an area(s) which is free of organic boundary layer lubrication. FIG. 6 is an artist's representation of a partial organic boundary layer lubrication. A careful review of FIGS. 6, 7, 8 and 9 shows an unexpected and preferred range of Effective Coefficient of Friction in the operative finishing interface for semiconductor wafers. To optimize, for instance, finishing rate and semiconductor surface quality, different values are preferred. An operative finishing interface having a Effective Coefficient of Friction within a value determined by the equation ECOF_Al wherein from 0.001 to 0.25 surface area fraction of the workpiece surface being finished is free of organic boundary layer lubrication is preferred and having surface area fraction of the workpiece surface being finished is free of organic boundary layer lubrication from 0.001 to 0.25 is more preferred and one having a surface area fraction of the workpiece surface being finished is free of organic boundary layer lubrication from 0.01 to 0.15 is even more preferred and one having a surface area fraction of the workpiece surface being finished is free of organic boundary layer lubrication from 0.02 to 0.15 is even more particularly preferred. Control of the Effective Coefficient of Friction in preferred value ranges for at least a portion of the finishing cycle is preferred. These unexpected ranges help reduce unwanted surface defects. Guidance on helpful parameters for adjusting the Effective Coefficient of Friction are discussed herein.

Partial organic boundary layer lubrication is preferred for finishing, and more preferably for fixed abrasive finishing. As used herein, partial organic boundary lubrication is where a workpiece surface's area(s) which has an organic boundary layer lubrication and that same surface has an area(s) which is free of organic boundary layer lubrication. FIG. 6 is an artist's representation of a partial organic boundary layer lubrication. A careful review of FIGS. 7, 8 and 9 show an unexpected and preferred range of partial organic boundary lubrication for semiconductor wafers. The Effective Coefficient of Friction depends at least in part on the fraction of the semiconductor wafer free of organic boundary layer lubricant (FFOBL). To optimize, for instance, finishing rate and semiconductor surface quality, different values are preferred. An operative finishing interface having from 0.001 to 0.25 fraction of the semiconductor wafer surface free of organic boundary lubrication for at least a portion of the finishing cycle is preferred and one having from 0.005 to 0.20 fraction of the semiconductor wafer surface free of organic boundary lubrication for at least a portion of the finishing cycle is more preferred and one having from 0.01 to 0.15 fraction of the semiconductor wafer surface free of organic boundary lubrication for at least a portion of the finishing cycle is even more preferred and one having from 0.02 to 0.15 fraction of the semiconductor wafer surface free of organic boundary lubrication for at least a portion of the finishing cycle is even more particularly preferred. These unexpected ranges help reduce unwanted surface defects and provide useful finishing rates.

Apparent partial organic boundary layer lubrication is preferred for fixed abrasive finishing. As used herein, apparent partial organic boundary lubrication is where a workpiece surface an area(s) acts as if it has an organic boundary layer lubrication and that same surface has an area(s) which is free of organic boundary layer lubrication and the coefficient of friction changes with the pressure (see for example FIG. 3, Reference Numeral 35) applied to the operative finishing interface. FIG. 6 is an artist's representation of a partial organic boundary layer lubrication. To improve the finishing rate and semiconductor surface quality, different effective partial organic boundary layer lubrication values are preferred. An operative finishing interface with an apparent partial organic boundary layer lubrication having from 0.001 to 0.25 fraction of the semiconductor wafer surface effectively free of organic boundary lubrication at least a portion of the finishing cycle is preferred and having from 0.005 to 20 fraction of the semiconductor wafer surface effectively free of organic boundary lubrication at least a portion of the finishing cycle is more preferred and having from 0.01 to 15 fraction of the semiconductor wafer surface effectively free of organic boundary lubrication at least a portion of the finishing cycle is even more preferred and having from 0.02 to 15 fraction of the semiconductor wafer surface effectively free of organic boundary lubrication at least a portion of the finishing cycle is even more particularly preferred. These unexpected ranges help reduce unwanted surface defects and good finishing rates.

Control of finishing control parameters to finish semiconductor wafers within preferred ranges of effective coefficient of friction values for a substantial amount of the finishing cycle time is preferred and control of finishing control parameters to finish semiconductor wafers within these preferred ranges of Effective Coefficient of Friction values for from 20% to 100% of the finishing cycle time is more preferred and control of finishing control parameters to finish semiconductor wafers within these preferred ranges of Effective Coefficient of Friction values for from 40 to 100% of the finishing cycle time is even more preferred. Controlling with in situ process control the finishing control parameters to finish semiconductor wafers within preferred ranges of Effective Coefficient of Friction values for a substantial amount of the finishing cycle time is preferred and for from 20% to 100% of the finishing cycle time is more preferred and for from 40 to 100% of the finishing cycle time is even more preferred. Use of in situ process control with in situ friction sensing methods to control the finishing control parameters to finish semiconductor wafers within these preferred Effective Coefficient of Friction for a substantial amount of the finishing cycle time is preferred and for from 20% to 100% of the finishing cycle time is more preferred and for from 40 to 100% of the finishing cycle time is even more preferred. Use of in situ process control with in situ friction sensing methods operatively connected to a processor which at least in part calculates a term related to the effective coefficient of friction to aid control of the finishing control parameters to finish semiconductor wafers within these preferred surface area fraction free of organic boundary layer lubrication values for a substantial amount of the finishing cycle time is preferred and for from 20% to 100% of the finishing cycle time is more preferred and for from 40 to 100% of the finishing cycle time is even more preferred. Use of in situ process control with in situ sensors operatively connected to a processor which at least in part calculates a effective coefficient of friction to aid control of the finishing control parameters to finish semiconductor wafers within these preferred surface area fractions free of organic boundary layer lubrication values for a substantial amount of the finishing cycle time is preferred and for from 20% to 100% of the finishing cycle time is more preferred and for from 40 to 100% of the finishing cycle time is even more preferred. Where high finishing rates (such as high initial cut rates) are preferred (such as high initial finishing rates), a range of from 5 to 95% of the finishing cycle time is preferred and a range of from 10 to 90% is more preferred for preferred control as discussed herein. Use of at least one friction sensing detector for control is preferred and use of at least two friction sensing detectors for control is more preferred and use of at least three function detectors for control is even more preferred. By controlling the finishing process within preferred effective coefficient of friction levels and finishing times with rapid real-time control using processors, surfaces can be improved and unwanted surface defects can be reduced.

As discussed herein, preferred semiconductor wafer surfaces can be heterogeneous. A heterogeneous semiconductor preferably has different uniform regions such as conductive regions and non-conductive regions. During finishing it is often the case that one of the uniform regions is particularly important during finishing. Also, because of differences such as surface energy, preferred marginal lubrication may be more important for one uniform region or the other uniform region. A preferred uniform region is a region having uniform chemical composition. A preferred uniform region in some applications is the conductive region. A preferred uniform region in some applications is the non-conductive region. In semiconductor finishing, generally there are uniform regions of chemical composition for multiple conductive and non-conductive regions. The priority is preferably judged on such parameters as desired finishing rates and surface quality. Alternately, a first organic boundary layer lubricant can be used for the first region and a second organic boundary layer lubricant can be used for the second region. An operative finishing interface having an Effective Coefficient of Friction within the preferred ranges discussed herein within a particular uniform region of the semiconductor wafer surface is preferred. Friction sensor probes are particularly preferred for this type of control. Controlling the Effective Coefficient of Friction with the preferred ranges for at least a portion of the finishing cycle is preferred and for from 5% to 95% of the finishing cycle time is more preferred for from 20 to 100% of the finishing cycle time is even more preferred and from 40 to 100% of the finishing cycle time is even particularly more preferred. In this manner, local finishing can be improved and localized surface defects can be reduced.

FIG. 14 is an artist's representation of finishing some unwanted raised regions and some regions below the unwanted raised regions. Reference Numeral 800 represents a portion of a semiconductor wafer surface having two unwanted raised regions. Reference Numeral 802 represents unwanted raised regions on the semiconductor surface being finished. Reference Numeral 804 represents lower local regions on the semiconductor surface being finished proximate to the unwanted raised regions. Reference Numeral 140 represents a small cross-section of the finishing element. Reference Numeral 810 represents the finishing element finishing surface in local contact with the unwanted raised regions (Reference Numeral 802). Reference Numeral 812 represents the finishing element surface local region displaced from but proximate to and lower than the unwanted raised local regions. As shown the finishing element finishing surface can reduce pressure and/or lose actual contact with the lower local regions on the semiconductor proximate to the unwanted raised local regions. This leads to unwanted raised regions having higher pressure which in turn can reduce the lubricating boundary layer thickness in the unwanted raised regions. Reducing the boundary layer thickness generally increases local tangential friction forces, raises the finishing rate measured in angstroms per minute on the unwanted raised regions. Also the pressure in lower regions proximate to the unwanted raised regions have is lower pressure applied which in turn can increase lubricating boundary layer thickness in these lower regions. Increasing the lubricating boundary layer thickness generally decreases local tangential forces, lowering the finishing rate measured in angstroms per minute in these lower regions proximate to the unwanted raised regions. By increasing finishing rate in the unwanted raised regions and lowering the finishing rate in the proximate lower regions the planarity of the semiconductor is generally improved. This generally helps the unwanted raised regions to have higher finishing rates when measured in angstroms per minute and improves within die nonuniformity. As shown in the FIG. 4, the region of contact with the unwanted raised region is small which in turn raises the finishing pressure applied by the finishing elements having a higher flexural modulus and this increased pressure increases the finishing rate measured in angstroms per minute at the unwanted raised region. This higher pressure on the unwanted raised region also increases frictional heat which can further increase finishing rate measured in angstroms per minute in the unwanted raised region. Boundary lubrication on the unwanted raised region can be reduced due to the higher temperature and/or pressure which further increases friction and finishing rate measured in angstroms per minute. Higher stiffness finishing element finishing surfaces apply higher pressures to the unwanted raised local regions which can further improve planarization, finishing rates, and within die nonuniformity. Finishing wherein the unwanted raised regions have a finishing rate measured in angstroms per minute of at least 1.6 times faster than in the proximate low local region measured in angstroms per minute is preferred and finishing wherein the unwanted raised regions have a finishing rate of at least 2 times faster than in the proximate low local region is more preferred and finishing wherein the unwanted raised regions have a finishing rate of at least 4 times faster than in the proximate low local region is even more preferred. Where there is no contact with the proximate low local region, the finishing rate in the low local region can be very small and thus the ratio between the finishing rate in the unwanted raised region to finishing rate in the low local region can be large. Finishing wherein the unwanted raised regions have a finishing rate measured in angstroms per minute of from 1.6 to 500 times faster than in the proximate low local region measured in angstroms per minute is preferred and finishing wherein the unwanted raised regions have a finishing rate of from 2 to 300 times faster than in the proximate low local region is more preferred and finishing wherein the unwanted raised regions have a finishing rate of from 2 to 200 times faster than in the proximate low local region is even more preferred and finishing wherein the unwanted raised regions have a finishing rate of from 4 to 200 times faster than in the proximate low local region is even more preferred. By finishing the unwanted raised regions at a faster rate, planarizing is improved.

A semiconductor wafer surface having at least one unwanted raised region which are effectively free of organic boundary layer lubrication for a portion of the finishing cycle time are preferred. A semiconductor wafer surface having a plurality of unwanted raised regions which are effectively free of organic boundary layer lubrication and have a higher effective coefficient of friction than the surface area proximate to the unwanted raised regions which have lower effective coefficient of friction is preferred. A semiconductor wafer surface having a plurality of unwanted raised regions which are effectively free of organic boundary layer lubrication and a higher temperature than the surface area proximate to the unwanted raised regions and which have a lower temperature is also preferred. A semiconductor wafer surface having a plurality of unwanted raised regions which are effectively free of organic boundary layer lubrication and have a higher effective coefficient of friction and a higher temperature than the surface area proximate to the unwanted raised regions which have lower effective coefficient of friction and a lower temperature is more preferred. By having a lower coefficient of friction on the unwanted raised region, generally higher cut rates and/or reaction rates can generally be attained.

By increasing the stiffness of the finishing element finishing surface, the pressure applied to the unwanted raised region can be increased. Flexural modulus as measured by ASTM 790 B at 73 Fahrenheit is a useful guide to help raise the stiffness of a polymer finishing element. By adjusting the flexural modulus as measured by ASTM 790 B at 73 degrees Fahrenheit the pressure can be increased on the unwanted raised regions to increase finishing rates measured in Angstroms per minute. Applying at least two times higher pressure to the unwanted raised region when compared to the applied pressure in a lower region proximate to the unwanted raised region is preferred and applying at least three times higher pressure to the unwanted raised region when compared to the applied pressure in a lower region proximate to the unwanted raised region is more preferred and applying five times higher pressure to the unwanted raised region when compared to the applied pressure in a lower region proximate to the unwanted raised region is even more preferred. Because the lower region proximate the unwanted raised region can have a very low pressure, at most 100 times higher pressure in the unwanted raised regions compared to the pressure in a lower region proximate the unwanted raised region is preferred and at most 50 times higher pressure in the unwanted raised regions compared to the pressure in a lower region proximate the unwanted raised region is more preferred. By adjusting the flexural modulus of the finishing element finishing surface, lubricating boundary layer, and the other control parameters discussed herein, finishing and planarization of semiconductor wafer surfaces can be accomplished.

FIG. 15 is an artist's representation of an example of the effects on the boundary layer lubrication discussed herein above. As discussed herein, it is not drawn to scale so the boundary layer thickness can be illustrated in simple fashion for helpful guidance. Reference Numeral 800 represents a cross-sectional view of a semiconductor wafer having two unwanted raised regions (Reference Numeral 802). Reference Numeral 804 represents a cross-sectional view of a semiconductor wafer having lower regions proximate to the two unwanted raised regions (Reference Numeral 802). Reference Numeral 900 represents the lubricating boundary layer. Reference Numeral 902 represents regions of partial or no local boundary layer lubrication (and generally with a higher coefficient of friction). In other words, Reference Number 902 represents regions having higher coefficients of friction and/or partial lubrication. Note that the regions of partial or no local organic boundary lubricating boundary layer can occur proximate to the unwanted raised regions on the semiconductor wafer surface being finished. Reference Numeral 904 represents a thicker region of lubricating boundary layer (and generally with lower coefficient of friction) which can generally occur in regions proximate to and below the unwanted raised regions and generally have lower coefficients of friction. Reference Numeral 810 represents a small cross-section of finishing element. The different local regions having different lubricating boundary layers and lubricating properties are referred to herein as differential boundary lubrication. Differential boundary lubrication can improve planarization for some semiconductor wafers (particularly at the die level). A uniform portion of the heterogeneous surface area which is effectively free of organic boundary layer lubrication has a higher effective coefficient of friction than the surface area having a more effective organic boundary lubrication is preferred. A uniform portion of the heterogeneous surface area which is effectively free of organic boundary layer lubrication has a higher temperature than the surface area having a more effective organic boundary lubrication is more preferred. A uniform portion of the heterogeneous surface area which is effectively free of organic boundary layer lubrication has a higher effective coefficient of friction and a higher temperature than the surface area having a more effective organic boundary lubrication is more preferred. By varying the temperature and/or coefficient of friction selectively, finishing rates can be influenced to improve selective finishing of different local regions on the workpiece.

Finishing a semiconductor wafer in an operative finishing interface having a percentage of the surface effectively free of organic boundary lubrication is new and unique to this invention. This method of finishing can improve the balance of finishing rate and surface quality unexpected ways.

Operative Finishing Motion

Chemical mechanical finishing during operation has the finishing element in operative finishing motion with the surface of the workpiece being finished. A relative lateral parallel motion of the finishing element to the surface of the workpiece being finished is an operative finishing motion. Lateral parallel motion can be over very short distances or macro-distances. A parallel circular motion of the finishing element finishing surface relative to the workpiece surface being finished can be effective. A tangential finishing motion can also be preferred. U.S. Pat. No. 5,177,908 to Tuttle issued in 1993, U.S. Pat. No. 5,234,867 to Schultz et. al. issued in 1993, U.S. Pat. No. 5,522,965 to Chisholm et. al. issued in 1996, U.S. Pat. No. 5,735,731 to Lee in 1998, and U.S. Pat. No. 5,962,947 to Talieh issued in 1997 comprise illustrative nonlimiting examples of the operative finishing motion contained herein for further general guidance of those skilled in the arts.

Some illustrative nonlimiting examples of preferred operative finishing motions for use in the invention are also discussed. This invention has some particularly preferred operative finishing motions of the workpiece surface being finished and the finishing element finishing surface. Moving the finishing element finishing surface in an operative finishing motion to the workpiece surface being finished is a preferred example of an operative finishing motion. Moving the workpiece surface being finished in an operative finishing motion to the finishing element finishing surface is a preferred example of an operative finishing motion. Moving the finishing element finishing surface in a parallel circular motion to the workpiece surface being finished is a preferred example of an operative finishing motion. Moving the workpiece surface being finished in a parallel circular motion to the finishing element finishing surface is a preferred example of an operative parallel. Moving the finishing element finishing surface in a parallel linear motion to the workpiece surface being finished is a preferred example of an operative finishing motion. Moving the workpiece surface being finished in a parallel linear motion to the finishing element finishing surface is a preferred example of an operative parallel motion. The operative finishing motion performs a significant amount of the polishing and planarizing in this invention.

High speed finishing of the workpiece surface with fixed abrasive finishing elements can cause surface defects in the workpiece surface being finished at higher than desirable rates because of the higher forces generated. As used herein, high speed finishing involves relative operative motion having an equivalent linear velocity of greater than 300 feet per minute and low speed finishing involves relative operative motion having an equivalent linear velocity of at most 300 feet per minute. High speed finishing having a relative operative motion from 300 to 1500 feet per minute is preferred and from 350 to 1000 feet per minute is more preferred. The relative operative speed is measured between the finishing element finishing surface and the workpiece surface being finished. Supplying a lubricating aid between the interface of finishing element finishing surface and the workpiece surface being finished when high speed finishing is preferred to reduce the level of surface defects. Supplying a lubricating aid between the interface of a cylindrical finishing element and a workpiece surface being finished is a preferred example of high speed finishing. Supplying a lubricating aid between the interface of a belt finishing element and a workpiece surface being finished is a preferred example of high speed finishing. An operative finishing motion which maintains substantially different instantaneous relative velocity between the finishing element and some points on the semiconductor wafer is preferred for some finishing equipment. Nonlimiting illustrative examples of some different finishing elements and a cylindrical finishing element are found in patents U.S. Pat. No. 5,735,731 to Lee, U.S. Pat. No. 5,762,536 to Pant, and U.S. Pat. No. 5,759,918 to Hoshizaki et al. and which can be modified by those skilled in the art as appropriate. U.S. Pat. No. 5,735,731 to Lee, U.S. Pat. No. 5,762,536 to Pant, and U.S. Pat. No. 5,759,918 to Hoshizaki et al. are included herein by reference in their entirety.

Friction Sensor Probe

A friction sensor probe to facilitate measurement and control of finishing in this invention is preferred. A friction sensor probe comprises a probe that can sense friction at the interface between a material which is separated from and unconnected to the workpiece surface being finished and the finishing element finishing surface. A friction sensor probe having a friction sensor surface in operative friction motion with the finishing element finishing surface is particularly preferred. Friction sensor surface comprising a material which comprises the same material contained in the workpiece is preferred and which comprises the same material selected from the proximate surface of the workpiece is more preferred and one which comprises a material selected from the surface of the workpiece is even more preferred. Friction sensor surface comprising a material which reacts (or interacts) in a similar manner with the lubricating aid as a material contained in the workpiece is preferred and one which interacts in a similar manner with the lubricating aid as a material selected the same a material proximate to the surface of the workpiece is more preferred and one which interacts in a similar manner with the lubricating aid as a material selected from the surface of the workpiece is even more preferred.

Sensing the change in friction of the friction sensor probe can be accomplished using technology disclosed herein. An optical friction sensor is a preferred friction sensor. Nonlimiting preferred examples of the optical friction sensors is an infrared thermal sensing unit such as a infrared camera and a laser adjusted to read minute changes of movement friction sensor probe to a perturbation. A non-optical sensing friction sensor is a preferred friction sensor. Non-limiting preferred examples of non-optical friction sensors include thermistors, thermocouples, diodes, thin conducting films, and thin metallic conducting films. Electrical performance versus temperature such as conductivity, voltage, and resistance is measured. Those skilled in the thermal measurement arts are generally familiar with non-optical thermal sensors and their use. A change in friction can be detected by rotating the friction sensor probe in operative friction contact with the finishing element finishing surface with electric motors and measuring current changes on one or both motors. The current changes related to friction changes can then be used to produce a signal to operate the friction sensor subsystem. A change in friction can be detected by rotating the friction sensor probe in operative friction contact with the finishing element finishing surface with electric motors and measuring power changes on one or both motors. The power changes related to friction changes can then be used to produce a signal to operate the finishing control subsystem. Optionally one can integrate the total energy used by one or both motors over known time periods to monitor friction changes. One can monitor the temperature of the friction sensor surface with a friction sensor to develop a signal related to the friction at the interface between the friction sensor surface and the finishing element finishing surface. A sensor can also be used to detect imparted translational motion which corresponds to changes in friction. Using this information, integration coefficients can be developed to predict finishing effectiveness. An infrared camera or another type infrared temperature measuring device can be used for detecting and mapping of a temperature of the friction sensor surface which is predictive of the friction at the interface of the friction sensor surface and the finishing element finishing surface. The thermal image can then be analyzed and used to control the operational parameters of finishing. Methods to measure friction are generally well known to those skilled in the art. Non limiting examples of methods to measure friction are described in the following U.S. Pat. No. 5,069,002 to Sandhu et. al., U.S. Pat. No. 5,196,353 to Sandhu, U.S. Pat. No. 5,308,438 to Cote et. al., U.S. Pat. No. 5,595,562 to Yau et. al., U.S. Pat. No. 5,597,442 to Chen, U.S. Pat. No. 5,643,050 to Chen, and U.S. Pat. No. 5,738,562 to Doan et. al. and are included by reference herein in their entirety for guidance. Those skilled in the art can modify this information using the confidential information disclosed herein for use in the friction sensor probes of this invention.

By having at least one friction sensor probe to detect and output signals in real time on changes in friction due to operating parameter changes in lubrication and finishing can be more effectively controlled. By having two friction sensor probes, differential changes in friction can be monitored and used to even more effectively control finishing. Differential changes in friction can be monitored that are due to differential reaction (and/or interaction) and lubrication of different materials on two different friction sensor probe friction sensor surfaces which in turn can be used to better control finishing of the workpiece surface having these two materials. Further the differential lubrication can be related to such finishing control parameters as operative finishing motion speed, type of motion such as continuous or vibrating motions, applied pressure, temperature of finishing, etc. By having at least one friction sensor probe, more preferably two friction sensor probes, which have been calibrated over time, such changes can be recognized and adjusted by those generally skilled in the art with mathematical equations and modeling within the capability of current processor devices such as computers.

By having one friction probe friction sensor surface comprising at least one material selected from the proximate surface of the workpiece surface being finished, control of the active lubrication at the interface between the workpiece being finished and the finishing element finishing surface can be controlled more effectively. By having two friction sensor probe friction sensor surfaces, each comprising at least one material selected from the proximate surface of the workpiece surface being finished, control of the active lubrication at the interface between the workpiece being finished and the finishing element finishing surface can be adjusted and controlled to improve the boundary layer lubrication in the operative finishing interface. One is that active lubrication can vary from bulk lubrication because selective reactions (and/or interactions) with the materials on the workpiece surface being finished. A heterogeneous workpiece surface being finished can have variations from bulk lubrication due to different selective reactions (or interactions) with the lubricant and different materials on the workpiece surface being finished. By having the friction sensor probes, one can control lubrication by the intended result (effect on friction) rather than by concentrations or feed rates. For boundary lubrication with a reactive lubricant, less lubricant is needed once the desired level of boundary lubrication is established. Using friction sensor probes, desired lubrication can be more effectively controlled. Using friction sensor probes, marginal lubrication can be more effectively controlled.

A friction sensor probe of this invention has at least one friction sensor and a friction sensor probe with at least two friction sensors is preferred. A friction sensor probe of this invention has at least one friction sensor surface and a friction sensor probe having at least two friction sensor surfaces is more preferred for some applications. By having more than one friction sensor (such as two thermocouples or one optical temperature sensor and one non-optical friction sensor) a more precise friction can often be obtained. With very expensive workpieces such as semiconductor wafers the additional cost is often justified. By having more than one friction sensor surface, multiple friction readings can be obtained without the additional expense of having two friction probe bodies. Two separate friction sensor probes have additional degrees of freedom in their measurement and freedom of movement so they can often be cost justified. A friction sensor surface generates friction while contacting the surface of the finishing element finishing surface which produces heat. A thermal measurement of the finishing element finishing surface immediately after it departs from the area of friction with the friction sensor probe can also be made with an infrared camera or other optical friction sensor. Applicant currently particularly prefers to measure the friction at a point where the friction sensor surface is still in contact with the finishing element finishing surface (as would occur in use with the friction sensor probe in FIG. 4). Sensing the temperature of the friction sensor surface is very preferred and sensing changes in the temperature of the friction sensor surface is even more preferred. Sensing changes in temperature of the friction sensor surface by sensing changes in temperature of the friction sensing element is also more preferred and sensing changes in temperature of the friction sensor surface by sensing changes in temperature of the friction sensing element is also even more preferred. Applicant recommends having a low thermal mass in the friction sensor surface to increase response time to friction generated heat when a thermal sensor is employed.

A friction sensor subsystem as used herein is the combination of the friction sensor probe operatively connected to a processor and a controller which is capable of controlling the finishing control parameters and the friction sensing control parameters. Non-limiting friction control parameters include the operative friction motion, temperature, and finishing composition type and feed rate. Non-limiting preferred operative friction sensor motions include relative motion between the finishing element finishing surface and the friction sensor surface including velocity, continuous or periodic, and applied pressure. Still further examples of friction sensor motions include circular, tangential, linear, orbital, repetitive, and intermittent motions. A vibrating friction sensor motion is a preferred friction sensor motion for some applications. Mechanical mechanisms which deliver these operative friction sensor motions are well understood by those skilled in the art and are not repeated herein. Electric motors and electric stepper motors are generally known in the industry for driving a mechanical mechanism. Guidance can also be found in mechanical mechanisms used for the carrier motions known in the general CMP industry and adapted for use with a friction sensor probe(s).

A friction sensor subsystem which uses a processor which uses at least in part a mathematical equation to aid control is preferred. A friction sensor subsystem having at least two friction sensor probes and which uses a processor which uses at least in part a mathematical equation to extrapolate from the information from the two probes is also more preferred. A friction sensor subsystem having at least two friction sensor probes and which uses a processor which uses at least in part a mathematical equation to interpolate between the range of information derived from the two probes during the finishing cycle time is more preferred. A friction sensor subsystem having at least two friction sensor probes and which uses a processor which uses at least in part a mathematical equation to interpolate between the information from the two probes at a particular time during the cycle time is more particularly preferred. Controlling finishing with current information from the friction sensor probes for interpolations is often more effective and precise than historical predictions, particularly when the finishing element finishing surface changes with time. Controlling finishing with current information from the friction sensor probes for extrapolations is often more effective and precise than historical predictions, particularly when the finishing element finishing surface changes with time. A friction sensor probe is a preferred example of a friction sensing method.

A friction sensor probe having a surface which is similar to the workpiece surface being finished is preferred and a secondary friction sensor essentially free of abrasive dressing action on the finishing element finishing surface is more preferred and a secondary friction sensor free of abrasive dressing action on the finishing element finishing surface is more preferred (because this can reduce the useful life of the finishing element).

Workpiece Finishing Sensor

A workpiece finishing sensor is a sensor which senses the finishing progress to the workpiece in real time so that an in situ signal can be generated. A workpiece finishing sensor is preferred. A workpiece finishing sensor probe which facilitates measurement and control of finishing in this invention is preferred. A workpiece finishing sensor probe which generates a signal which can be used cooperatively with the friction sensor signal to improve finishing is more preferred. As used herein, a finishing sensor probe is a sensor probe which senses parameters either directly or indirectly related to finishing of the workpiece in the operative finishing interface. A friction sensor probe is an example of a preferred finishing sensor. A workpiece finishing sensor probe is a preferred finishing sensor.

The change in friction during finishing can be accomplished using technology generally familiar to those skilled in the art. A change in friction can be detected by rotating the workpiece being finished and the finishing element finishing surface with electric motors and measuring current changes on one or both motors. The current changes related to friction changes can then be used to produce a signal to operate the finishing control subsystem. A change in friction can be detected by rotating the workpiece finishing surface with the finishing element finishing surface with electric motors and measuring power changes on one or both motors. Changes in friction can also be measured with thermal sensors. A thermistor is a non-limiting example of preferred non-optical thermal sensor. A thermal couple is another preferred non-optical thermal sensor. An optical thermal sensor is a preferred thermal sensor. A infrared thermal sensor is a preferred thermal sensor. Sensors to measure friction in workpieces being finished are generally known to those skilled in the art. Non limiting examples of methods to measure friction in friction sensor probes are described in the following U.S. Pat. No. 5,069,002 to Sandhu et. al., U.S. Pat. No. 5,196,353 to Sandhu, U.S. Pat. No. 5,308,438 to Cote et. al., U.S. Pat. No. 5,595,562 to Yau et. al., U.S. Pat. No. 5, 597,442 to Chen, U.S. Pat. No. 5,643,050 to Chen, and U.S. Pat. No. 5,738,562 to Doan et. al. and are included by reference herein in their entirety for guidance and can be advantageously modified by those skilled in the art for use in this invention. Thermal sensors are available commercially from Terra Universal, Inc. in Anaheim, Calif. and Hart Scientific in American Fork, Utah. Measuring the changes in friction at the interface between the workpiece being finished and the finishing element finishing surface to generate an in situ signal for control is particularly preferred because it can be effectively combined with at least one friction sensor probes to this invention to improve finishing control. Measuring the changes in friction at the interface between the workpiece being finished and the finishing element finishing surface is a useful friction sensing method.

A workpiece finishing sensor for the workpiece being finished is preferred. A sensor for the workpiece being finished selected from the group consisting of friction sensors, thermal sensors, optical sensors, acoustical sensors, and electrical sensor is a preferred sensor for the workpiece being finished in this invention. Workpiece thermal sensors and workpiece friction sensors are non-limiting examples of preferred workpiece friction sensors. As used herein, a workpiece friction sensor can sense the friction between the interface of the workpiece being finished and the finishing element finishing surface during operative finishing motion.

Additional non-limiting preferred examples of workpiece sensors will now be discussed. Preferred optical workpiece sensors are discussed. Preferred non-optical workpiece sensors are also discussed. The endpoint for planarization can be effected by monitoring the ratio of the rate of insulator material removed over a particular pattern feature to the rate of insulator material removal over an area devoid of an underlying pattern. The endpoint can detected by impinging a laser light onto the workpiece being polished and measuring the reflected light versus the expected reflected light as an measure of the planarization process. A system which includes a device for measuring the electrochemical potential of the slurry during processing which is electrically connected to the slurry, and a device for detecting the endpoint of the process, based on upon the electrochemical potential of the slurry, which is responsive to the electrochemical potential measuring device can be used. Endpoint detection can be determined by an apparatus using an interferometer measuring device directed at an unpatterned die on the exposed surface of the wafer to detect oxide thickness at that point. A semiconductor substrate and a block of optical quartz are simultaneously polished and an interferometer, in conjunction with a data processing system is then used to monitor the thickness and the polishing rate of the optical block to develop an endpoint detection method. A layer over a patterned semiconductor is polished and analyzed using optical methods to determine the end point. An energy means for supplying prescribed energy to the semiconductor wafer is used to develop a detecting means for detecting a polishing end point to the polishing of film by detecting a variation of the energy supplied tot the semiconductor wafer. The use of sound waves can be used during chemical mechanical polishing by measuring sound waves emanating from the chemical mechanical polishing action of the substrate against the finishing element. A control subsystem can maintain a wafer count, corresponding to how many wafers are finished and the control subsystem regulates the backside pressure applied to each wafer in accordance with a predetermined function such that the backside pressure increases monotonically as the wafer count increases. The above methods are generally known to those skilled in the art. U.S. Pat. No. 5,081,796 to Schultz, U.S. Pat. No. 5,439,551 to Meikle et al., U.S. Pat. No. 5,461,007 to Kobayashi, U.S. Pat. No. 5,413,941 to Koos et. al., U.S. Pat. No. 5,637,185 Murarka et al., U.S. Pat. No. 5,643,046 Katakabe et al., U.S. Pat. No. 5,643,060 to Sandhu et al., U.S. Pat. No. 5,653,622 to Drill et al., and U.S. Pat. No. 5,705,435 to Chen. are included by reference in their entirety and included herein for general guidance and modification by those skilled in the art.

Changes in lubrication, particularly active lubrication, at the operative finishing interface can significantly affect finishing rates and finishing performance in ways that current workpiece sensors cannot handle as effectively as a remote friction sensor probe (secondary friction sensor probe). For instance, current workpiece sensors can be used in new, surprising manner to aid in the control of the marginal boundary lubrication as discussed herein. Continued operation in the older manner renders some prior art workpiece finishing sensors less effective than desirable for controlling during finishing and stopping finishing where friction is adjusted or changed in real time. Friction sensor probe subsystems as indicated above can help to improve real time control wherein the lubrication is changed during the finishing cycle time. Preferred secondary friction sensors include optical friction sensors and non-optical friction sensors. An optical friction sensor is a preferred friction sensor. Non-limiting preferred examples of optical friction sensors is an infrared thermal sensing unit such as a infrared camera and a laser adjusted to read minute changes of movement friction sensor probe to a perturbation. A non-optical sensing friction sensor is a preferred friction sensor. Non-limiting preferred examples of non-optical friction sensors include thermistors, thermocouples, diodes, thin conducting films, and thin metallic conducting films. Electrical performance versus temperature such as conductivity, voltage, and resistance is measured. Those skilled in the thermal measurement arts are generally familiar with non-optical thermal sensors and their use. A change in friction can be detected by rotating the friction sensor probe in operative friction contact with the finishing element finishing surface with electric motors and measuring current changes on one or both motors. Where the material changes with depth during the finishing of workpiece being finished, one can monitor friction changes with the friction sensor probe surfaces (secondary friction sensor surfaces) having dissimilar materials even with changing organic boundary layer lubrication and therefore readily detect the end point and also perform in situ adjustments to finishing control parameters to optimize finishing with marginal lubrication.

As a preferred example, the pressure can be changed during finishing. With a friction sensor, a processor can rapidly calculate whether the effective coefficient of friction has changed. If the entire semiconductor wafer surface is covered with organic boundary layer lubrication, the effective coefficient of friction will remain very stable. If the semiconductor wafer surface has some regions free from organic boundary layer lubrication, the effective coefficient of friction will change if the percentage of surface area covered by the organic boundary layer lubrication changes with the change in pressure. FIG. 5 discussed herein above shows a representative change in the effective coefficient of friction as the area fraction free from organic boundary lubrication changes. In this manner, a pressure change to the secondary friction sensor probe can be used for in situ process control of marginal lubrication. In this manner, a pressure change in the operative finishing interface can also be used for in situ process control of marginal lubrication. Changing the applied pressure to a friction sensor is a preferred method of in situ control for marginal lubrication and reducing the applied pressure to a friction sensor is a more preferred method of in situ control. Using a reducing pressure change is normally preferred because this minimizes the abraded particles from the semiconductor wafer surface which helps to reduce unwanted semiconductor wafer surface damage. An example of a reducing pressure change is if the normal pressure during finishing is 6 psi, then a reducing pressure change is to reduce the pressure to 5 or 4 psi.

Platen

The platen is generally a stiff support structure for the finishing element. The platen surface facing the workpiece surface being finished is parallel to the workpiece surface being planarized and is flat and generally made of metal. The platen reduces flexing of the finishing element by supporting the finishing element; optionally a pressure distributive element can also be used. The platen surface during polishing is in operative finishing motion to the workpiece surface being finished. The platen surface can be static while the workpiece surface being finished is moved in an operative finishing motion. The platen surface can be moved in a parallel motion fashion while the workpiece surface being finished is static. Optionally, both the platen surface and the workpiece being finished can be in motion in a way that creates an operative finishing motion between the workpiece and the finishing element.

Base Support Structure

The base support structure forms structure which can indirectly aid in applying pressure to the workpiece surface being finished. It generally forms a support surface for those members attached to it directly or operatively connected to the base support structure. Other types of base support structure are generally known in the industry and are functional.

Finishing Element Conditioning

A finishing element can be conditioned before use or between the finishing of workpieces. Conditioning a finishing element is generally known in the CMP field and generally comprises changing the finishing element finishing surface in a way to improve the finishing of the workpiece. As an example of conditioning, a finishing element having no basic ability or inadequate ability to absorb or transport a finishing composition can be modified with an abrasive finishing element conditioner to have a new texture and/or surface topography to absorb and transport the finishing composition. As a non-limiting preferred example, an abrasive finishing element conditioner having a mechanical mechanism to create a finishing element finishing surface which more effectively transports the finishing composition is preferred. The abrasive finishing element conditioner having a mechanical mechanism to create a finishing element finishing surface which more effectively absorbs the finishing composition is also preferred. An abrasive finishing element conditioner having a mechanical mechanism comprising a plurality of abrasive points which through controlled abrasion can modify the texture or surface topography of a finishing element finishing surface to improve finishing composition absorption and/or transport is preferred. An abrasive finishing element conditioner having a mechanical mechanism comprising a plurality of abrasive points comprising a plurality of diamonds which through controlled abrasion can modify the texture and/or surface topography of a finishing element finishing surface to improve finishing composition absorption and/or transport is preferred.

Modifying a virgin finishing element finishing surface with a finishing element conditioner before use is generally preferred. Modifying a finishing element finishing surface with a finishing element conditioner a plurality of times is also preferred. Conditioning a virgin finishing element finishing surface can improve early finishing performance of the finishing element by exposing finishing aids. Modifying a finishing element finishing surface with a finishing element conditioner a plurality of times during its useful life in order to improve the finishing element finishing surface performance over the finishing cycle time by exposing new, unused finishing aid, particularly new finishing aid particles, is preferred. Conditioning a finishing element finishing surface a plurality of times during it useful life can keep the finishing element finishing surface performance higher over its useful lifetime by exposing fresh finishing aid particles to improve finishing performance is preferred. Using feedback information, preferably information derived from friction sensor probes, to select when to modify the finishing element finishing surface with the finishing element conditioner is preferred. Using feedback information, preferably information derived from a friction sensor probe, to optimize the method of modifying the finishing element finishing surface with the finishing element conditioner is more preferred. Use of feedback information is discussed further herein in other sections. When using a fixed abrasive finishing element, a finishing element having three dimensionally dispersed finishing aids is preferred because during the finishing element conditioning process, material is often mechanically removed from the finishing element finishing surface and preferably this removal exposes fresh finishing aids, particularly finishing particles, to improve finishing.

Nonlimiting examples of textures and topographies useful for improving transport and absorption of the finishing composition and/or finishing element conditioners and general use are given in U.S. Pat. No. 5,216,843 to Breivogel, U.S. Pat. No. 5,209,760 to Wiand, U.S. Pat. No. 5,489,233 to Cook et. al., U.S. Pat. No. 5,664,987 to Renteln, U.S. Pat. No. 5,655,951 to Meikle et. al., U.S. Pat. No. 5,665,201 to Sahota, and U.S. Pat. No. 5,782,675 to Southwick and are included herein by reference in their entirety for general background and guidance and modification by those skilled in the art.

Cleaning Composition

After finishing the workpiece such as an electronic wafer, the workpiece must be carefully cleaned before the next manufacturing process step. A lubricating aid or abrasive particles remaining on the finished workpiece can cause quality problems later on and yield losses.

A finishing aid which can be removed from the finished workpiece surface by supplying a water composition to the finished workpiece is preferred and a finishing aid which can be removed from the finished workpiece surface by supplying a hot water composition to the finished workpiece is also preferred. An example of a water composition for cleaning is a water solution comprising water soluble surfactants. An effective amount of lubricating aid which lowers the surface tension of water to help clean abrasive and other adventitious material from the workpiece surface after finishing is particularly preferred.

A lubricating aid which can be removed from the finished workpiece surface by supplying pure water to the finished workpiece to substantially remove all of the lubricating aid is preferred and a lubricating aid which can be removed from the finished workpiece surface by supplying hot pure water to the finished workpiece to substantially remove all of the lubricating aid is also preferred. A lubricating aid which can be removed from the finished workpiece surface by supplying pure water to the finished workpiece to completely remove the lubricating aid is more preferred and a lubricating aid which can be removed from the finished workpiece surface by supplying hot pure water to the finished workpiece to completely remove the lubricating aid is also more preferred. A preferred form of pure water is deionized water. Supplying a cleaning composition having a surfactant which removes lubricating aid from the workpiece surface just polished is a preferred cleaning step. A lubricating aid which lowers the surface tension of the water and thus helps remove any particles from the finished workpiece surface is preferred.

By using water to remove lubricating aid, the cleaning steps are lower cost and generally less apt to contaminate other areas of the manufacturing steps. A water cleaning based process is generally compatible with many electronic wafer cleaning process and thus is easier to implement on a commercial scale.

Process Control Parameters

Preferred process control parameters include those control parameters which can be changed during processing and affect workpiece finishing. Control of the operative finishing motion is a preferred process control parameter. Examples of preferred operative finishing motions include relative velocity, pressure, and type of motion. Examples of preferred types of operative finishing motions include tangential motion, planar finishing motion, linear motion, vibrating motion, oscillating motion, and orbital motion. Finishing temperature is a preferred process control parameter. Finishing temperature can be controlled by changing the heat supplied to the platen or heat supplied to the finishing composition. Alternately, friction can also change the finishing temperature and can be controlled by changes in lubrication, applied pressure during finishing, and relative operative finishing motion velocity. Changes in lubricant can be effected by changing finishing composition(s) and/or feed rate(s). A preferred group of process control parameters consists of parameters selected from the group consisting of operative finishing interface relative velocity, platen velocity, polishing pattern, finishing temperature, force exerted on the operative finishing interface, finishing composition, finishing composition feed rate, and finishing pad conditioning Processor A processor is preferred to help evaluate the friction sensor probe information. A processor can be a microprocessor, an ASIC, or some other processing means. A processor preferably has computational and digital capabilities. Non limiting preferred examples of processing information include use of various mathematical equations, calculating specific parameters, memory look-up tables or databases for generating certain parameters such as historical performance or preferred parameters or constants, neural networks, fuzzy logic techniques for systematically computing or obtaining preferred parameter values. Input parameter (s) can include information on current wafers being polished such as uniformity, expected polish rates, preferred lubricants(s), preferred lubricant concentrations, entering film thickness and uniformity, workpiece pattern. Further preferred non-limiting processor capabilities including adding, subtracting, multiplying, dividing, use functions, look-up tables, noise subtraction techniques, comparing signals, and adjusting signals in real time from various inputs and combinations thereof.

Cost of Manufacture Information

Cost of manufacture parameters for chemical mechanical finishing are very complex. To applicant's knowledge, because of their complexity they have not been used for in situ process improvement. Applicant has now found unexpectedly that cost of manufacture parameters can be used to advantage to improve both finishing control and cost of manufacture during real-time finishing. Particular cost of manufacture parameters are preferred because they have a large impact on efficiency and effectiveness of chemical mechanical finishing as well as the proper selection of improved process control parameters and their selected values. A preferred cost of manufacture parameter is the defect density. FIG. 10 illustrates the effect of defect density on the cost of manufacture for a particular semiconductor wafer (finished wafer valued of $500). Note that an increase of defect density from 0.01 to 0.03 can increase the cost of manufacture for finishing by about $1.50. Another preferred cost of manufacture parameter is equipment yield. FIG. 11 illustrates the effect of a decrease of 1% in equipment yield can increase the cost of manufacture by $2.50 (in process wafer valued of $250). Another preferred cost of manufacture parameter for in situ process control is the parametric yield. FIG. 12 illustrates the effect of a decrease of 1% in parametric yield which can increase the cost of manufacture by $5.00 (finished wafer valued of $500). Another preferred cost of manufacture parameter for in situ process control is the finishing rate. FIG. 13 illustrates the effect of a finishing rate improvement on the cost of manufacture. It is also important to note that depending on the particular finishing conditions, an increase in finishing rate can have a lowering effect on cost of manufacture due to an increase in throughput and can simultaneously increase the cost of manufacture by increasing the yield loss due to increased defect density. By using a processor, appropriate calculations can be made in situ to improve cost of manufacture in real-time. Without the processor and the ready access to preferred cost of manufacture parameters, it is difficult to properly improve the process control parameters during real-time finishing. Cost of manufacture parameters and Cost of Ownership metrics are generally known by those skilled in the semiconductor arts. SEMATECH has published generally widely accepted cost of manufacture parameters and Cost of Ownership metrics which are included herein by reference in their entirety for guidance and use of those skilled in the semiconductor art. Further, Wright Williams and Kelly of Dublin, Calif. have published a manual entitled "Understanding and Using Cost of Ownership" (rev. 0595-1) containing cost of manufacture parameters and equations for cost of manufacture calculation which is also included herein by reference in its entirety for guidance and use of those skilled in the semiconductor arts. Where specific reference is made herein to a specific definition of a particular cost of manufacture metric, applicant will use for instance the Wright Williams and Kelly parametric yield or the SEMATECH equipment yield naming for additional specificity.

Non limiting example of methods to make available preferred cost of manufacture information include use of various mathematical equations, calculating specific parameters, memory look-up tables or databases for generating certain parameters such as historical performance or preferred parameters or constants, neural networks, fuzzy logic techniques for systematically computing or obtaining preferred parameter values. It is also to be understood that of ten a single semiconductor wafer can undergo multiple wafer finishing steps. Each time the semiconductor wafer is finished in a wafer pass, the value of the semiconductor wafer increases due to multiple processing steps and thus the value of the equipment yield changes. A method which updates the cost of manufacture parameters consistent with the current manufacturing step is preferred. Those skilled in the arts of activity based accounting can generally setup appropriate look-up tables containing appropriate cost of manufacture parameters to use for in situ process control given the teachings and guidance herein. The semiconductor wafer can be tracked during processing with a tracking code. As an illustrative example, a semiconductor wafer can be assigned with a trackable UPC code. U.S. Pat. No. 5,537,325 issued to Iwakiri, et al., on Jul. 16, 1997 teaches a method to mark and track semiconductor wafers sliced from an ingot through the manufacturing process and is included for by reference in its entirety for general guidance and appropriate modification by those skilled in the art. Process and cost of manufacture information can be tracked and stored by wafer with this technology when used with the new disclosures herein.

A method of finishing of a semiconductor wafer surface being finished wherein a mathematical formula is used to calculate in situ at least one improved process control parameter value based at least in part upon at least one cost of manufacture parameter selected from the group consisting of parametric yield, equipment yield, defect density, and finishing rate and then adjusting in situ at least one improved process control parameter is preferred. A method of finishing of a semiconductor wafer surface being finished wherein a mathematical formula is used to calculate in situ at least one improved process control parameter value based at least in part upon at least two cost of manufacture parameters selected from the group consisting of parametric yield, equipment yield, defect density, and finishing rate and then adjusting in situ at least one improved process control parameter is more preferred. A method of finishing of a semiconductor wafer surface being finished wherein a mathematical formula is used to calculate in situ at least one improved process control parameter value based at least in part upon at least three cost of manufacture parameters selected from the group consisting of parametric yield, equipment yield, defect density, and finishing rate and then adjusting in situ at least one improved process control parameter is even more preferred. A method of finishing of a semiconductor wafer surface being finished wherein a mathematical formula is used to calculate in situ at least two improved process control parameter values based at least in part upon at least two cost of manufacture parameters selected from the group consisting of parametric yield, equipment yield, defect density, and finishing rate and then adjusting in situ at least those two improved process control parameters is even more particularly preferred. These preferred cost of manufacture parameters are relatively difficult to improve during in situ processing because of their complexity and because they can have opposite effects on the cost of manufacture and thus a processor is quite effective for these calculations. Preferably, the calculations can be completed at least 4 times during the finishing cycle time and more preferably the calculations can be completed at least 6 times during the finishing cycle time and even more preferably the calculations can be completed at least 10 times during the finishing cycle time and even more particularly preferably the calculations can be completed at least 20 times during the finishing cycle time. Preferably, the in situ process control parameter value can be adjusted at least 4 times during the finishing cycle time and more preferably at least 6 times during the finishing cycle time and even more preferably at least 10 times during the finishing cycle time and even more particularly preferably at least 20 times during the finishing cycle time. By repeatedly calculating and adjusting the process control parameter(s) value (s), better process control and improved cost of manufacture can be effected. Generally, a maximum of one hundred calculations and process control parameter adjustments during a finishing cycle time are preferred although more can be used for particularly critical semiconductor wafer finishing. A process control parameter which changes the friction during finishing is a preferred process control parameter and a process control parameter which changes the coefficient of friction is a more preferred process control parameter.

A processor can evaluate input signals rapidly with the cost of manufacture parameters with algorithms, look-up tables, fuzzy logic, iterative calculation methods, and/or solving multiple simultaneous equations to develop an improved output control signal from the controller and/or subsystem controller.

Use of Information for Feedback and Controller

Controllers to control the finishing of workpieces are generally known in the art. Controllers generally use information at least partially derived from the processor to make changes to the process control parameters. A processor is preferably operatively connected to a sensor to gain current information about the process and the processor is also operatively connected to a controller which preferably controls the finishing control parameters. As used herein, a control subsystem is a combination of an operative sensor operatively connected to a processor which is operatively connected to a controller which in turn can change finishing control parameters.

An advantage of this invention is the additional degree of control it gives to the operator performing planarization and/or polishing. To better utilize this control, the use of feedback information to control the finishing control parameters is preferred and in situ control is more preferred. Controlling the finishing control parameters selected from the group consisting of alternate finishing composition feed rates, alternate finishing composition concentration, operative finishing motion, and operative finishing pressure is preferred to improve control of the finishing of the workpiece surface being finished and in situ control is more particularly preferred. Another preferred example of a finishing control parameter is to use a different finishing element for a different portion of the finishing cycle time such as one finishing element for the planarizing cycle time and a different finishing element for the polishing cycle time. Workpiece film thickness, measuring apparatus, and control methods are preferred methods of control. Mathematical equations including those developed based on process results can be used. Finishing uniformity parameters selected from the group consisting of Total Thickness Variation (TTV), Focal plane deviation (FPD), Within-Wafer Non-Uniformity (WIW NU), and surface quality are preferred. Average cut rate is a preferred finishing rate control parameter. Average finishing rate is a preferred finishing rate control parameter. A preferred average cut rate can be the average cut rate across the surface of a semiconductor wafer at a particular time. A preferred average cut rate can be the average cut rate across the uniform region of the surface of a semiconductor wafer at a particular time (for example a uniform compositional region). Controlling finishing for at least a portion of the finishing cycle time with a finishing sensor subsystem to adjust in situ at least one finishing control parameter that affects finishing results is a preferred method of control finishing. Information feedback subsystems are generally known to those skilled in the art. Illustrative non limiting examples of wafer process control methods include U.S. Pat. No. 5,483,129 to Sandhu issued in 1996, U.S. Pat. No. 5,483,568 to Yano issued in 1996, U.S. Pat. No. 5,627,123 to Mogi issued in 1997, U.S. Pat. No. 5,653,622 to Drill issued in 1997, U.S. Pat. No. 5,657,123 to Mogi issued in 1997, U.S. Pat. No. 5,667,629 to Pan issued in 1997, and U.S. Pat. No. 5,695,601 to Kodera issued in 1997 and are included herein by reference in their entirety for guidance and modification by those skilled in the art and are included herein by reference in their entirety.

Using an aqueous lubricating composition having at least one boundary lubricant to form a partial lubricating boundary layer between two surfaces when the surfaces are in operative friction contact is preferred. Lubricating boundary layers can be controlled by changing the boundary layer control parameters. A preferred group of aqueous lubricating composition control parameters consists of parameters selected from the group consisting of operative finishing motion, aqueous lubricating composition, aqueous lubricating composition feed rate, and temperature. Another preferred group of operative finishing motions consists of motions selected from the group consisting of continuous motion, discontinuous motion, pressure, and velocity of the motion. A preferred group of operative finishing motions consists of motions selected from the group consisting of continuous motion, intermittent motion, and velocity of the motion. Vibrating motion, linear motion, and circular motion are preferred motions for changing or controlling the lubricating boundary layer performance. Changing the pressure at the operative finishing interface can change the organic boundary layer lubricating performance and this is a preferred control parameter as discussed herein above. Changing the motion for example, with the speed or type of motion can change the organic boundary layer lubricating performance. Changing the feed rate of the organic boundary layer lubricant can change the performance. Changing the pressure applied in the operative finishing interface, either total pressure or regional pressure, can change the lubricating boundary layer performance. Changing the temperature in the operative finishing interface, either average or regional temperatures, can change the lubricating boundary layer performance. Changing the chemistry of the aqueous lubricating composition can change the performance. Changing the pressure at the operative finishing interface can change the performance. The above parameters are preferred aqueous lubricating composition control parameters and can be used to effect changes in the finishing of the workpiece surface being finished. Changing an aqueous lubricating composition control parameter to change the effective coefficient of friction at the operative finishing interface is preferred and changing an aqueous lubricating composition control parameter to change the effective coefficient of friction at a region in the operative finishing interface is more preferred and changing an aqueous lubricating composition control parameter to change the effective coefficient of friction in at least in two regions of the operative finishing interface is even more preferred. Changing a control parameter to change the tangential force of friction at the operative finishing interface is preferred and changing a control parameter to change the tangential force of friction at a region in the operative finishing interface is more preferred and changing a control parameter to change the tangential force of friction in at least two regions of the operative finishing interface is even more preferred. Changing the organic boundary lubricating layer control parameters at least once during the finishing cycle time is preferred and changing the organic boundary lubricating layer control parameters at least four times during the finishing cycle time is more preferred. Changing the organic boundary lubricating layer control parameters in situ is preferred and changing the organic boundary lubricating layer control parameters in situ with a subsystem controller is more preferred and changing the organic boundary lubricating layer composition control parameters in situ with a controller based on a secondary friction sensor signal is even more preferred. Changing at least one control parameter in situ is preferred and changing at least one control parameter in situ with a subsystem controller is more preferred and changing at least one control parameter in situ with a controller based on a secondary friction sensor signal is even more preferred. Controlling at least one control parameter in situ is preferred and controlling at least one control parameter in situ with a subsystem controller is more preferred and controlling at least one control parameter in situ with a controller based on a secondary friction sensor signal is even more preferred.

Changing at least one organic boundary lubricating layer control parameter during the finishing cycle time in order to change a lubricating boundary layer in a manner that changes the tangential force of friction in at least one region of the semiconductor wafer surface in the operative finishing interface is preferred. Changing at least one of the organic boundary lubricating layer composition control parameters which is in response to an in situ control signal is also preferred. Changing at least one organic boundary lubricating layer control parameter during the finishing cycle time in a manner that changes the effective coefficient of friction in at least two different regions of the semiconductor wafer surface in the operative finishing interface is more preferred. Changing of at least one organic boundary lubricating layer control parameter in a manner that changes the lubricating boundary layers in at least two of the different regions of the semiconductor wafer in response to an in situ control signal is also more preferred. Changing the pressure at the operative finishing interface is a particularly preferred organic boundary lubricating layer control parameter. Using a secondary friction sensor signal to aid in changing the aqueous lubricating composition control parameters is even more preferred.

Applying higher pressure in the unwanted raised region on the semiconductor wafer surface compared to pressure applied to the region below the unwanted raised region causing the boundary layer lubrication to be less on the unwanted raised region and the boundary layer lubrication to be greater on at least a portion of the semiconductor wafer surface below the raised region is a preferred method for differential finishing rates. Applying higher pressure in the unwanted raised region on the semiconductor wafer surface compared to pressure applied to the region below the unwanted raised region causes the boundary layer lubrication to be less on the unwanted raised region and the temperature to be higher on the unwanted raised region and the boundary lubrication to be greater on at least portion of the semiconductor wafer surface below the raised region and the temperature to be lower on the surface below the raised region and is a more preferred method for differential finishing rates.

Supplying an aqueous lubricating composition to the workpiece surface being finished which changes the rate of a chemical reaction is preferred. Supplying an aqueous lubricating composition having a property selected from the group consisting of a change in workpiece surface effective coefficient of friction, workpiece average finish rate change, a heterogeneous workpiece surface having a different ratio of the effective coefficient of frictions for different regions, and a heterogeneous workpiece surface having different finishing rate changes for different regions which reduces unwanted damage to the workpiece surface is particularly preferred.

Controlling at least one of the finishing control parameters using secondary friction sensor information combined with workpiece sensor information is preferred and controlling at least two of the finishing control parameters using secondary friction sensor information combined with workpiece sensor information is more preferred. Using an electronic finishing sensor subsystem to control the finishing control parameters is preferred. Feedback information selected from the group consisting of finishing rate information and product quality information such as surface quality information is preferred. Non-limiting preferred examples of process rate information include polishing rate, planarizing rate, and workpiece finished per unit of time. Non-limiting preferred examples of quality information include first pass first quality yields, focal plane deviation, total thickness variation, measures of non uniformity. Non-limiting examples particularly preferred for electronics parts include Total Thickness Variation (TTV), Focal plane deviation (FPD), Within-Wafer Non-Uniformity (WIW NU), and surface quality.

In situ process control systems relying on workpiece finishing sensors are generally known to those skilled in the CMP industry. Commercial CMP equipment advertised by Applied Materials and IPEC reference some of this equipment.

The use of aqueous lubricating compositions in finishing, particularly those having boundary lubricants, in a preferred embodiment including secondary friction sensor(s), friction sensor controllers, and friction sensor subsystems are unknown in the industry. Supplying a marginal organic boundary layer lubrication with in situ process control to control the fraction of semiconductor wafer surface area free of organic boundary layer lubrication is preferred and unknown in the industry.

Further Comments on Method of Operation

Some particularly preferred embodiments directed at the method of finishing are now discussed.

Providing a finishing element finishing surface for finishing is preferred and providing a finishing element finishing surface having finishing aids for finishing is also preferred and providing a finishing element having a finishing element finishing surface having finishing aids dispersed therein for finishing is also preferred. Providing the workpiece surface being finished proximate to the finishing surface is preferred and positioning the workpiece surface being finished proximate to the finishing element finishing surface is more preferred.

Supplying an operative finishing motion between the workpiece surface being finished and the finishing element finishing surface is preferred and applying an operative finishing motion between the workpiece surface being finished and the finishing element finishing surface is more preferred. The operative finishing motion creates the movement and pressure at the operative finishing interface which supplies the finishing action such as chemical reactions, tribochemical reactions and/or abrasive wear generally caused by the abrasive particles. Applying an operative finishing motion that transfers the finishing aid to the interface between the finishing surface and the workpiece surface being finished is preferred and applying an operative finishing motion that transfers the finishing aid, forming a marginally effective lubricating layer in the operative finishing interface is more preferred and applying an operative finishing motion that transfers the finishing aid, forming a marginally effective lubricating boundary layer in the operative finishing interface is even more preferred. The lubrication at the interface reduces the occurrence of high friction, facilitates reductions in finishing energy, and can help reduce related workpiece surface damage. Applying an operative finishing motion that transfers the finishing aid, forming a lubricating boundary layer between at least a portion of the finishing surface and the semiconductor wafer surface being finished is preferred and applying an operative finishing motion that transfers the finishing aid, forming a marginally effective lubricating layer between at least a portion of the finishing surface and the semiconductor wafer surface being finished in order to control abrasive wear occurring to the semiconductor wafer surface being finished is more preferred and applying an operative finishing motion that transfers the finishing aid, forming a marginally effective lubricating boundary layer between at least a portion of the finishing surface and the semiconductor wafer surface being finished in a manner that tribochemical wear occurs to the semiconductor wafer surface being finished is even more preferred and applying an operative finishing motion that transfers the finishing aid, differentially lubricating different regions of the heterogeneous semiconductor wafer surface being finished is even more particularly preferred. With heterogeneous workpiece surfaces, the potential to differentially lubricate and finish a workpiece surface has high value where the differential lubrication is understood and controlled.

A finishing aid selected from the group consisting of a lubricating aid and chemically reactive aid is preferred. A finishing aid which reacts with the workpiece surface being finished is preferred and one which reacts with a portion of the workpiece surface being finished is more preferred and one which differentially reacts with heterogeneous portions of a workpiece surface being finished is even more preferred. By reacting with the workpiece surface, control of finishing rates can be improved and some surface defects minimized or eliminated. For instance, a preferred organic lubricating boundary layer can react with the workpiece surface. A finishing aid which reduces friction during finishing is also preferred because surface defects can be minimized.

Cleaning the workpiece surface reduces defects in the semiconductor later on in wafer processing.

Supplying a finishing aid to the workpiece surface being finished which changes the rate of a chemical reaction is preferred. Supplying and controlling a finishing aid to the workpiece surface being finished having a property selected from the group consisting of changing the workpiece surface coefficient of friction, changing workpiece surface average cut rate, and changing the cut rate of a specific material of the workpiece surface being finished is particularly preferred.

Providing at least one friction sensor having a friction sensing surface proximate to the finishing element finishing surface and free of contact with the semiconductor wafer surface is preferred and providing at least two friction sensors having friction sensing surfaces proximate to the finishing element finishing surface and free of contact with the semiconductor wafer surface is more preferred. Applying an operative friction sensor motion between the friction sensor surface and the finishing element finishing surface is preferred and applying an operative friction sensor motion between at least two friction sensor surfaces and the finishing element finishing surface is more preferred. Applying at least two separate and independent to operative friction sensor motions between at least two friction sensor surfaces and the finishing element finishing surface is even more preferred in complex finishing situations. A friction sensor, preferably a plurality of friction sensors, can better detect changes in and control of finishing in many finishing situations and especially when lubricating aids are added to the operative finishing interface. Controlling in situ a finishing control parameter with a friction sensor subsystem is preferred and controlling in situ a finishing control parameter with a finishing sensor subsystem is more preferred. As used herein, a friction sensor subsystem includes the friction sensor probe, the processor, and the controller along with the operative connections needed therefore. As used herein, a finishing sensor subsystem includes the friction sensor probe, workpiece sensor (if available), a processor, and a controller along with the operative connections needed therefore. As used herein, a finishing sensor subsystem always has at least one friction sensor probe and a finishing sensor subsystem having at least two friction sensor probes is more preferred and a finishing sensor subsystem having at least one friction sensor probe and at least one workpiece sensor is also more preferred and a finishing sensor subsystem having at least two friction sensor probes and at least one workpiece sensor is particularly preferred for controlling finishing of semiconductor wafers.

Sensing the friction between the friction sensor surface and the finishing element finishing surface with at least one friction sensor subsystem is preferred. Sensing the friction between the friction sensor surface and the finishing element finishing surface with at least one finishing sensor subsystem is more preferred, particularly if a workpiece sensor is operable.

Using the method of this invention to finish a workpiece, especially a semiconductor wafer, by controlling finishing for a period of time with a friction sensor subsystem to adjust in situ at least one finishing control parameter that affects finishing selected from the group consisting of the finishing rate and the finishing uniformity is preferred. A finishing control parameter selected from the group consisting of the finishing composition, finishing composition feed rate, finishing temperature, finishing pressure, operative finishing motion velocity and type, and finishing element type and condition change is preferred. A preferred friction sensor subsystem and a preferred finishing sensor subsystem is operatively connected electrically to the lubrication control mechanism(s). A preferred method to measure finishing rate is to measure the change in the amount of material removed in angstroms per unit time in minutes (.ANG./min). Guidance on the measurement and calculation for polishing rate for semiconductor parts is found in U.S. Pat. No. 5,695,601 to Kodera et. al. issued in 1997 and which are included herein in entirety for illustrative guidance. Methods to measure and monitor finishing rate in angstroms per minute is generally known to those skilled in the relevant art.

An average finishing rate range is preferred, particularly for workpieces requiring very high precision finishing such as in process electronic wafers. Average cut rate is used as a preferred metric to describe preferred finishing rates. Average cut rate is metric and is generally known to those skilled in the art. For electronic workpieces, such as wafers, a cut rate of from 100 to 25,000 Angstroms per minute on at least a portion of the workpiece is preferred and a cut rate of from 200 to 15,000 Angstroms per minute on at least a portion of the workpiece is more preferred and a cut rate of from 500 to 10,000 Angstroms per minute on at least a portion of the workpiece is even more preferred and a cut rate of from 500 to 7,000 Angstroms per minute on at least a portion of the workpiece is even more particularly preferred and a cut rate of from 1,000 to 5,000 Angstroms per minute on at least a portion of the workpiece is most preferred. A finishing rate of at least 100 Angstroms per minute for at least one of the regions on the surface of the workpiece being finished is preferred and a finishing rate of at least 200 Angstroms per minute for at least one of the materials on the surface of the workpiece being finished is preferred and a finishing rate of at least 500 Angstroms per minute for at least one of the regions on the surface of the workpiece being finished is more preferred and a finishing rate of at least 1000 Angstroms per minute for at least one of the regions on the surface of the workpiece being finished is even more preferred where significant removal of a surface region is desired. During finishing there are often regions where the operator desires that the finishing stop when the target is reached such when removing a conductive region (such as a metallic region) over a non conductive region (such as a silicon dioxide region). For regions where it is desirable to stop finishing (such as the silicon dioxide region example above), a finishing rate of at most 1000 Angstroms per minute for at least one of the regions on the surface of the workpiece being finished is preferred and a finishing rate of at least 500 Angstroms per minute for at least one of the materials on the surface of the workpiece being finished is preferred and a finishing rate of at least 200 Angstroms per minute for at least one of the regions on the surface of the workpiece being finished is more preferred and a finishing rate of at least 100 Angstroms per minute for at least one of the regions on the surface of the workpiece being finished is even more preferred. When a low cut rate is desired (for example final finishing, polishing or buffing), a finishing cut rate of at least 10 Angstroms per minute is preferred. The finishing rate can be controlled with organic boundary lubricants and with the process control parameters discussed herein.

Using finishing of this invention to remove raised surface perturbations and/or surface imperfections on the workpiece surface being finished is preferred. Using the method of this invention to finish a workpiece, especially a semiconductor wafer, at a planarizing rate and/or planarizing uniformity according to a controllable set of finishing control parameters that upon variation change the planarizing rate and/or planarizing uniformity and wherein the finishing parameters consist of at least two finishing control parameters is more preferred. Using the method of this invention to polish a workpiece, especially a semiconductor wafer, wherein a finishing sensor subsystem changes an operative finishing composition feed mechanism in situ is preferred. The finishing sensor subsystem and/or friction sensor subsystem is preferably operatively connected electrically to the operative lubrication feed mechanism.

Using the method of this invention to polish or planarize a workpiece, especially a semiconductor wafer, supplying lubrication moderated by a finishing element having at least two layers is preferred. A finishing element having at least two layers wherein the finishing surface layer has a higher hardness than the subsurface layer is more preferred, particularly for planarizing. A finishing element having at least two layers wherein a finishing surface layer has a lower hardness than the subsurface layer is also preferred, particularly for polishing.

Changes in boundary lubricant, particularly active boundary lubrication, at the operative finishing interface can significantly affect finishing rates and finishing performance in ways that current workpiece sensors cannot handle as effectively as desired. For instance, current workpiece sensors cannot effectively monitor and control multiple real time changes in boundary lubricant, particularly active boundary lubrication, and changes in finishing such as finishing rates. This renders prior art workpiece sensors less effective for controlling and stopping finishing where friction is adjusted or changed in real time. Friction sensor subsystems having friction sensors remote from and unconnected to the workpiece can help to improve real time control wherein the boundary lubrication is changed during the finishing cycle time. Preferred friction sensors include optical friction sensors and non-optical friction sensors. An optical friction sensor is a preferred friction sensor. Non-limiting preferred examples of optical friction sensors are an infrared thermal sensing unit such as an infrared camera and a laser adjusted to read minute changes of movement of the friction sensor probe to a perturbation. A non-optical sensing friction sensor is a preferred friction sensor. Non-limiting preferred examples of non-optical friction sensors include thermistors, thermocouples, diodes, thin conducting films, and thin metallic conducting films. Electrical performance versus temperature such as conductivity, voltage, and resistance is measured. Those skilled in the thermal measurement arts are generally familiar with non-optical thermal sensors and their use. A change in friction can be detected by rotating the friction sensor in operative friction contact with the finishing element finishing surface with electric motors and measuring current changes on one or both motors. The current changes related to friction changes can then be used to produce a signal to operate the friction sensor subsystem. Where the material changes with depth during the finishing of a workpiece being finished, one can monitor friction changes with the friction sensor probe(s) having dissimilar materials even with active lubrication and therefore readily detect the end point. As an additional example, the finishing rate can be correlated with the instantaneous boundary lubrication at the operative finishing interface, a mathematical equation can be developed to monitor finishing rate with instantaneous lubrication information from the secondary sensor and the processor then in real time calculates finishing rates and indicates the end point to the controller. The friction sensor probes of this invention are particularly effective for sensing and controlling changes in the lubricating boundary layer and resulting changes in friction therefrom. The control subsystems can readily help to make in situ process changes to improve finishing and reduce manufacturing costs.

Applying an operative finishing motion in the operative finishing interface forming an organic lubricating layer such that a tangential friction force is created in the operative finishing interface which is dependent on lubricant properties other than lubricant viscosity is preferred. Applying an operative finishing motion in the operative finishing interface forming an organic lubricating layer such that a tangential friction force is created in the operative finishing interface which depends on lubricant properties other than lubricant viscosity is preferred. Applying an operative finishing motion in the operative finishing interface forming a differential organic lubricating layer such that a plurality of different tangential friction forces are created in different regions of the operative finishing interface and wherein the plurality of the different tangential friction forces are dependent on lubricant properties other than lubricant viscosity is more preferred. Applying the greater tangential friction force in the unwanted raised region of the semiconductor wafer surface being finished and also applying the lower tangential friction force to a region below and proximate to the unwanted raised region of the semiconductor wafer surface being finished is also more preferred. By creating this type of lubricating layer, finishing of the semiconductor wafer can be accomplished with good finishing rates and reduced unwanted surface defects. Planarization can be improved. Within die nonuniformity can be improved.

Given the guidance and disclosure herein, one skilled in the art can easily see that the friction sensor subsystems and finishing sensor subsystems can easily be used to detect changes to the finishing element finishing surface by monitoring real time changes in friction whether or not changes in lubrication are made and this information can be used by the subsystem to determine advantageous timing for finishing element finishing conditioning and thus improve finishing to a workpiece surface. Given the guidance and disclosure herein, one skilled in the art can easily see that the friction sensor subsystems and finishing sensor subsystems can easily be used to detect changes in friction to the finishing element finishing surface by monitoring real time changes in friction, whether or not changes in lubrication are made. Friction sensor surface can be surfaces similar to the workpiece, surfaces essentially identical to those contained in the workpiece, a standard surface to compare surface friction against, or even an identical finishing element finishing surface. By measuring the change in friction with time or number of wafers processed, improved and cost effective finishing element conditioning can be accomplished. At least two friction sensor probes are preferred when lubricants are used to help different changes in friction due to finishing element finishing surface wear and changes due to lubricant additions and/or changes. The friction sensor probes can be used for finishing element finishing surfaces having a fixed abrasive. The friction sensor probes can give a real time read-out on changes to the "cut-ability" of the fixed abrasive finishing element finishing surfaces and they can also be used to adjust finishing control parameters appropriately to these changes to effect improved finishing of the workpiece surface.

Common semiconductor wafer finishing involves the removal of one layer comprised predominantly of a conductive material such as copper during finishing in order to change to a predominantly non-conductive material. Changes in friction measured by the friction sensor probes, with or without the addition of lubricant, along with knowledge of finishing performance as a function of this measure of friction, and particularly when integrated with a workpiece sensor, can deliver good finishing control and ability to stop finishing when desired. End points can be detected by detecting a changed level of friction at the operative finishing interface by using the friction sensor probes to detect and develop information to correct in real time to changing finishing control parameters including, but not limited to, changes in lubrication and changes in finishing element finishing surface changes with time.

Changing the pressure at the operative finishing interface to detect potential changes in the effective coefficient of friction is preferred and changing the pressure at least four times at the operative finishing interface to detect potential changes in the effective coefficient of friction is more preferred and changing the pressure at least ten times at the operative finishing interface to detect potential changes in the effective coefficient of friction is more preferred and changing the pressure at least twenty times at the operative finishing interface to detect potential changes in the effective coefficient of friction is more preferred. Changing the effective coefficient of friction by at least in part changing the pressure applied to the friction sensor is a preferred embodiment. Changing the pressure applied to a secondary friction sensor to detect potential changes in the effective coefficient of friction is preferred and changing the pressure at least four times applied to a secondary friction sensor to detect potential changes in the effective coefficient of friction is more preferred and changing the pressure at least ten times applied to a secondary friction sensor to detect potential changes in the effective coefficient of friction is more preferred and changing the pressure at least twenty times applied to a secondary friction sensor to detect potential changes in the effective coefficient of friction is more preferred. Controlling at least one finishing control parameter changing the effective coefficient of friction in the operative finishing interface is preferred. Changing the aqueous lubricating composition control parameters based on feedback information is preferred and changing the aqueous lubricating composition control parameters in situ based on feedback information with an aqueous lubricating composition control subsystem is more preferred. Changing the aqueous lubricating composition control parameters such as concentration, pressure, and time period of lubrication (or some combination thereof) can improve the quality of the final finishing step. Supplying a plurality of aqueous lubricating compositions during finishing can be preferred for some applications. Supplying an aqueous lubricating composition having a plurality of lubricants during finishing can be preferred for some applications (such as different lubricants at different times). Depending on the application and the particular surface at the moment being finished, the plurality of aqueous lubricating compositions can be supplied simultaneously or sequentially. For instance, one can supply a planarizing aqueous lubricating composition and then later a polishing aqueous lubricating composition.

Changing the lubrication control parameters at least once during workpiece finishing is preferred and changing the lubrication control parameters at least twice during workpiece finishing is more preferred. Changing the lubrication control parameters in steps is preferred. Changing the lubrication control parameters based on feedback information is preferred and changing the lubrication control parameters in situ based on feedback information with a lubrication control subsystem is more preferred. Changing the lubrication control parameters such as concentration and time period (or some combination thereof) can improve the quality of the final finishing step. Supplying a plurality of lubricants during finishing can be preferred for some applications. Depending on the application and the particular surface at the moment being finished, the plurality of lubricants can be supplied simultaneously or sequentially. For instance, one can supply a planarizing lubricant and then later a polishing lubricant. A lubrication control parameter is a parameter which affects the lubrication of the operative finishing interface. A boundary lubrication control parameter is a parameter which affects the boundary lubrication in the operative finishing interface. A parameter selected from the group consisting of the lubricant chemistry, lubricant concentration, lubricant feed rate, operative finishing interface temperature, operative finishing interface pressure, and operative finishing interface motion is a preferred lubricating boundary layer control parameter. A parameter selected from the group consisting of the local lubricant chemistry, local lubricant concentration, local lubricant feed rate, local operative finishing interface temperature, local operative finishing interface pressure, and local operative finishing interface motion is a preferred local lubricating boundary layer control parameter.

Applying a discontinuous motion to a friction sensor to sense the effective coefficient of friction is preferred. Applying a perturbation to the friction sensor to sense the effective coefficient of friction is preferred. Applying a discontinuous motion to a friction sensor probe separated from and unconnected to the workpiece to sense the effective coefficient of friction is more preferred. Applying a perturbation to the friction sensor probe to sense separated from and unconnected to the workpiece the effective coefficient of friction is more preferred. This can sense preferred information for in situ control of the organic boundary lubricating layer within preferred effective coefficient of friction ranges and for control using cost of manufacture parameters.

Supplying an organic lubricant for a portion of finishing cycle time is preferred. Supplying an organic lubricant for a secondary finishing step after a first finishing step free of lubricant, can be preferred. Using two finishing steps, one with lubricant and one free of lubricant can reduce unwanted surface damage when finishing a semiconductor wafer. Using two finishing steps can also increase the finishing rate.

Providing a separate aqueous lubricating composition and a separate alternate finishing composition proximate to the workpiece heterogeneous workpiece surface being finished for use between the finishing element surface and the workpiece being finished is a preferred step in the method. Providing an effective amount of an aqueous lubricating composition between the finishing element surface and the workpiece being finished for at least a portion of the finishing time in order to reduce the effective coefficient of friction between the finishing element surface and the workpiece being finished and providing a separate alternate finishing composition between the finishing element finishing surface and the workpiece being finished for at least a portion of the finishing time is also preferred. Separate and distinct feed lines and reservoirs for the aqueous lubricating composition and the alternate finishing composition and delivery of their product by each separate system near or proximate to the point of use are preferred.

SUMMARY

Particularly preferred embodiments of this invention include the combination of in situ control using a processor having access to cost of manufacture parameters and using mathematical evaluations to change in real time process control parameters which change the effective coefficient of friction at the operative finishing interface. Real time rapid control of such preferred process control parameter as the pressure applied to the operative finishing interface to improve finishing is preferred. At least one process sensor is preferred and at least two process sensors are more preferred and at least three process sensors are even more preferred. A friction sensor probe remote from the workpiece being finished is preferred. Illustrative preferred processor sensors include friction sensor probes and their use as shown herein in FIG. 5. FIG. 5 also illustrates a particularly preferred embodiment of this invention for guidance for those skilled in the art. Changing the Effective Coefficient of Friction in the operative finishing interface having an organic boundary layer lubricant with fast response process control variables is particularly preferred. Preferably the Effective Coefficient of Friction is substantially reversible over the range of change of the Effective Coefficient of Friction and more preferably the Effective Coefficient of Friction is reversible over the range of change of the Effective Coefficient of Friction during finishing cycle time. A change in pressure is a particularly preferred, fast response time process control parameter which can be varied over reversible ranges. Particularly preferred cost of manufacture parameters can be selected from the group consisting of parametric yield, equipment yield, defect density, and finishing rate. Other preferred cost of manufacture parameters include equipment utilization, raw materials cost such as slurry, chemicals, finishing element cost, cleaning chemicals and/or equipment. Thus another preferred set of cost of manufacture parameters can be selected from the group consisting of parametric yield, equipment yield, defect density, finishing rate, and consumable materials costs. Still other preferred cost of manufacture parameters include mean time to finishing element change and mean time to finishing element conditioning. Illustrative examples of consumable materials costs include slurry cost, other chemical costs, and cleaning chemical costs. The cost of manufacture effects on other steps of the manufacturing of the completed semiconductor wafer can also be considered such as lithography (and of other cost of individual processing steps). By tracking individual semiconductor wafer, the in process cost of manufacture of individual semiconductor wafer can be tracked and used for improving the finishing process. A processor is needed to perform the multiple calculations in the preferred real time rapid process control to improve finishing. This can help reduce unwanted surface defects and also reduce the cost of manufacture for finishing. FIG. 16 shows some preferred steps in one preferred embodiment of this invention.

Illustrative nonlimiting examples of useful technology have been referenced by their patents numbers and all of these patents are included herein by reference in their entirety for further general guidance and modification by those skilled in the arts.

The scope of the invention should be determined by the appended claims and their legal equivalents, rather than by the preferred embodiments and details as discussed herein.

I claim:

1. A method of finishing of a semiconductor wafer surface comprising the steps of:

providing a finishing element finishing surface;

positioning the semiconductor wafer surface proximate to the finishing element finishing surface;

providing at least one finishing sensor probe capable of monitoring the finishing of the semiconductor wafer surface;

applying an operative finishing motion between the semiconductor wafer surface and the finishing element finishing surface forming an operative finishing interface;

sensing the progress of the finishing of the semiconductor wafer surface with the finishing sensor probe and sending the progress of the finishing to a processor having access to current cost of manufacture parameters;

evaluating the finishing progress parameters for improved adjustment using both the current cost of manufacture parameters and finishing control parameters to improve the cost of manufacture; and controlling in situ a finishing control parameter to improve the cost of manufacture of the semiconductor wafer surface.

2. The method of finishing according to claim 1 wherein at least one cost of manufacture parameter is selected from the group consisting of parametric yield, equipment yield, defect density, and finishing rate.

3. The method of finishing according to claim 2 wherein the evaluating step uses a mathematical formula to calculate in situ at least one improved process control parameter value based at least in part upon the at least one cost of manufacture parameter selected from the group consisting of parametric yield, equipment yield, defect density, and finishing rate and then adjusting in situ at least one improved process control parameter.

4. The method of finishing according to claim 1 wherein at least two cost of manufacture parameters are selected from the group consisting of parametric yield, equipment yield, defect density, and finishing rate.

5. The method of finishing according to claim 4 wherein the evaluating step uses a mathematical formula to calculate in situ at least one improved process control parameter value based at least in part upon the at least two cost of manufacture parameters selected from the group consisting of parametric yield, equipment yield, defect density, and finishing rate and then adjusting in situ at least that one improved process control parameter.

6. The method of finishing according to claim 1 wherein at least three cost of manufacture parameters are selected from the group consisting of parametric yield, equipment yield, defect density, and finishing rate.

7. The method of finishing according to claim 6 wherein the evaluating step uses a mathematical formula to calculate in situ at least one improved process control parameter value based at least in part upon the at least three cost of manufacture parameters selected from the group consisting of parametric yield, equipment yield, defect density, and finishing rate and then adjusting in situ at least one improved process control parameter.

8. The method of finishing according to claim 1 wherein the evaluating step uses a mathematical formula to calculate in situ at least one improved process control parameter value based at least in part upon the cost of manufacture parameters and then controlling in situ at least one improved process control parameter.

9. The method of finishing according to claim 1 wherein the evaluating step uses a mathematical formula to calculate in situ at least two improved process control parameter values based at least in part upon at least two cost of manufacture parameters selected from the group consisting of parametric yield, equipment yield, defect density, and finishing rate and then adjusting in situ at least those two improved process control parameters.

10. The method of finishing according to claim 1 wherein the step of evaluating finishing control parameters for improved adjustment involves using at least two cost of manufacture parameters comprising equipment utilization and raw materials cost.

11. The method of finishing according to claim 1 wherein the step of evaluating finishing control parameters for improved adjustment involves using at least one cost of manufacture parameter comprising first pass first quality yield.

12. The method of finishing according to claim 1 wherein the step of evaluating finishing control parameters for improved adjustment involves using at least one cost of manufacture parameter comprising equipment yield.

13. A method of finishing of a semiconductor wafer surface comprising the steps of:

providing a finishing element finishing surface;

positioning the semiconductor wafer surface proximate to the finishing surface;

providing at least one friction sensor probe capable of measuring at least one parameter related to friction during finishing of semiconductor wafer surface;

providing at least one cost of manufacture parameter;

applying an operative finishing motion between the semiconductor wafer surface and the finishing surface forming an operative finishing interface;

sensing at least one parameter related to friction during the finishing of the semiconductor wafer surface with the friction sensor probe and sending at least one parameter related to friction to a processor having access to at least one cost of manufacture parameter;

evaluating finishing process parameters for improved adjustment using both the current cost of manufacture parameters and finishing control parameters for improving cost of manufacture; and controlling in situ a finishing control parameter to improve the cost of manufacture of the semiconductor wafer surface.

14. The method of finishing according to claim 13 wherein at least one cost of manufacture parameter is selected from the group consisting of parametric yield, equipment yield, defect density, and finishing rate.

15. The method of finishing according to claim 14 wherein the evaluating step uses a mathematical formula to calculate in situ at least one improved process control parameter value based at least in part upon at least two cost of manufacture parameters selected from the group consisting of parametric yield, equipment yield, defect density, and finishing rate and then adjusting in situ at least one improved process control parameter.

16. The method of finishing according to claim 13 wherein at least two cost of manufacture parameters are selected from the group consisting of parametric yield, equipment yield, defect density, and finishing rate.

17. The method of finishing according to claim 16 wherein the evaluating step uses a mathematical formula to calculate in situ at least one improved process control parameter value based at least in part upon at least two cost of manufacture parameters selected from the group consisting of parametric yield, equipment yield, defect density, and finishing rate and then adjusting in situ at least one improved process control parameter.

18. The method of finishing according to claim 13 wherein at least three cost of manufacture parameters are selected from the group consisting of parametric yield, equipment yield, defect density, and finishing rate.

19. The method of finishing according to claim 18 wherein the evaluating step uses a mathematical formula to calculate in situ at least one improved process control parameter value based at least in part upon at least three cost of manufacture parameters selected from the group consisting of parametric yield, equipment yield, defect density, and finishing rate and then adjusting in situ at least one improved process control parameter.

20. The method of finishing according to claim 13 wherein the evaluating step uses a mathematical formula to calculate in situ at least one improved process control parameter value based at least in part upon the cost of manufacture parameters and then adjusting in situ at least one improved process control parameter.

21. The method of finishing according to claim 13 wherein the evaluating step uses a mathematical formula to calculate in situ at least two improved process control parameter values based at least in part upon at least two cost of manufacture parameters selected from the group consisting of parametric yield, equipment yield, defect density, and finishing rate and then adjusting in situ at least those two improved process control parameters.

22. The method of finishing according to claim 13 wherein the evaluating finishing control parameters for improved adjustment involves using at least one cost of manufacture parameter comprising equipment yield.

23. The method of finishing according to claim 13 wherein the evaluating finishing control parameters for improved adjustment involves using at least one cost of manufacture parameter comprising parametric yield.

24. The method of finishing according to claim 13 wherein the evaluating finishing control parameters for improved adjustment involves using at least one cost of manufacture parameter comprising a consumable material cost.

25. A method of finishing of a semiconductor wafer having a semiconductor wafer surface comprising the steps of:

providing a finishing element finishing surface;

positioning the semiconductor wafer surface proximate to the finishing element finishing surface;

providing at least one operative sensor capable of gaining information about the finishing;

applying an operative finishing motion between the semiconductor wafer surface and the finishing element finishing surface forming an operative finishing interface;

sensing the progress of the finishing of the semiconductor wafer surface with the operative sensor and sending the information about the finishing to a processor having access to current cost of manufacture parameters;

evaluating finishing control parameters for improved adjustment using both the current cost of manufacture parameters and finishing control parameters to improve the cost of manufacture; and controlling in situ a finishing control parameter to improve the cost of manufacture of the semiconductor wafer.

26. The method of finishing according to claim 25 wherein the operative sensor comprises a plurality of operative sensors.

27. The method of finishing according to claim 25 further comprising the step of tracking finishing progress and the cost of manufacture parameters with a tracking code for the semiconductor wafer for tracking before the step of evaluating the finishing control parameters.

28. The method of finishing according to claim 25 further comprising the additional step of supplying an organic lubricant between the semiconductor wafer surface and the finishing element finishing surface to reduce the coefficient of friction between the semiconductor wafer surface and the finishing element finishing surface during finishing.

29. The method of finishing according to claim 25 further comprising the additional steps of supplying an organic boundary lubricant between the semiconductor wafer surface and the finishing element finishing surface and then applying the operative finishing motion forming an organic lubricating boundary layer to reduce the coefficient of friction between the semiconductor wafer surface and the finishing element finishing surface during finishing.

30. The method of finishing according to claim 25 further comprising the additional steps of supplying an organic boundary lubricant between the semiconductor wafer surface and the finishing element finishing surface and then applying the operative finishing motion forming an organic lubricating boundary layer which differentially lubricates different regions of the semiconductor wafer and reduces the unwanted surface damage to at least a portion of the surface of the semiconductor wafer during finishing.

31. The method of finishing according to claim 25 further comprising the additional step of supplying an organic lubricant between the semiconductor wafer surface and the finishing element finishing surface and wherein a lubricating film is formed which adheres to the semiconductor wafer surface during finishing.

32. The method of finishing according to claim 25 wherein controlling in situ comprises adjusting at least 4 times during a finishing cycle time the finishing control parameter to improve the cost of manufacture of the semiconductor wafer.

33. The method of finishing according to claim 25 wherein:

the finishing of the semiconductor wafer surface has a finishing cycle time; and wherein evaluating finishing control parameters for improved adjustment involves using at least two cost of manufacture parameters comprising equipment utilization and raw materials cost; and wherein controlling in situ comprises adjusting at least 4 times during the finishing cycle time the finishing control parameter to improve the cost of manufacture of the semiconductor wafer.

34. The method of finishing according to claim 25 wherein:

the finishing of the semiconductor wafer surface has a finishing cycle time; and wherein evaluating finishing control parameters for improved adjustment involves using at least two cost of manufacture parameters comprising mean time to finishing element change and mean time to finishing element conditioning; and wherein controlling in situ comprises adjusting at least 4 times during the finishing cycle time a finishing control parameter to improve the cost of manufacture of the semiconductor wafer.

35. The method of finishing according to claim 25 wherein:

the finishing of the semiconductor wafer surface has a finishing cycle time; and wherein evaluating finishing control parameters for improved adjustment involves using at least one cost of manufacture parameter comprising parametric yield; and wherein controlling in situ comprises adjusting at least 10 times during the finishing cycle time a finishing control parameter to improve the cost of manufacture of the semiconductor wafer.

36. The method of finishing according to claim 25 wherein:

the finishing of the semiconductor wafer surface has a finishing cycle time; and wherein evaluating finishing control parameters for improved adjustment comprises using an algorithm; and wherein controlling in situ comprises adjusting at least 4 times during the finishing cycle time the finishing control parameters to improve the cost of manufacture of the semiconductor wafer.

37. The method of finishing according to claim 36 wherein evaluating finishing control parameters for improved adjustment further comprises using look-up tables.

38. The method of finishing according to claim 25 wherein:

the finishing of the semiconductor wafer surface has a finishing cycle time; and wherein evaluating finishing control parameters for improved adjustment comprises using look-up tables; and wherein controlling in situ comprises adjusting at least 6 times during the finishing cycle time the finishing control parameters to improve the cost of manufacture of the semiconductor wafer.

39. The method of finishing according to claim 25 wherein:

the finishing of the semiconductor wafer surface has a finishing cycle time; and wherein evaluating finishing control parameters for improved adjustment comprises using process rate information; and wherein controlling in situ comprises adjusting at least 6 times during the finishing cycle time the finishing control parameters to improve the cost of manufacture of the semiconductor wafer.

40. A method of finishing of a semiconductor wafer having a semiconductor wafer surface comprising the steps of:

providing a finishing element finishing surface;

positioning the semiconductor wafer surface proximate to the finishing element finishing surface;

providing at least one operative sensor capable of gaining information about the finishing;

applying an operative finishing motion between the semiconductor wafer surface and the finishing element finishing surface forming an operative finishing interface;

sensing the progress of the finishing of the semiconductor wafer surface with the operative sensor and sending the information about the finishing to a processor having access to current cost of manufacture parameters;

evaluating finishing control parameters for improved adjustment using at least in part at least two cost of manufacture parameters; and controlling at least two process control parameters to improve the cost of manufacture of the semiconductor wafer.

41. The method of finishing according to claim 40 wherein the at least two cost of manufacture parameters are selected from the group consisting of parametric yield, equipment yield, defect density, and finishing rate.

42. The method of finishing according to claim 40 wherein:

the finishing of the semiconductor wafer surface has a finishing cycle time; and wherein evaluating finishing control parameters for improved adjustment involves using the at least two cost of manufacture parameters comprising equipment utilization and raw materials cost; and wherein controlling at least two process control parameters comprises adjusting at least 4 times during the finishing cycle time a finishing control parameter to improve the cost of manufacture of the semiconductor wafer.

43. The method of finishing according to claim 40 wherein:

the finishing of the semiconductor wafer surface has a finishing cycle time; and wherein evaluating finishing control parameters for improved adjustment involves using the at least two cost of manufacture parameters comprising mean time to finishing element change and mean time to finishing element conditioning; and wherein controlling at least two process control parameters comprises adjusting at least 4 times during the finishing cycle time a finishing control parameter to improve the cost of manufacture of the semiconductor wafer.

44. The method of finishing according to claim 40 wherein:

the finishing of the semiconductor wafer surface has a finishing cycle time; and wherein evaluating finishing control parameters for improved adjustment involves using at least one cost of manufacture parameter comprising parametric yield; and wherein controlling at least two process control parameters comprises adjusting at least 10 times during the finishing cycle time a finishing control parameter to improve the cost of manufacture of the semiconductor wafer.

45. A method of finishing of a semiconductor wafer having a semiconductor wafer surface comprising the steps of:

providing a finishing element finishing surface;

positioning the semiconductor wafer surface proximate to the finishing element finishing surface;

providing at least one operative sensor capable of gaining information about the finishing;

applying an operative finishing motion between the semiconductor wafer surface and the finishing element finishing surface forming an opertive finishing interface;

sensing the progress of the finishing of the semiconductor wafer surface with the operative sensor and sending the information about the finishing to a processor having access to current cost of manufacture parameters;

evaluating finishing control parameters for improved adjustment using at least in part at least three cost of manufacture parameters; and controlling at least two process control parameters to improve the cost of manufacture of the semiconductor wafer.

46. The method of finishing according to claim 45 wherein:

the finishing of the semiconductor wafer surface has a finishing cycle time; and wherein evaluating finishing control parameters for improved adjustment involves using at least one cost of manufacture parameter comprising equipment yield; and wherein controlling at least two process control parameters comprises adjusting at least 10 times during the finishing cycle time at least one finishing control parameter to improve the cost of manufacture of the semiconductor wafer.

47. A method of finishing of a semiconductor wafer having a semiconductor wafer surface comprising the steps of:

providing a finishing element finishing surface;

positioning the semiconductor wafer surface proximate to the finishing element finishing surface;

providing at least one operative sensor capable of gaining information about the finishing;

applying an operative finishing motion between the semiconductor wafer surface and the finishing element finishing surface forming an operative finishing interface;

sensing the progress of the finishing of the semiconductor wafer surface with the operative sensor and sending the information about the finishing to a processor having access to current cost of manufacture parameters;

evaluating finishing control parameters for improved adjustment using at least in part at least three cost of manufacture parameters; and controlling at least two process control parameters to improve the cost of manufacture of the semiconductor wafer.

48. The method of finishing according to claim 45 wherein the at least three cost of manufacture parameters are selected from the group consisting of parametric yield, equipment yield, defect density, and finishing rate.

49. The method of finishing according to claim 45 wherein:

the finishing of the semiconductor wafer surface has a finishing cycle time; and wherein evaluating finishing control parameters for improved adjustment involves using at least one cost of manufacture parameter comprising defect yield; and wherein controlling at least two process control parameters comprises adjusting at least 10 times during the finishing cycle time at least one finishing control parameter to improve the cost of manufacture of the semiconductor wafer.

50. The method of finishing according to claim 45 wherein:

the finishing of the semiconductor wafer surface has a finishing cycle time; and wherein evaluating finishing control parameters for improved adjustment involves using at least one cost of manufacture parameter comprising first pass first quality yield; and wherein controlling at least two process control parameters comprises adjusting at least 10 times during the finishing cycle time at least one finishing control parameter to improve the cost of manufacture of the semiconductor wafer.

51. The method of finishing according to claim 45 wherein:

the finishing of the semiconductor wafer surface has a finishing cycle time; and wherein evaluating finishing control parameters for improved adjustment involves using an algorithm; and wherein controlling at least two process control parameters comprises adjusting at least 4 times during the finishing cycle time a process control parameter of the at least two process control parameters to improve the cost of manufacture of the semiconductor wafer.

52. The method of finishing according to claim 51 wherein evaluating process finishing parameters for improved adjustment further comprises using look-up tables.

53. The method of finishing according to claim 45 wherein:

the finishing of the semiconductor wafer surface has a finishing cycle time; and wherein evaluating finishing control parameters for improved adjustment comprises using look-up tables; and wherein controlling at least two process control parameters comprises adjusting at least 6 times during the finishing cycle time a process control parameter of the at least two process control parameters to improve the cost of manufacture of the semiconductor wafer.

54. The method of finishing according to claim 45 wherein:

the finishing of the semiconductor wafer surface has a finishing cycle time; and wherein evaluating finishing control parameters for improved adjustment comprises using process rate information; and wherein controlling at least two process control parameters comprises adjusting at least 6 times during the finishing cycle time a process control parameter of the at least two process control parameters to improve the cost of manufacture of the semiconductor wafer.

55. A method of finishing of a semiconductor wafer having a semiconductor wafer surface comprising the steps of:

providing an abrasive finishing element finishing surface;

positioning the semiconductor wafer surface proximate to the finishing element finishing surface;

providing at least one operative sensor capable of gaining information about the finishing;

applying an operative finishing motion between the semiconductor wafer surface and the finishing element finishing surface forming an operative finishing interface;

sensing the progress of the finishing of the semiconductor wafer surface with the operative sensor and sending the information about the finishing to a processor having access to current cost of manufacture parameters;

evaluating finishing control parameters for improved adjustment using at least in part at least three cost of manufacture parameters; and controlling at least two process control parameters to improve the cost of manufacture of the semiconductor wafer.

56. The method of finishing according to claim 51 wherein:

the finishing of the semiconductor wafer surface has a finishing cycle time; and wherein evaluating finishing control parameters for improved adjustment involves using at least two cost of manufacture parameters comprising mean time to finishing element change and mean time to finishing element conditioning; and wherein controlling at least two process control parameters comprises adjusting at least 4 times during the finishing cycle time a finishing control parameter to improve the cost of manufacture of the semiconductor wafer.

57. The method of finishing according to claim 51 wherein:

the finishing of the semiconductor wafer surface has a finishing cycle time; and wherein evaluating finishing control parameters for improved adjustment involves using at least two cost of manufacture parameters comprising equipment utilization and raw materials cost; and wherein controlling at least two process control parameters comprises adjusting at least 4 times during the finishing cycle time a finishing control parameter to improve the cost of manufacture of the semiconductor wafer.

58. The method of finishing according to claim 51 wherein:

the finishing of the semiconductor wafer surface has a finishing cycle time; and wherein evaluating finishing control parameters for improved adjustment involves using at least one cost of manufacture parameter comprising first pass first quality yield; and wherein controlling at least two process control parameters comprises adjusting at least 4 times during the finishing cycle time at least one finishing control parameter to improve the cost of manufacture of the semiconductor wafer.

59. The method of finishing according to claim 51 wherein:

the finishing of the semiconductor wafer surface has a finishing cycle time; and wherein evaluating finishing control parameters for improved adjustment includes using at least two cost of manufacture parameters comprising equipment utilization and raw materials cost; and wherein controlling at least two process control parameters comprises adjusting at least 4 times at least two finishing control parameters during the finishing cycle time to improve the cost of manufacture of the semiconductor wafer.

60. The method of finishing according to claim 51 wherein:

the finishing of the semiconductor wafer surface has a finishing cycle time; and wherein evaluating finishing control parameters for improved adjustment includes using at least one cost of manufacture parameter comprising first pass first quality yield; and wherein controlling at least two process control parameters comprises adjusting at least 4 times at least two finishing control parameters during the finishing cycle time to improve the cost of manufacture of the semiconductor wafer.

61. The method of finishing according to claim 55 wherein:

the finishing of the semiconductor wafer surface has a finishing cycle time; and wherein evaluating finishing control parameters for improved adjustment comprises using an algorithm; and wherein controlling at least two process control parameters comprises adjusting at least 4 times during the finishing cycle time a process control parameter of the at least two process control parameters to improve the cost of manufacture of the semiconductor wafer.

62. The method of finishing according to claim 61 wherein evaluating process finishing parameters for improved adjustment further comprises using look-up tables.

63. The method of finishing according to claim 55 wherein:

the finishing of the semiconductor wafer surface has a finishing cycle time; and wherein evaluating finishing control parameters for improved adjustment comprises using look-up tables; and wherein controlling at least two process control parameters comprises adjusting at least 6 times during the finishing cycle time a process control parameter of the at least two process control parameters to improve the cost of manufacture of the semiconductor wafer.

64. The method of finishing according to claim 55 wherein:

the finishing of the semiconductor wafer surface has a finishing cycle time; and wherein evaluating finishing control parameters for improved adjustment comprises using process rate information; and wherein controlling at least two process control parameters comprises adjusting at least 6 times during the finishing cycle time a process control parameter of the at least two process control parameters to improve the cost of manufacture of the semiconductor wafer.

* * * * *